US011060281B2

(12) United States Patent
LeBlang

(10) Patent No.: US 11,060,281 B2
(45) Date of Patent: Jul. 13, 2021

(54) SPACER BRACES IN TANDEM FOR WALLS, JOISTS AND TRUSSES

(71) Applicant: Dennis LeBlang, Palm Desert, CA (US)

(72) Inventor: Dennis LeBlang, Palm Desert, CA (US)

( * ) Notice: Subject to any disclaimer, the term of this patent is extended or adjusted under 35 U.S.C. 154(b) by 0 days.

(21) Appl. No.: 15/090,460

(22) Filed: Apr. 4, 2016

(65) Prior Publication Data

US 2017/0284090 A1 Oct. 5, 2017

(51) Int. Cl.

| | |
|---|---|
| ***E04C 3/07*** | (2006.01) |
| ***E04B 2/58*** | (2006.01) |
| ***E04B 2/70*** | (2006.01) |
| ***E04C 3/292*** | (2006.01) |
| *E04B 1/24* | (2006.01) |
| *E04C 3/02* | (2006.01) |
| *E04C 3/04* | (2006.01) |

(52) U.S. Cl.

CPC ..... *E04B 2/58* (2013.01); *E04B 2/707* (2013.01); *E04C 3/07* (2013.01); *E04C 3/292* (2013.01); *E04B 2001/2415* (2013.01); *E04B 2001/2496* (2013.01); *E04C 2003/026* (2013.01); *E04C 2003/0473* (2013.01)

(58) Field of Classification Search

CPC ..... E04C 3/07; E04C 3/292; E04C 2003/026; E04C 2003/0473; E04B 1/40; E04B 2/58; E04B 1/7608; E04B 1/7654; E04B 2001/405; E04B 2/707; E04B 2001/2415; E04B 2001/2496

USPC ..... 52/243, 317, 349, 481.1, 655.1, 656.9, 52/696, 653.1, 654.1, 667, 703, 710, 711, 52/712–715

See application file for complete search history.

(56) References Cited

U.S. PATENT DOCUMENTS

| | | | | |
|---|---|---|---|---|
| 778,878 A | | 1/1905 | Moir | |
| 3,332,196 A | | 7/1967 | Tuttle | |
| 3,343,329 A | | 9/1967 | Pohutsky | |
| 3,778,952 A | | 12/1973 | Soucy | |
| 3,780,209 A | * | 12/1973 | Schuplin | H02G 3/125 174/51 |
| 3,962,840 A | | 3/1976 | Nelsson | |
| 3,952,462 A | | 4/1976 | Heise | |
| 3,959,945 A | | 6/1976 | Allen | |
| 4,069,636 A | * | 1/1978 | Kessler | E04B 1/76 52/357 |
| 4,525,972 A | | 7/1985 | Palacio | |

(Continued)

OTHER PUBLICATIONS

Simpson Strong-Tie Company Inc., Pleasant, CA Title of Catalog: BBR & DBR Spacer Bracers, dated Jan. 1, 2017.

*Primary Examiner* — William V Gilbert

(57) ABSTRACT

The present invention relates to using interlocking spacer braces between support members to construct wood and metal framed walls, floors and building trusses. Spacer braces have indentations, extensions, with hook fingers, hook tongues and hook receivers along with U & W shaped clips that interlock horizontally, vertically or diagonally between support members. The spacer braces can form diagonal and lateral wall bracing, diagonal and vertical chords within building truss with either horizontally or vertical orientations, headers above doors and windows and shear walls. The spacer braces can be installed individually or in tandem between wood or metal framing.

13 Claims, 40 Drawing Sheets

(56) References Cited

U.S. PATENT DOCUMENTS

| | | | |
|---|---|---|---|
| 4,878,323 | A | 11/1989 | Nelson |
| 5,058,352 | A | 10/1991 | Loiselle |
| 5,152,114 | A | 10/1992 | Beazley |
| 5,218,803 | A | 6/1993 | Wright |
| 5,729,950 | A | 3/1998 | Hardy |
| 5,784,850 | A | 6/1998 | Elderson |
| 5,884,448 | A | 3/1999 | Pellock |
| 5,899,042 | A | 4/1999 | Pellock |
| 5,937,608 | A | 8/1999 | Kucirka |
| 5,943,838 | A | 8/1999 | Madsen |
| 5,992,109 | A | 11/1999 | Jonker |
| 6,021,618 | A | 2/2000 | Elderson |
| 6,073,413 | A | 6/2000 | Tongiatama |
| 6,199,336 | B1 | 3/2001 | Poliquin |
| 6,244,010 | B1 | 6/2001 | Slulter |
| 6,354,055 | B1 | 3/2002 | Shaw |
| 6,393,794 | B1 | 5/2002 | Pellock |
| 6,412,233 | B1 | 7/2002 | Jones |
| 6,418,695 | B1 | 7/2002 | Daudet |
| 6,578,335 | B2 | 7/2003 | Poliquin |
| 6,694,695 | B2 | 2/2004 | Collins |
| 6,701,689 | B2 | 3/2004 | diGirolamo |
| 6,708,460 | B1 | 3/2004 | Elderson |
| 6,739,562 | B2 | 5/2004 | Rice |
| 6,761,005 | B1 | 7/2004 | Daudet |
| 6,792,733 | B2 | 9/2004 | Wheeler |
| 6,892,504 | B1 | 5/2005 | diGirolamo |
| 6,920,734 | B2 | 7/2005 | Elderson |
| 6,941,718 | B1 | 9/2005 | diGirolamo |
| 6,983,569 | B1 | 1/2006 | Rosenberg |
| 7,017,310 | B2 | 3/2006 | Brunt |
| 7,073,757 | B2 | 7/2006 | Johnson |
| 7,159,369 | B2 | 1/2007 | Elderson |
| 7,168,219 | B2 | 1/2007 | Elderson |
| 7,241,459 | B2 | 7/2007 | Daudet |
| 7,360,745 | B2 | 4/2008 | Nikayin |
| 7,428,804 | B2 | 9/2008 | Surowiecki |
| 7,520,100 | B1 | 4/2009 | Herrman |
| 7,596,921 | B1 | 10/2009 | diGirolamo |
| 7,640,701 | B2 | 1/2010 | Rutherford |
| 7,730,695 | B2 | 6/2010 | Brady |
| 7,739,852 | B2 | 6/2010 | Brady |
| 7,765,771 | B2 | 8/2010 | Serpico |
| 7,836,657 | B1 | 11/2010 | diGirolamo |
| 8,011,160 | B2 | 9/2011 | Rice |
| 8,041,319 | B2 | 10/2011 | He et al. |
| 8,079,561 | B2 | 12/2011 | Jafari |
| 8,205,402 | B1 | 6/2012 | diGirolamo |
| 8,234,826 | B1 | 8/2012 | Proffitt |
| 8,262,043 | B2 | 9/2012 | Jafari |
| 8,281,540 | B2 | 10/2012 | Strickland |
| 8,443,568 | B2 | 5/2013 | Lin |
| 8,356,453 | B2 | 11/2013 | Rice |
| 8,590,255 | B2 | 11/2013 | Daudet |
| 8,683,772 | B2 | 4/2014 | Friis |
| 8,689,508 | B2 | 4/2014 | Orszulak |
| 8,756,895 | B1 | 6/2014 | Sidhu |
| 8,813,456 | B2 | 8/2014 | Lin |
| 8,943,778 | B2 | 2/2015 | Belanger |
| 8,966,856 | B2 | 3/2015 | Groenesteyn |
| 8,997,424 | B1 | 4/2015 | Miller |
| 9,010,055 | B2 | 4/2015 | Orszulak |
| 9,016,024 | B1 | 4/2015 | Daudet |
| 9,085,888 | B2 | 7/2015 | Fuller |
| 9,091,056 | B2 | 7/2015 | Stauffer |
| 9,109,361 | B2 | 8/2015 | Daudet |
| 9,200,446 | B1 | 12/2015 | diGirolamo |
| 9,290,926 | B2 | 3/2016 | Sidhu |

* cited by examiner

SPACER BRACES IN TANDEM FOR WALLS, JOISTS AND TRUSSES

CROSS REFERENCED TO RELATED APPLICATION

This application claims priority from:
U.S. Ser. No. 15/090,460 application being a CIP of U.S. Ser. No. 14/946,378 filed Nov. 19, 2015 and;
U.S. provisional application No. 62/242,705 filed Nov. 15, 2015 and;
U.S. provisional application No. 62/208,766 filed Aug. 23, 2015 and;
U.S. provisional application No. 62/175,191 filed Jun. 12, 2015 and;
U.S. provisional application No. 62/170,269 filed Jun. 3, 2015 and;
U.S. provisional application No. 62/143,097 filed Apr. 4, 2015 and;
U.S. provisional application No. 62/175,191 filed Jun. 12, 2015 and;
U.S. provisional application No. 62/170,269 filed Jun. 3, 2015 and;
U.S. provisional application No. 62/139,916 filed Mar. 30, 2015 and;
U.S. provisional application No. 62/083,276 filed Nov. 23, 2014 and;
U.S. provisional application No. 61/629,552 filed Nov. 22, 2011 and;
U.S. provisional application No. 61/628,044 filed Oct. 24, 2011 and;
U.S. Ser. No. 14/946,378 application being a CIP of U.S. Ser. No. 13/398,243 filed Feb. 16, 2012 and;
U.S. Ser. No. 13/398,243 application being a CIP of 12/456,707 filed Jun. 22, 2009 now U.S. Pat. No. 8,161,699 issued Apr. 24, 2012 and;
by the inventor hereof, the disclosure of which is incorporated herein by reference. The disclosures of the above cited U.S. Patent Applications and U.S. Provisional Applications of the Applicant, including all drawings and all the specifications, are hereby in incorporated by reference in their entireties into this U.S. Patent Application.

FEDERALLY SPONSORED RESEARCH OR DEVELOPMENT

Not applicable

PARTIES OR JOINT RESEARCH

Not applicable

FIELD OF THE INVENTION

The present invention relates to using interlocking spacer braces between support members for-buildings. The spacer braces are installed between the holes of the support members, at the top and bottom of the support members or on the flanges of the support members. The spacer braces have indentations, extensions, fingers, tongues and receiver shapes that connect between each other or to support members. The different end configurations can be vary where some spacer braces can have two fingers or two tongues or even two receiver ends. The fingers, tongues or receivers are also interchangeable so a U-shaped clip or W-shaped clip can be connected to the spacer brace and allow the spacer brace to be connected to the support members in many different ways. The spacer braces can be adjustable as well as connected horizontally, vertically or diagonally for even spacing and increase structural strength. The spacer braces with their interlocking connections between members can form shear walls, corner bracing, beams, hold-downs, and headers above doors and windows. The support members can be the vertical support members of a building wall or the horizontal support members of a floor or ceiling joist or the diagonal support members of a rafter or a component of a floor or roof truss.

BACKGROUND OF THE INVENTION

Light gauge metal framing and wood framing have been used in the construction of buildings for many years, however interior and exterior metal framing has always been difficult to assemble as well as construct horizontal and diagonal bracing between support framing members because of the configuration of the support members like a C channel and poor energy efficient shear wall construction. The lip and flange of the C channel protrudes from the web making it difficult to make connections. When bracing members are installed between support members for additional strength, insulation became even more difficult to install as well as form an insulated wall.

When assembling wood and metal framed walls the vertical support members are not stiff until the bracing members are added to help stabilize the support members from moving. In the past there have been attempts to stiffen support members by providing lateral bracing, drywall backing or bracing members between vertical support members.

The bracing members within the wall forming structure are generally required to tie the support members together. For metal framing bracing members are internal bracing members installed through openings provided in the web of the support channels and solid blocking for wood framing. None of the metal framing bracing members used today has a good quick installation solution for interlocking individual bracing members together between support members. Bracing members are usually long supports connecting many support members together and are not individual members that have the flexibility to be installed individually and at a diagonal within the metal framing wall. In addition the bracing members are not used to form shear walls or diagonal framing with the walls or have the flexibility to form trusses having diagonally framing members.

Metal framing has developed computer systems to form pre-punched screw holes to designate how and where to install fasteners between metal framing. Different types of notches or shapes of bracing members have help speed up framing assembly. There have been no innovation developed allow metal framing to be connected without using fasteners and nothing has been developed where the spacer brace connects support members together using W clips, U clips, punch-out tables and ledges that form a self-lock connectors that fit together to form a fast an easy connection means to form metal framed wall panels without using fasteners at the support members. The unique wall construction allows wall panels to be fabricated quickly and easily without using fasteners thereby saving money in labor and material.

DESCRIPTION OF PRIOR ART

The horizontal and diagonal connections between wood and metal support members do not form continuous bracing that interlocks between each other but rather are individual components. Individual mounting brackets are used to support trusses or horizontally brace support members. Many different shapes of horizontal bracing members are used to connect metal framing members together and include various grooves, tabs, bridging backing, notches to connect the metal framing members together. Some types of connections between support members use bent hooks, bent flanges, clamping tabs, anchoring hand rail system, adjustable braces or extended tabs to connect trusses. Existing bracing members do not connect support members together at corners, provide drywall backing and connect wall panels together. Different types of brackets, shapes, leg supporting connections and blocking are used to install support members together. Slotted holes at the flanges of the top base plate have been used to compensate for vertical movement between vertical and horizontal support member. Existing bracing member do use various types of clips with fasteners to interlock between support members to prevent vertical and horizontal movement. There is no prior art for U or W shaped clips with spacer braces to secure support members together. Punch out tabs has been used as spacers or as tabs where the tabs have been used to support another object.

SUMMARY OF THE INVENTION

The present invention are interlocking spacer braces that connect different building construction components together to form integrated building wall and floor assemblies using the light gauge metal framing spacer braces. The spacer braces can connect vertical or horizontal support members together individually, diagonally and or in tandem between adjacent spacer braces. The spacer braces can have a variety of shapes, U-shape, C-shape, J-shape or I-shape and can be connected to the support members in many different ways. The spacer braces can have a hook finger end, a hook tongue or a hook receiver end and can be connected to a U-shaped clip or W-shaped clip which can also be connected to the support member.

The spacer braces can be individual horizontal bracing members that pass through the holes of support members and secure the support members together. When the spacer braces passes through the holes in the support members, the horizontal movement is eliminated the side edges of the holes in the direction of the web and notches or the flanges and hook fingers of the spacer brace eliminate the horizontal movement along the flanges of the support member. The spacer braces can fit into the hole of the support member, over or under the web of the support member or over the flange of the support member. The spacer braces can have the web oriented vertically or horizontally. The spacer braces can be installed at a diagonal whether the web is oriented vertically or horizontally. The spacer braces can be installed individually between support members or be in tandem using the opposite end of the spacer bracer as the hook receiver end or a U or W shaped clip as the hook receiver. The U or W shaped clips can also be oriented vertically, horizontally, through the hole, over the flange, over the web, under the web, connected to the ledge or not connecting the ledge of the support member. A spacer brace can be connected to the support member in tandem or as individual spacer braces so that six different spacer braces can interested adjacent to one another allow the structural capacity of the spacer braces to transfer their load capacity the same way horizontal and diagonal structural members of a bridge span together to form one unified structure.

The ends of the flanges of the spacer braces have blunt ends, jagged edges or bent flanges engages one side of the web of the support member. The opposite side of the web of the support member is engaged on the interior side of the hook tongue extending from the exterior side of the spacer brace. The hook tongue is indented at the web and then extended parallel or bent perpendicular to the exterior side to the opposite side of the web in the support member either at the flange or at the hole in the web of the support member or into an interlocking engagement connecting adjacent spacer braces. The hook tongue are typically perpendicular to the extension of the web for maximum strength, but can be at an angle to connect to diagonally oriented spacer braces and can have abrasive planar surfaces connection on the interior and exterior sides for a tight fit.

Horizontal bracing members that pass through the holes in the support members can have brackets inserted into the U shaped horizontal bracing channel where the clips form a reverse lip channel shape or butterfly shape where the wings or lips have notches that are inserted into the edges of the hole and the edges of the lips extending from the flanges of the vertical support member. Similar configurations can be used to support adjacent support members at the holes in the support members.

Spacer braces can also be used as base plates at the floor or ceiling joists where the tongue and receiver sides fit together to form a continuous base place and can vary how the tongue and receiver sides interconnect to each other.

Support members are spaced at standard distances between each other and the spacer braces are designed to connect to the support members webs and the standard intervals, however additional support members are added between the standard spacing and bunched together to form a stronger support member. Different Add-on spacer brackets are shown having the same U-shape as other spacer braces in order to have all the spacer braces interlock with each other. In addition, W and U shaped clips are shown as having hook receiver on one or both ends for the hook tongue of the spacer braces can fit into. The clips can be used in place of the U shaped hook receiver of the spacer brace. The clips can fit vertically or horizontally: in the holes of the support members; over or under the web of the support members; over the flanges of support members being wood or metal or individual or multiple spacer brace connections; between adjacent webs of support members; into triangle shape holes and still have two spacer braces connect to the clip.

When the spacer braces are installed in the holes between rafters or ceiling and floor joists, the spacer braces might be installed so the webs are in a vertical position that way the flanges of the spacer braces can be installed into the middle of the wall where the flanges of the spacer brace have the least resistance. Depending on the function of the spacer block, additional spacer braces can be installed either diagonally as cross-bridging or horizontally as additional support for the spacer block when the spacer braces have the web oriented either horizontally or vertically.

The present invention allows the spacer braces with their interlocking connections between support members to form roof and floor trusses, shear walls, headers above doors and windows and lateral bracing between the support members and various types truss joists. The spacer braces can be installed vertically, horizontally or diagonally with the exterior side of the spacer brace installed vertically between support members between the flanges or over the flanges. The spacer braces can have angular side flanges to fit into large triangular holes within the support members. The hook tongues shapes and flanges can brace support members to form truss floors or roof trusses. The U-shape hook receiver at one end and the hook tongue at the opposite interlock with each other when connected in tandem to form an excellent structural building component.

DESCRIPTION OF THE PREFERRED EMBODIMENTS

The drawings show various types of connections using interlocking spacer braces, bracing clips, hook clips and bracing brackets that connect different building construction components together to form integrated building wall and floor assemblies using the light gauge metal framing. The spacer braces connect vertical or horizontal support members together individually, diagonally and or in tandem between adjacent spacer braces. The bracing clips, bracing brackets can be installed vertically or horizontally so the spacer braces can connect to them to also form diagonal spacer braces giving the flexibility to form a framing structure using wood or metal framing support members.

Figure 1:
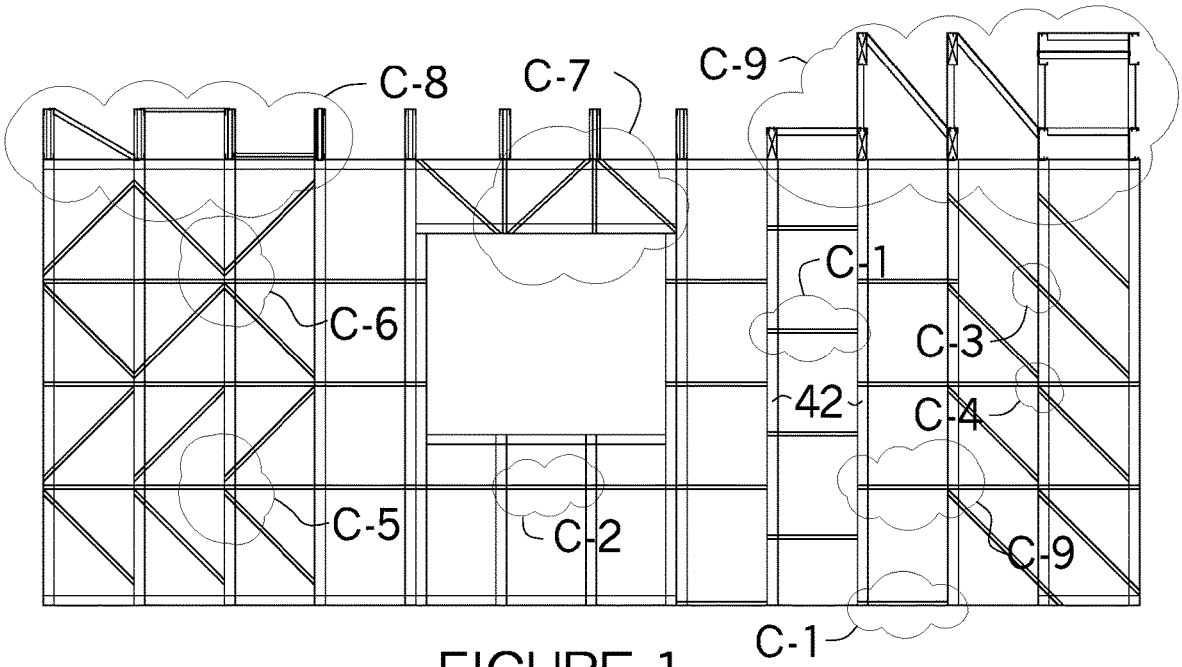
FIG. 1 is an elevation showing the nine clouds formations where each cloud represents a different horizontal or vertical orientations of the spacer braces, clips or bracket applications and some clouds having many different application connections: individual spacer braces, spacer braces connecting to adjacent spacer braces, diagonal spacer braces, offset diagonal spacer braces, opposite pointing diagonal spacer braces, X framing spacer brace, truss head, U & W clips, spacer braces connecting to clips, floor trusses and a solid fire stop spacer braces between the support members of a framed wall for a building.

FIG. 1 shows an elevation of a metal or wood framed walling with various clouds or cut away areas to for various configurations explained in some of the following figures noted in the drawings. Spacer braces are used to connect support members together whether the support members are vertically or horizontally oriented and or whether the spacer braces have the webs oriented vertically or horizontally or whether the spacer braces are horizontal, vertical or installed at an angle. For example in C-4 the spacer braces can be installed on the flange of the support member or can be installed through the holes of the support member either horizontally or diagonally. When installed through the holes the spacer braces would be mounted on the top edge and bottom edge of the hole. The space braces can be connected using fasteners or no fasteners. The spacer braces can be secured vertically, horizontally and diagonally without using fasteners. The spacer braces can be connected directly to the support members or can be connected by using U-shaped clip or W-shaped clips. The spacer braces in C-7 is similar however here the spacer braces and support members are forming a truss beam using spacer braces as the connection cords of the truss beam as shown in C-8. Lateral bracing between truss beams can be horizontal or diagonal when making spacer brace connections. Spacer braces can be used as the top plate or bottom plate of a metal framed wall. When the spacer braces are used at the end or beginning or a tandem row of spacer braces a hooked finger end connection is used and when two tandem rows or short spacer braces are used the hook receiver and hooked tongue interlock and secure the spacer braces together. The shape of the holes in the support member could be triangular or rectilinear which might also affect the installation as well as the shape of the spacer braces having a C, I, J, U shape and whether the spacer braces have the interior side facing upward or downward.

Figure 2:
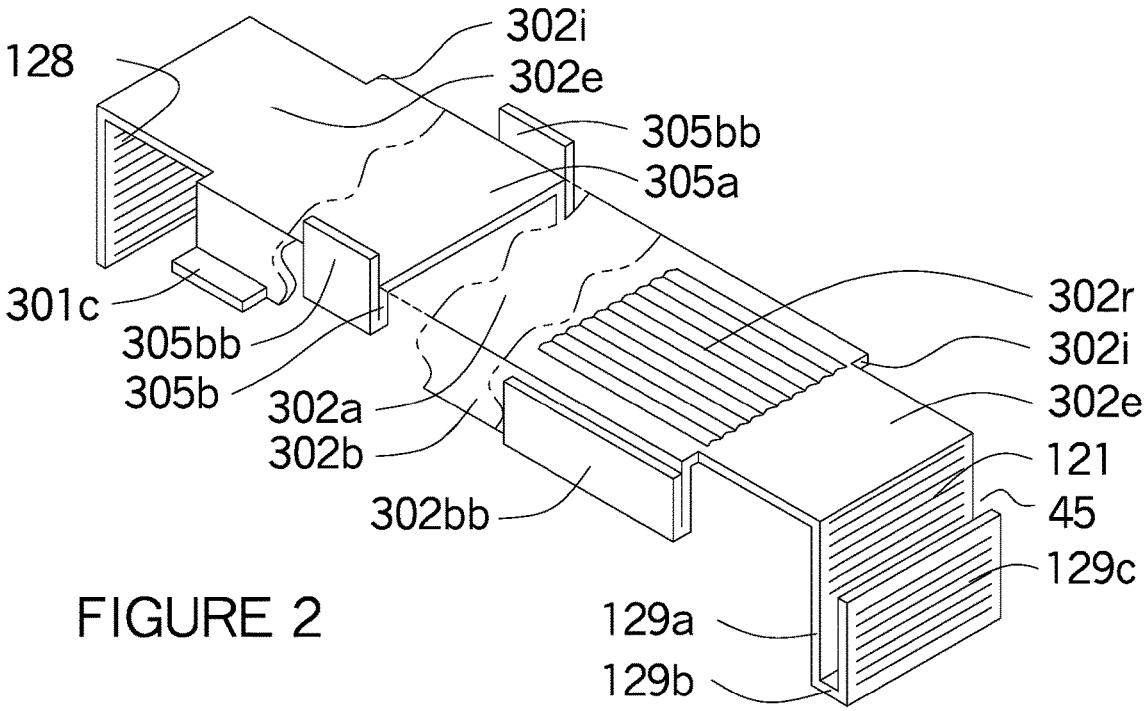
FIG. 2 shows a downward oriented U shaped spacer brace with alternative spacer brace shapes including ridges in the dorsal and hook tongue shapes, lips at the ends of the flanges where one on has either a hook finger or hook tongue end and the opposite end has a hook receiver end.

FIG. 2 shows an isometric drawing of a spacer brace having different configurations. One variation shows a downward oriented U shaped spacer brace 302 having an elongated body with a web 302*a* having two flanges 302*b* extending downward from the interior side of the web 302*a*.

The U-shaped spacer brace 302 is shown where the exterior is oriented horizontally and two flanges 302*b* extend downward from the interior side. Another variation shows a reverse lip spacer brace 301 having a U shape with a lip 301*c* extending from the bottom edge of the double flange 301 *bb* in an outward direction away from the web 301*a* and better shown as a reverse lip brace 301 in FIG. 16. Another variation of the U shaped spacer brace 302 has the flange 302*b* shown as a double flange 302*bb* where the flange 302*b* is bent twice to increase the strength. Another variation shows an I shape spacer brace 305 where the flanges 305*b* and 305*bb* are slightly different than the reverse lip brace 301 as the flange 305*b* extends downward from the web 305*a* then bents upward to form flange 305*bb*, but extends above the web 305*a* forming an I shape at the both flanges. By forming various fixation means such as grooves 121, indentations or ribs in the direction of the elongated spacer brace the metal surface is broken and the ribs will increase the strength of the elongated spacer brace. The thickness of the metal to form the spacer brace can increase in thickness to increase the strength of the spacer brace. The left side shows and an indentation 302*i* extend from the flanges 302*b* and into the web 302*a* where the web 302*a* has an extension 302*e*. The extension 302*e* can be wide or narrow depending if the extension 302*e* is installed in a hole or over a flange as shown later in the figures. The extension 302*e* on the left end forms a hook tongue 128 and forms a hook receiver 129 on the right end. When two U shaped spacer braces 302 are connected in tandem, the hook tongue 128 fits into the gap 45 of a hook receiver 129 from an adjacent spacer brace. When the hook tongue 128 is connected to the support member and not installed into the hook receiver 129 it is referred to as a hook finger 127.

Figure 3:
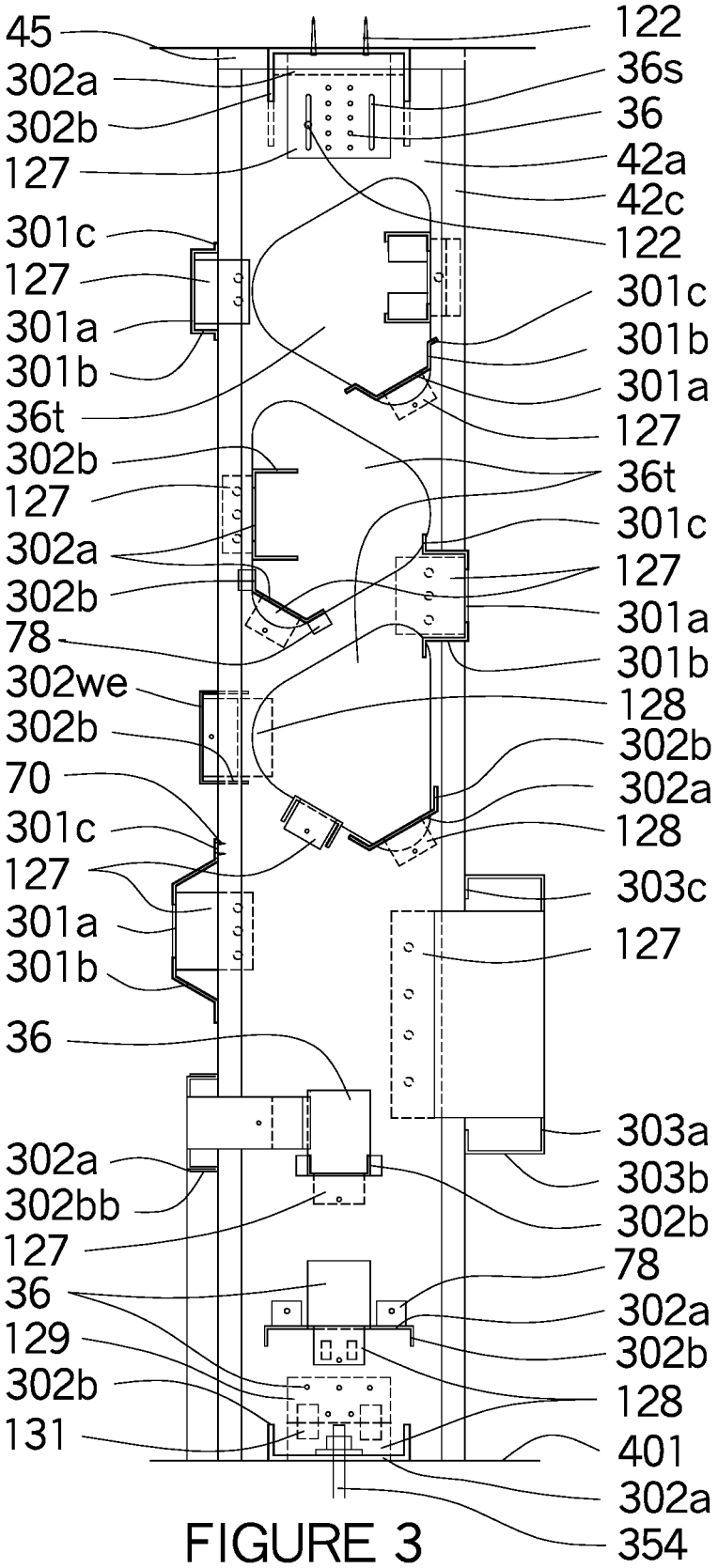
FIG. 3 shows eleven different space brace configurations each oriented differently on the vertical support member with some spacer braces passing through triangular or square shaped holes and others passing over the flanges of the support member.

FIG. 3 is a cross section through a metal framed wall showing numerous sizes and shapes of spacer braces being attached to a C channel 42. Some spacer braces are attached to the web 42*a* or by the hook finger 127 or the hook receiver 129 that has a hook tongue 128 installed within the hook receiver shown here as a U-shaped hook receiver 129 when installed in tandem. The holes 36 within the web 42*a* are usually rectangular in shape, however a triangular shape hole 36*t* is also shown showing three various spacer braces in FIGS. 30-32. The U-shaped spacer braces 302 near the bottom shows one U shaped spacer brace 302 where the exterior is oriented on the top side and the flanges 302*b* are extending downward while the other U-shaped spacer brace 302 the exterior is oriented on the bottom side and the flanges 302*b* are extending upward. The reverse lip spacer brace 301 on the right side of the support member is installed so the web extension 301*we* (not shown) at the web 301*a* can extend over the flange 42*b* so the hook finger 127 can be connected to the web 42*a* of the support member. On the left side the reverse lip spacer brace 301 is installed so the lips 301*c* are supported at the flange 42*b*. The reverse lip spacer brace 301 also on the left by further down the wall, shows the side 301*b* at an angle like a hat channel shape. Just below is a U shape spacer brace 302 that shows a double flange 302*bb* and the edge of the double flange 302*bb* is against the flange 42*b* of the support member. In addition, the U shape spacer brace 302 shows a light weight line below the U shape spacer brace 302 which references that the U shape space brace 302 is installed at an angle or diagonally over the flanges 42*b* of the support members. A C shaped spacer brace 303 is installed on the flange 303*b* where the lip 303*c* rests against the flange 42*b* and the hook finger 127 is secured to the web 42*b*. At the base is a horizontally oriented U shaped spacer brace 302 shown as a base plate of a framed wall where the exterior side is connected to a floor 401 by an anchor bolt 354 and explained as a hold-down 309 in FIGS. 10 & 12. The hold down 309 can be the full wide or less than full width of the support member. The web 302*a* extends under the support member shown as a C shape channel 42 where the hook receiver 129 is attached to the web 42*a* and the hook tongue 128 is attached into the gap 45 of the hook receiver 129. On the opposing end is a upper base plate where the dorsal is secured to a support structure and slot holes 36*s* are shown in the hook receivers 129 or hook fingers 127 where a fastener (not shown) is installed into the slot hole 36*s* and the C-channel 42 connection is allow to move should the support structure above moves. Other spacer braces are oriented at a diagonal within the triangular shaped holes 36*t*. Some spacer braces are secured at the lips 42*c* by U shaped hook receivers 129 having a U-shape or L-shape configuration.

Figure 4:
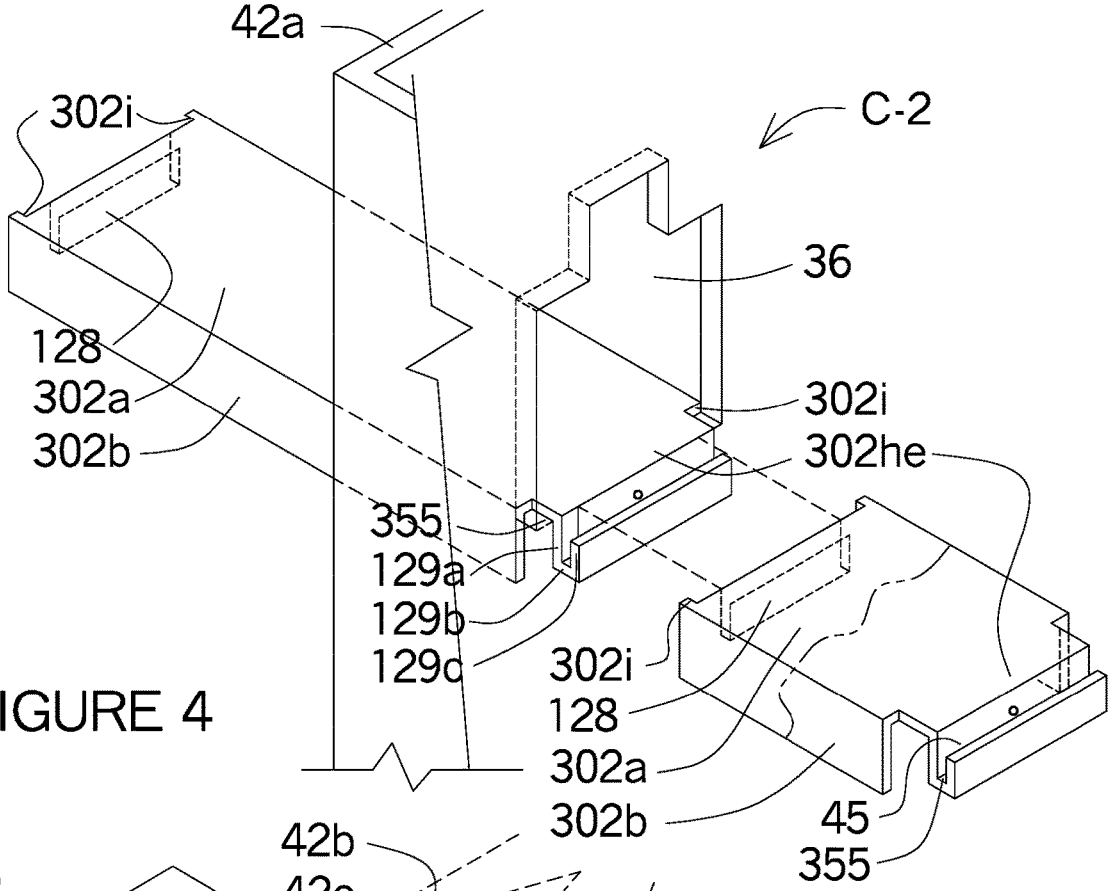
FIG. 4 shows a horizontally oriented downward facing spacer brace with a U shaped hook receiver passing through the hole of the support member for a spacer brace with a downward L-shaped hook tongue to fit into.
Figure 11:
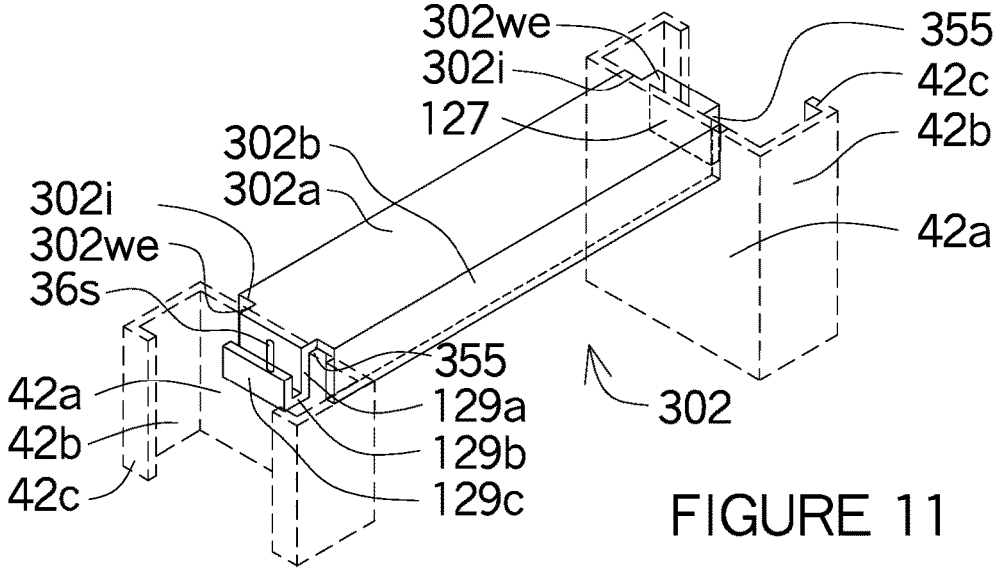
FIG. 11 shows a spacer brace with a finger end and a receiver end at the top of a support member.

FIG. 4 shows an enlargement of a spacer brace in FIG. 1 or FIG. 3 between support members; however only one of the support members is shown. The U shaped spacer brace 302 having an elongated body with the exterior side shown as the web 302*a* with a interior side having two flanges 302*b* extending downward from the web 302*a* with both ends of the elongated U shaped spacer brace 302 having the side edges of the flanges 302*b* engaging the web 42*a* on both ends between the support members forming the first engagement connection between framing members. The U shaped spacer brace 302 is slightly narrower as only the flanges 302*b* abut the web 42*a* of the support member. On the right side the web 302*a* of the U shaped spacer brace 302 has an indentation 302*i* and a hole extension 302*he* when abutting the web 42*a* of the C channel 42 shown as the support member. When the hole extension 302*he* spans over the anchor space 355 and extends over the bottom edge of the hole 36 a hook receiver 129 is formed having a U-shaped configuration with the first leg 129*a* extends downward then bending 90 degrees forming a second leg 129*b* then bending 90 degrees again forming an upward oriented third leg 129*c* leaving a gap 45 between the first and third legs 129*a* & 129*c* forming the second engagement means connection between framing members. By bending the first leg 129*a* on the opposite side of the web 42*a* from the end of the flanges 302*b* the U shaped spacer brace 302 is now engaged. To the right of the hook receiver 129 shows an another U shaped spacer brace 302 with a hook tongue 128 on the left side and the two flanges 302*b* extending beyond the hook tongue 128 so the two flanges 302*b* can extend beyond the hook receiver 129 and abut the web 42*a* of the support member. The hook tongue 128 extends downward from the web 302*a* over the third leg 129*c* of the hook receiver 129 into the gap 45 where another anchor space 355 exists when the hoot tongue 128 rests on the gap side of the second leg 129*b*. The engagement connection between framing members occurs when the hook tongue 128 fits into the gap 45 between the downward oriented first leg 129*a* and upward oriented third leg 129*c* thereby engaging two U-shaped spacer braces 302 together. In FIG. 11 the U shaped spacer brace 302 is shown as a top plate of a support member.

Figure 5:
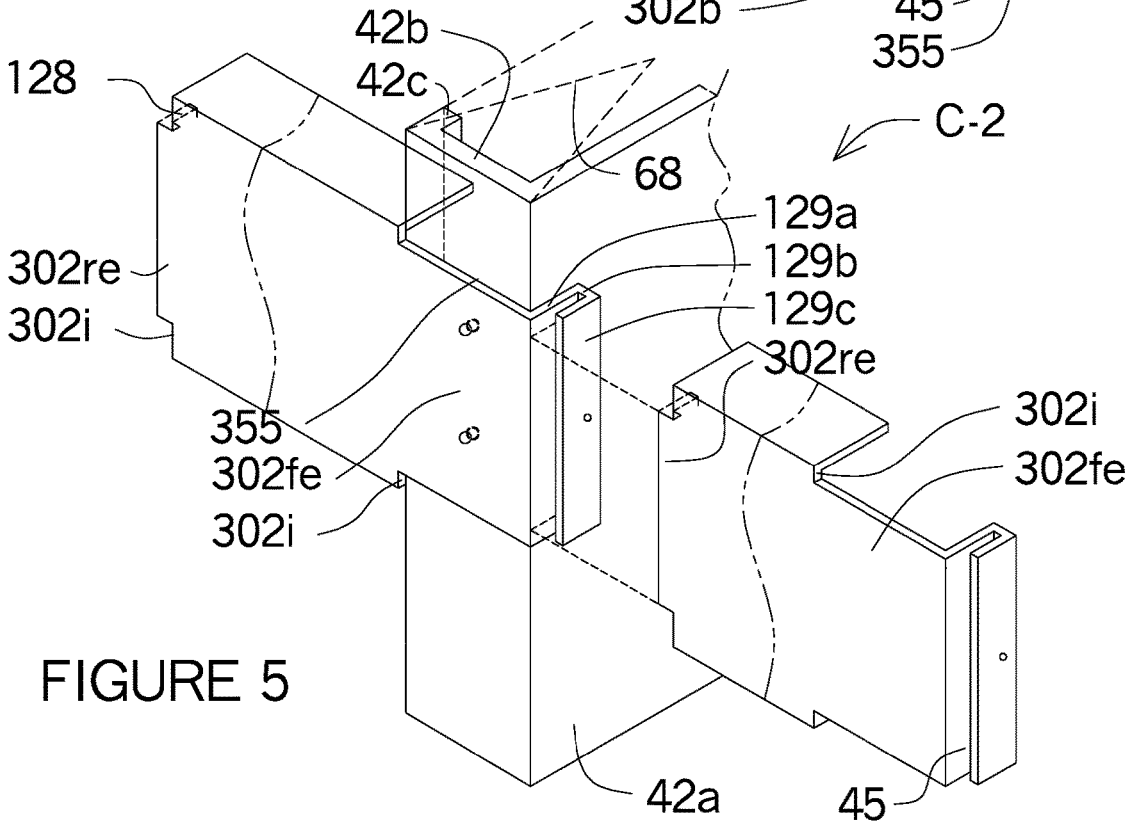
FIG. 5 shows a vertically oriented spacer brace with it U-shaped hook receiver extending over the flange of vertical support members for a spacer brace with its L-shaped hook tongue to fit into.

FIG. 5 also shows an enlargement of the U-shaped spacer brace 302 shown in FIG. 4; however the U-shaped spacer brace 302 is shown with the exterior side in a vertical position shown with the web 302*a* resting against the flange 42*b* of the C channel 42 being the supporting member of the wall framing construction. The flanges 302*b* extend horizontally on the interior side of the U shaped spacer brace 302 and abut the lip 42*c* of the support member. The web 302*b* of the U shaped spacer brace 302 has an indentation 302*i* then a flange extension 302*fe* spans over the anchor space 355 that extends across the face the flange 42*b* of the support member. Since the U shaped spacer brace 302 has the dorsal in a vertical position, the hook receiver 129 is bent horizontally so the first leg 129*a* is bent parallel to the web 42*a* of the support member, then bent 90 degrees forming a second leg 129*b* then bending 90 degrees again forming an outward oriented third leg 129*c* leaving a gap 45 between first & third legs 129*a* & 129*c*. By bending the leg 129*a* at the lip 42*c* and on the opposite side at the web 42*a* the U shaped spacer brace is engaged on both sides of the support member. On the right side of the support member, another U shaped spacer brace 302 is shown having the hook tongue 128 on the left side that is formed by a receiver extension 302*re* where the receiver extension 302*re* extends over the third leg 129*c* of the hook receiver 129 and the hook tongue 128 fits into the gap 45 between the first leg 129*a* and third leg 129*c* thereby engaging two U shaped spacer braces 302 together. The vertical support members can be wood framing members 68 in lieu of the C channels 42.

Figure 6:
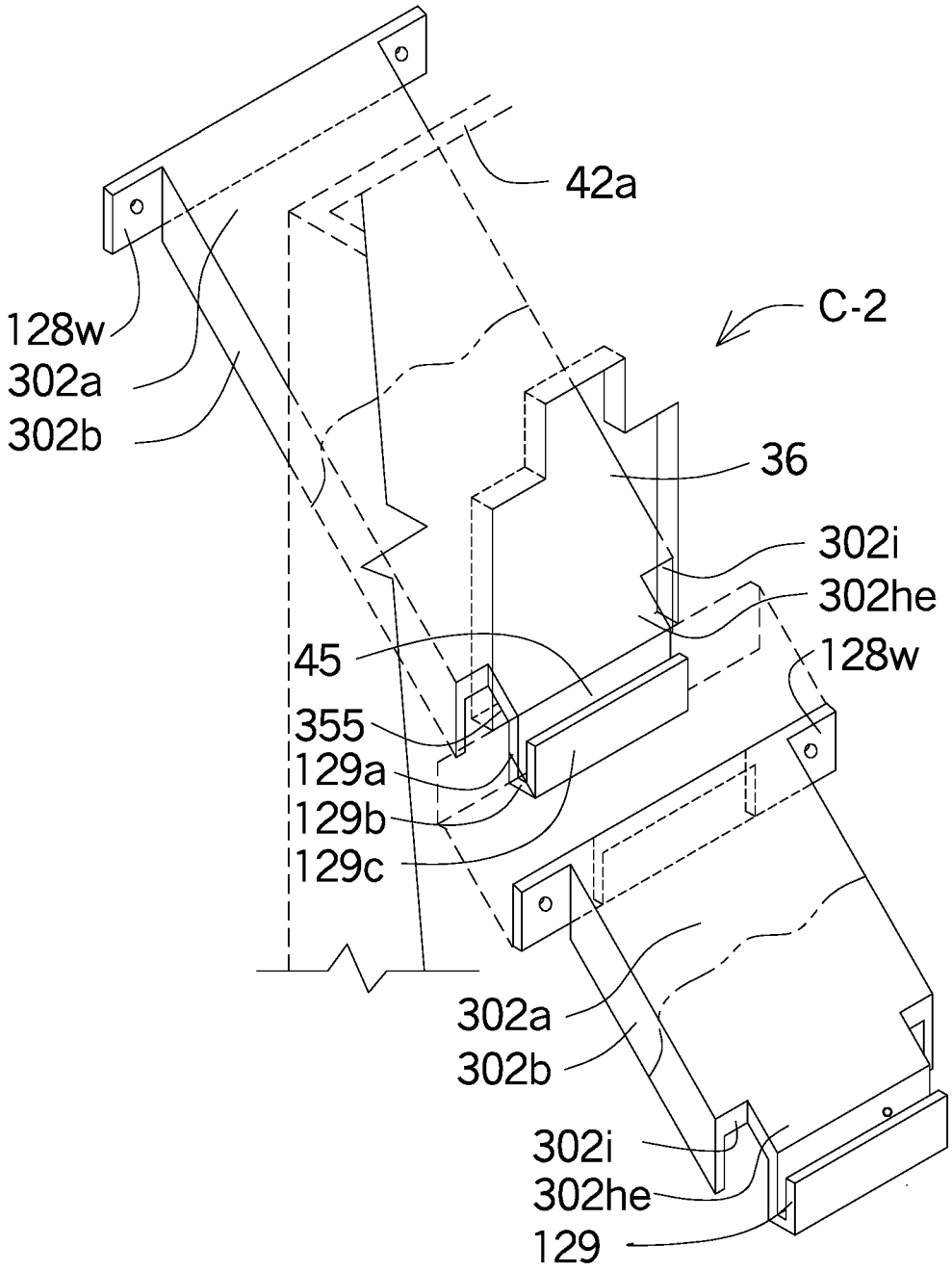
FIG. 6 shows an isometric view of two horizontally oriented spacer braces connected at the hole in the web of the metal framed support members where the spacer braces are shown in tandem.

FIG. 6 has downward oriented U shaped spacer braces 302 installed in tandem between the bottom edge of the hole 36 in the web 42*a* of the support member. The left U shaped spacer brace 302 has an indentation 302*i* at the flange 302*b* and web 302*a* with the web 302*a* extended at the hole extension 302*he* over the bottom edge of the hole 36 or anchor space 355 with the hook receiver 129 having its first leg 129*a* extend downward then the second leg bent 129*b* bent horizontally forming a gap 45 with the third leg 129*c* extending upward. The opposite end of another U shaped spacer brace 302 on the right has the indentation at the flange 302*b* so the web 302*a* can have a wide hook tongue 128*w* bent against the vertical edges of the flanges 302*b* for the wide hook tongue 128*w* can fit into the gap 45 and be connected at the holes with fasteners (not shown) to the web 302*a* forming a continuous diagonal connection between the hole 36 of adjacent support members.

Figure 7:
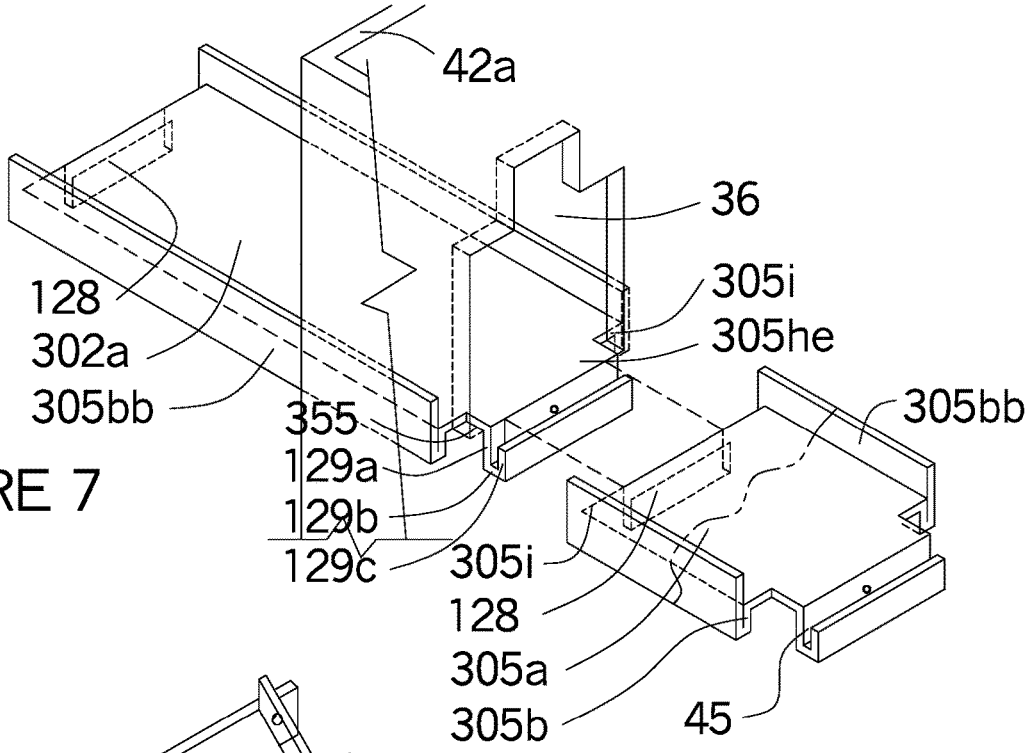
FIG. 7 shown an isometric view of a horizontal oriented I shaped space brace passing between the holes in the metal framing connecting in tandem to each other.

FIG. 7 show an I shaped spacer brace 305 spanning between support member shown as a C channel 42 where a hole 36 is installed in the web 42*a* and a hook receiver 129 has an indentation 305*i* with a hole extension 305*he* resting on the bottom edge of the hole 36 at the anchor space 355. The hook tongue 128 extends downward from the indentation 305*i* at the web 302*a* that extends into the gap 45 of the hook receiver 129. The flanges 305*b* & 305*bb* extend to the web 42*a* of the support member bracing the flanges 305*b* & 305*bb* tight against the web 42*a* and restricting the hook tongue 128 from moving horizontally out of the gap 45 and keeping the hook tongue 128 between the flanges 305*b* & 305*bb* creating another means of a third engagement. The I shaped spacer brace 305 having the web 305*a* with the exterior side upwards with the flanges 305*b* extending downward and further extending the flanges 305*b* so the flanges 305*bb* extend upward above the exterior side of the web 305*a* of the I shaped spacer brace 305. The double flanges 305*bb* add additional strength and give added support should insulation be installed between the support members.

Figure 8:
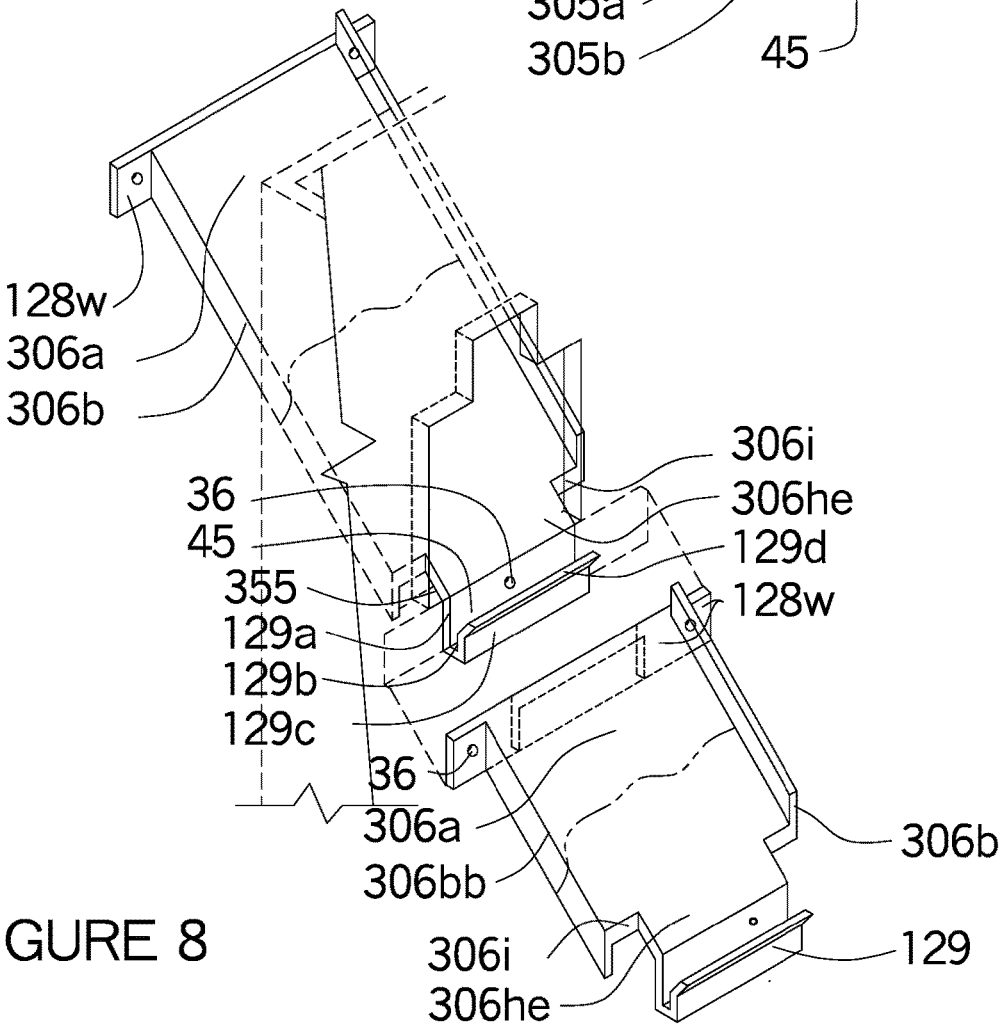
FIG. 8 shows a horizontally oriented web of the J shaped spacer brace being connected in tandem.

FIG. 8 shows a J-shaped spacer brace 306 where the hook tongue 128 is on the left side the hook receiver 129 is on the right side. The J-shaped spacer brace 306 has a downward oriented flange 306*b* connected to a horizontal oriented web 306*a* being connected to an upward oriented flange 306*b*. The J-shaped spacer brace 306 is shown passing through the hole 36, however the J-shaped spacer brace 306 is wider than the hole 36 in the support member shown as a C channel 42. The second engagement connection between framing members being the downward and upward flanges 306*b* and the web. 306*a* are indented 306*i* at the hole 36 so the web 306*a* can have a hole extension 36*he* that rests on the lower edge of the hole 36 at the anchor space 355 and against the side edges of the hole 36. The hole extension 36*he* connect to the hook receiver 129 that is inserted through the hole 36 and where the first leg 129*a* extends downward from the bottom edge of the hole 36 then horizontally forming the second leg 129*b* the vertically forming the third leg 129*c*. The hook receiver 129 is formed by using the three legs 129*a, b* and *c*. The opposite end of J-shaped spacer brace 306 has a wide hook tongue 128*w* that fits into the gap 45 between the first and third legs 129*a* & 129*c*. The wide hook tongue 128*w* can be formed by cutting the flanges 306*b* prior to the bending the flanges 306*b*, then bending the hook tongue 128 leaving the wider sides being formed from the flanges 306*b*.

Figure 9:
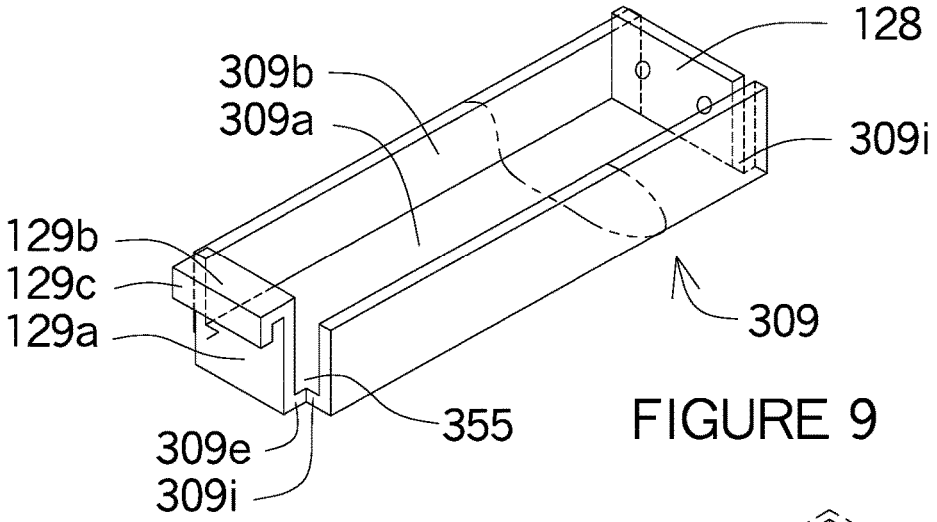
FIG. 9 shows the spacer brace having a downward oriented U shape hook receiver side and an upward oriented hook tongue side for a spacer brace used at a floor.
Figure 10:
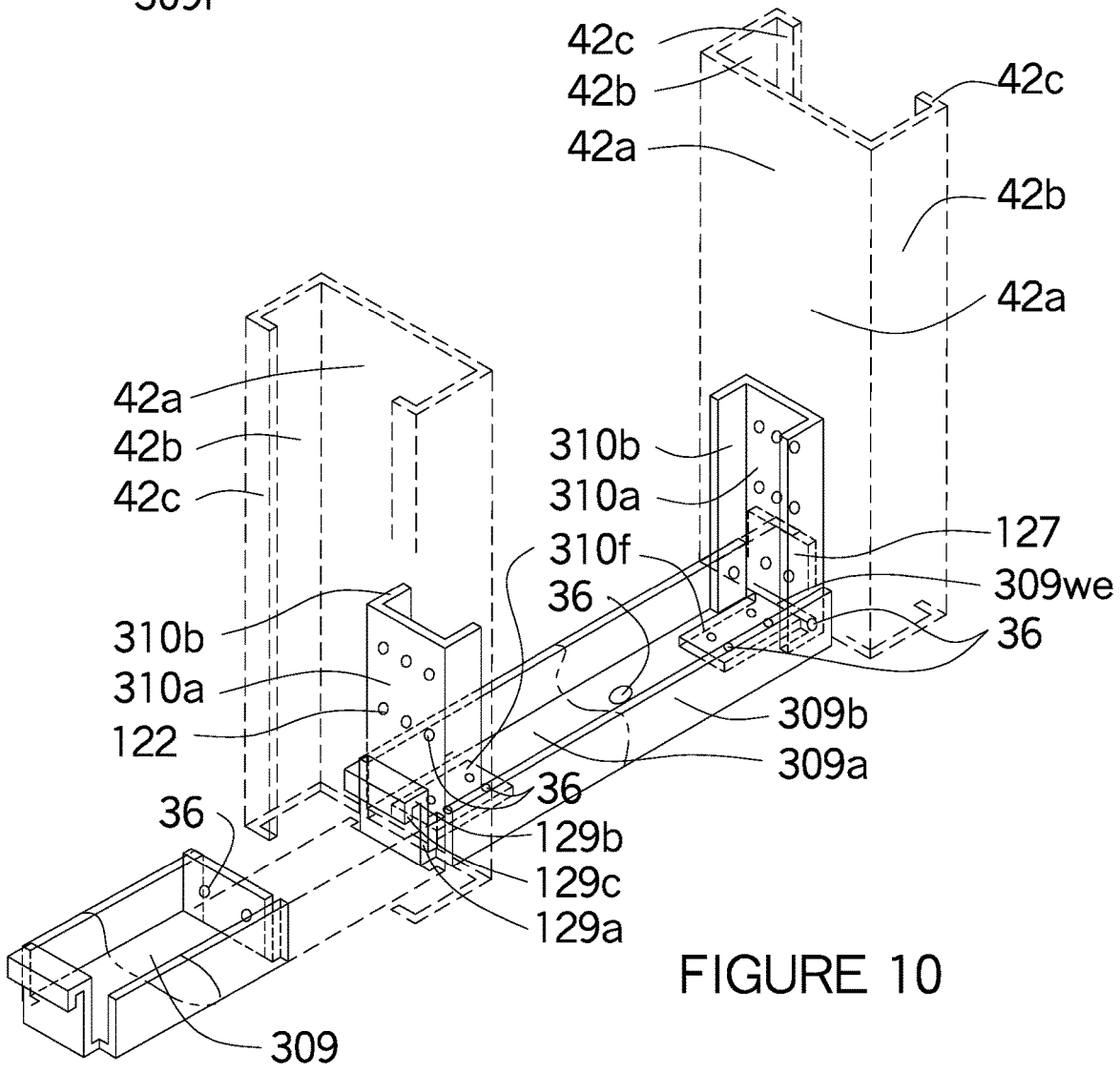
FIG. 10 shows the spacer brace being mounted at the floor between two support members where one end has a hook receiver end and the opposing end is a hook finger at the starter end.
Figure 47:
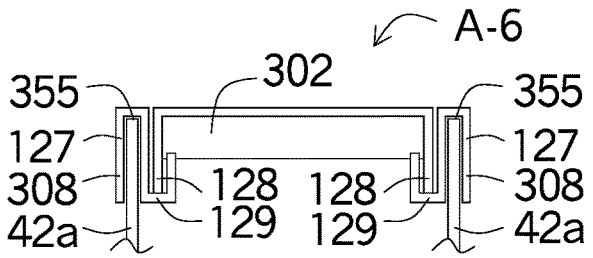
FIG. 47 shows an schematic view of a construction assembly using spacer braces spanning between two support members having the anchor space of a U-shaped clip engage the support member with the hook receiver on the right side end engaging the hooked tongue of the spacer brace on the left side end with a hook tongue on the right side end engaging the hook receiver side of the U-shaped clip where the anchor space between the hook finger and hook receiver engage the right support member.

FIGS. 9 & 10 show a hold-down spacer brace 309 having a U-shape with the exterior side of the web 309*a* is against a floor where an anchor bolt (not shown) passes through the hole 36 in the web 309*a* and is anchored to the floor and the flanges 42*b* extend upward for the web 42*a*. In FIG. 10 the hold-down spacer brace 309 spans between two support members shown as C channel 42 having a web 42*a* with two flanges 42*b* extending upward from the web 42*a*. On the right side the flanges 42*b* abut against the web 42*b* of the support member and the web 309*a* has an indentation 309*i* and the web 309*a* has an extension 309*e* that extends under the web 42*a* of the support member and upward forming a hook finger 127 on the interior side of the web 42*a* of the support member and is secured by fasteners (not shown) in the holes 36. On the left side the hold-down spacer brace 309 also has its flanges 309*b* abut the web 42*a* of the support member being the first engagement connection and the web 309*a* has an indentation 309*a* and an extension 309*e* that passed under the web of the support member being the second engagement connection and the anchor space 355 of the support member. The hold-down spacer brace 309 on the left side is design to be connected to another hold-down spacer brace 309 in tandem so the left end has a hook finger 129 where the extension 309*e* is bent upward against the interior side of the web 42*b* of the support member forming the first leg 129*a*, then horizontally away from the web 42*a* forming the second leg 129*b* leaving a gap 45 for a third leg 129*c* to extend downward forming a U-shape. The same profile is shown in FIG. 47 except in FIG. 10 the profile is upside down in relation to FIG. 10. To the left of the hold-down spacer brace 309 is another hold-down spacer brace 309 that is described in FIG. 9. The hold-down spacer brace 309 is also U-shaped have a web 309*a* with two flanges extending interiorly upward from the web 309*a*. On the right side the web 309*a* has an indentation 309*i* that is set back from the vertical edges of the flanges 309*b* and the web 309*a* has a hook tongue 128 that extends interiorly upward. The opposing end also has an indentation at the web 309*a* and an extension 309*e* with a hook receiver 129 having its first leg 129*a* extend upward with its second leg 129*b* extending horizontally for a gap 45 so the third leg 129*c* can extend downward. The hook tongue 128 from FIG. 9 is installed in the gap 45 between the first and third leg 129*a* & 129*c* as shown by the dashed lines into the hook receiver 129 in FIG. 10. The third engagement connection shows the hook tongue 128 fits into the hook receiver 129 at the gap 45 and between the flanges 309*b* so the hook tongue 128 cannot move horizontally out of the gap 45 eliminating the need for fasteners to secure the hook tongue 12*k* to the hook receiver 129. FIG. 9 also shows the hook receiver on the left side of the hold-down spacer brace 309. The web extension 309*we* at both the hook finger 127 and the hook receiver 129 is the anchor space 355 for the hold-down spacer brace 309 to be secured between the end of the flanges 309*b* and the hook finger 127 or hook receiver 129 in FIG. 10. On the other hand when the hold-down spacer brace 309 is in tandem, the web extension 309*we* is the second engagement connection to secure the web 42*a* of the support member between the hook tongue 128 or hook receiver 129 and the end edges of the flanges 309*b*. FIG. 10 shows a separate hold-down bracket 310 with a web 310*a* fitting against the web 42*a* of the support member with flanges 310*b* extending internally outward and its web 310*a* bent parallel to the floor forming an end plate 310*f*. The end plate 310*f* and flanges 310*b* can be fastened to the hold-down spacer brace 309 and against the web 42*a* of the support member.

Figure 12:
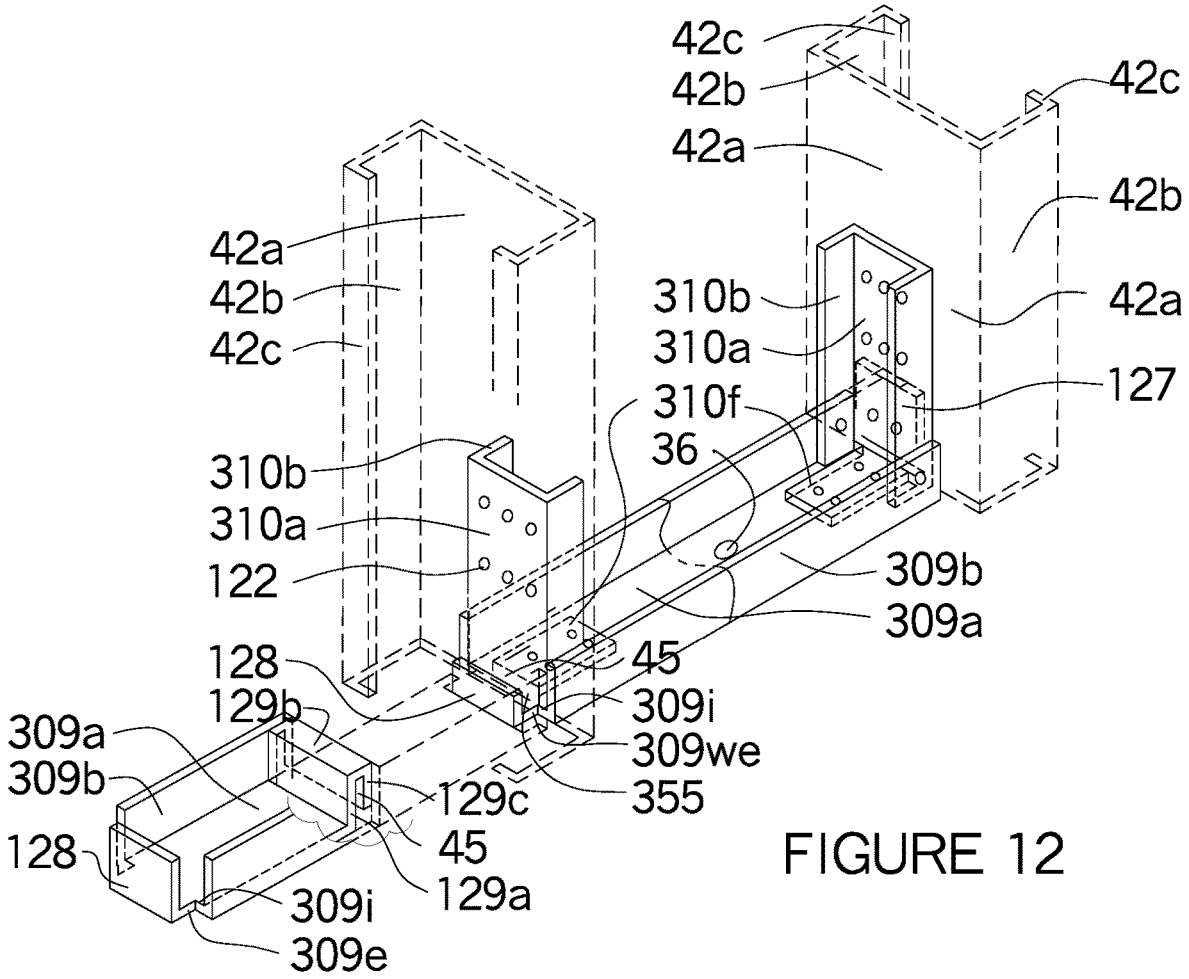
FIG. 12 shows a two piece spacer brace assembly at the floor where one end has a hook finger and the opposing end has a hook receiver end with a separate hold-down installed in the interior side of the spacer brace.

FIG. 12 is similar to FIG. 10 as the hold-down spacer brace 309 on the right side are the same configuration, while on the left side shows the indentation 309*i* at the flange 309*b* and the web 302*a* with the web 309*a* having a web extension 309*we* pass under the web 42*a* of the support member forming the anchor space 355 and extend beyond the web 42*a* so a gap 45 is formed between the web 42*a* and the hook tongue 128 that extends upward. The gap 45 is required as the adjacent hold-down spacer brace 309 has a hook receiver 129 where the third leg 129*c* fits into the gap 45 as shown in FIG. 12. The hold-down spacer brace 309 can vary where the hook receiver 129 can have the third leg 129*c* extend downward with the flanges 309*b* being level with the third leg 129*c* in order for the hook tongue 128 to fit into the gap 45 and keep the hook tongue 128 stable between the two flanges 309*b* as shown in FIG. 12. On the other hand, FIG. 9 had the flanges 309*b* extend beyond the hook tongue 128 as described in FIG. 10.

FIG. 11 shows a U-shaped spacer brace 302 extending over the top edges of a support member shown as a C channel 42 where the interior side has the web 302*a* with its flanges 302*b* extending downward. The right side show the flanges 302*b* and web 302*a* indented with the flanges 302*b* abutting the web 42*a* of the support member. The web 302*a* has a web extension 302*we* that extends over the web 42*a* at the anchor space 355 for a nook finger 127 to extend downward against the opposing side facing of the web 42*a*. The left side shows the indentation 302*i* of the web 302*a* and the flanges 302*b* where the flanges 302*b* abut the web 42*a* of an adjacent support member. The web 302*a* of the U-shaped spacer brace 302 has another anchor space 355 at the web extension 302*we* where the first leg 129*a* of the hook receiver extends downward against the web of the support member also referred to as the second engagement connection. The second leg 129*b* extends outward parallel to the web 42*a* leaving a gap 45 for the third leg 129*c* to extend upward forming a U-shaped hook receiver 129. The U-shaped spacer brace 302 shows the hook finger 127 on the right side and the left side of the shows the hook receiver 129 which is the beginning of installing the U shaped spacer braces 302 in tandem. When the U shaped spacer brace 302 is secured to the ceiling or floor above with fasteners as shown in FIG. 3 and the longitudinal ends of the support members have a gap 45, the longitudinal end that is installed in the web extension 302*we* between the first leg 129*a* on the left end or the hook finger 127 on the right end plus the flanges 302*b* are allowed to slide up and down in the anchor spacer 355 at the web extension 302*we*. In order to be able to slide the flanges 302*b* and the first leg 129*a* or finger 129 are longer in length to allow for the support member to slide between the two surfaces. At the top of the wall the U shaped spacer brace 302 is secured to the ceiling by fasteners 122 and the longitudinal end of the support member has a gap 45 between the longitudinal end and the ceiling. The gap 45 allows the support member shown as a C channel 42 to move vertically should the floor or ceiling move. The slot holes 36*s* with a fastener 122 (not shown) are needed to secure the support member horizontally to the U shaped space brace 302.

Figure 13:
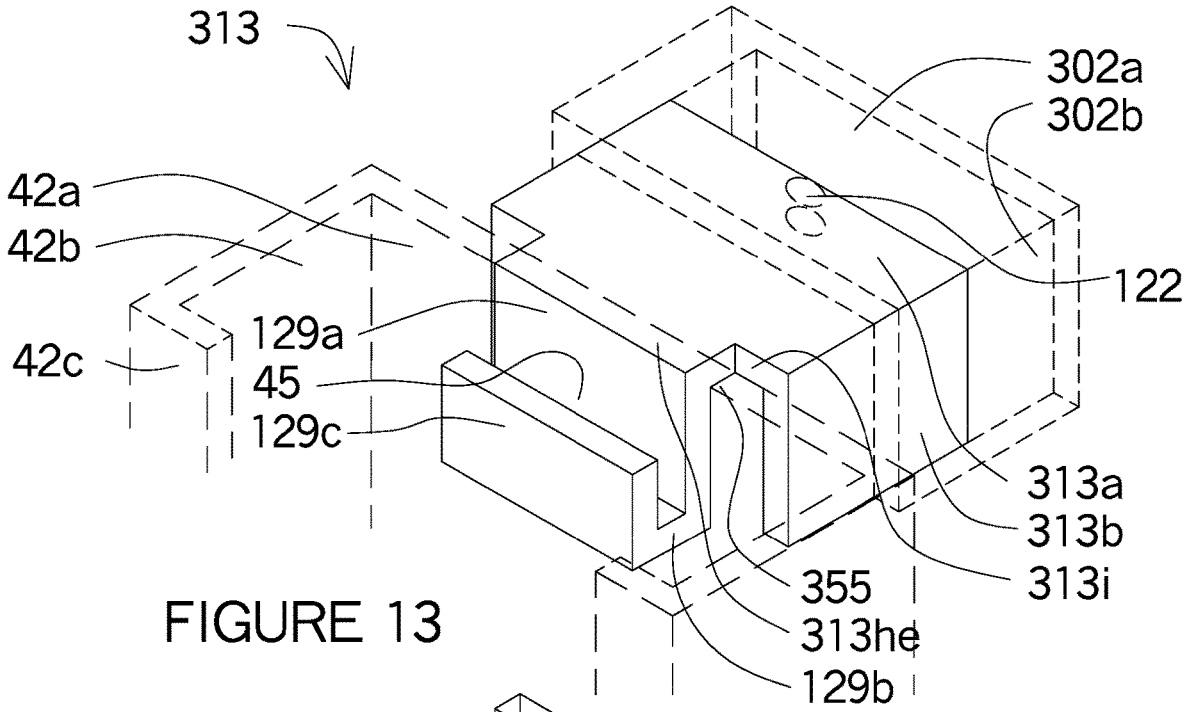
FIG. 13 shows an add-on hook clip with a U-shape profile being attached to a U shaped channel.
Figure 14:
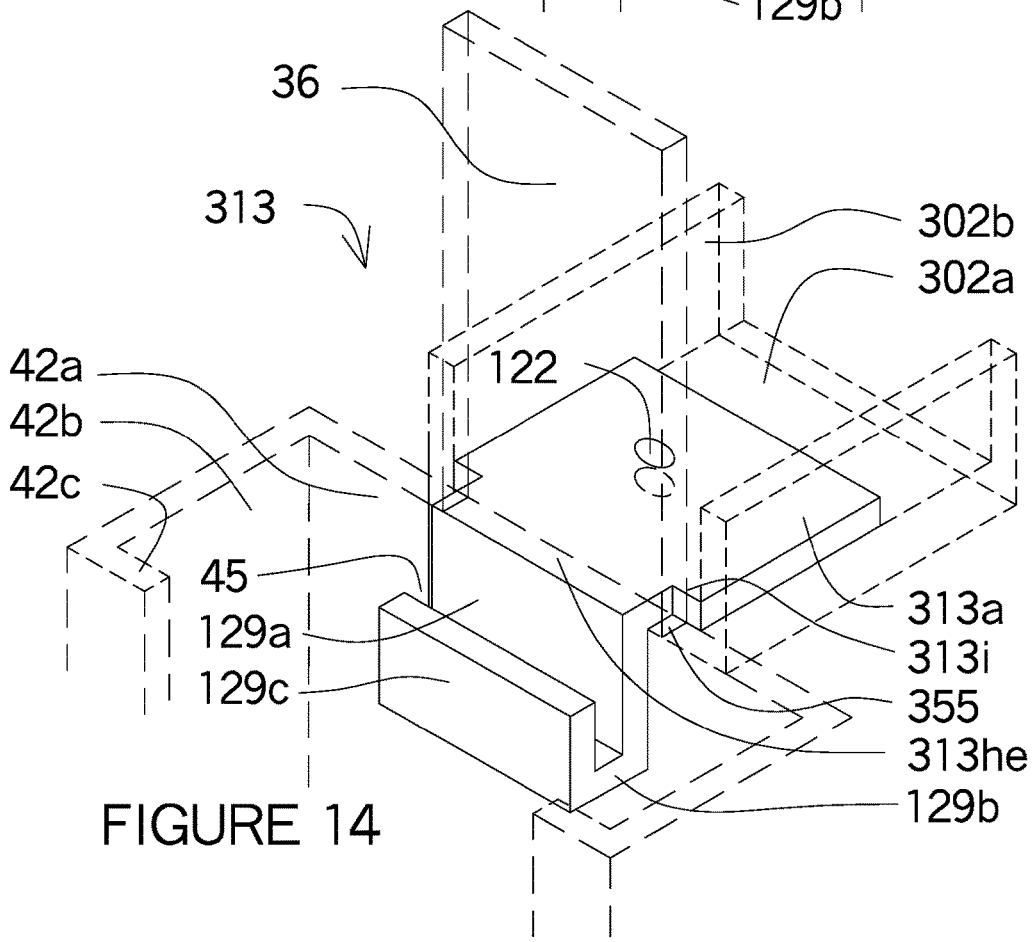
FIG. 14 shows an add-on hook clip having only its end attached to horizontal bracing channel.
Figure 15:
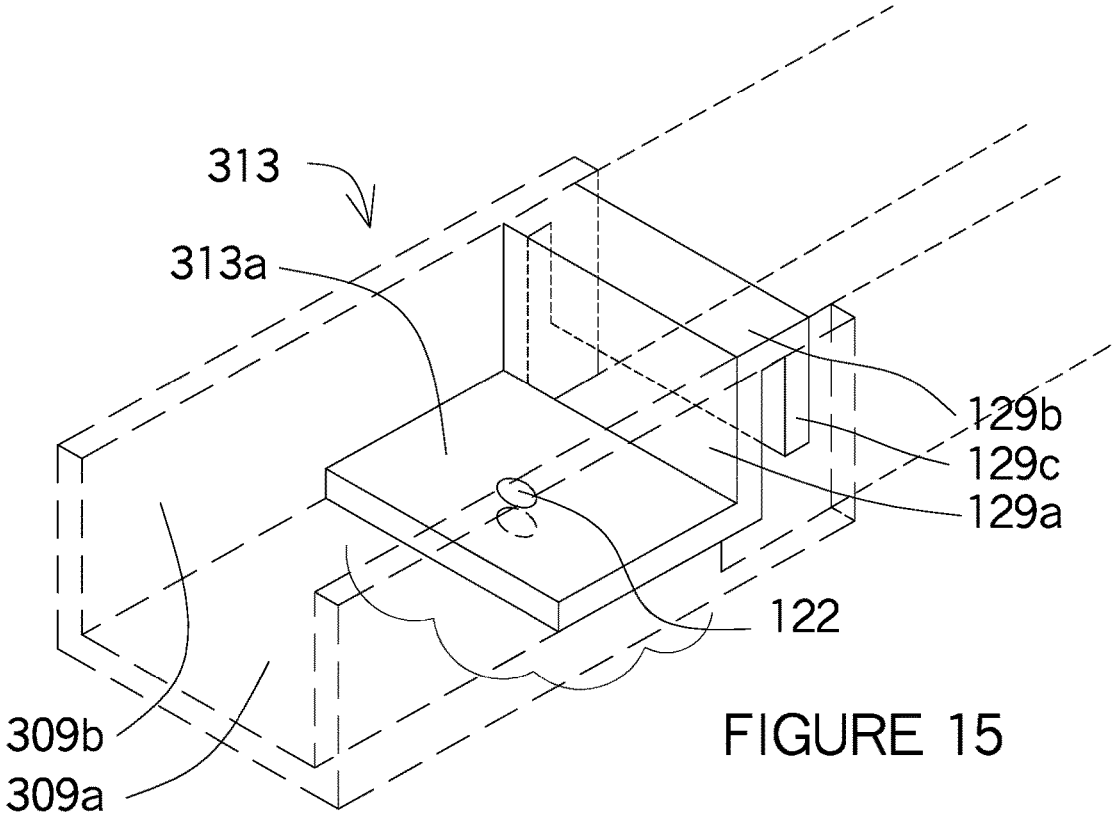
FIG. 15 shows an add-on hook clip having a downward oriented third side of the hook clip.

FIGS. 13-15 are add-on connectors 313 where I, C, J, W or hold-down spacer braces have been cut or altered so a hook receiver 129 can be added to the spacer brace in order to continue the spacer braces with a tandem connection. In FIG. 13 the add-on connector 313 has a U-shape with a web 313*a* and flanges 313*b* that fit into the interior side of a U-shape spacer brace 302 with is web 302*a* and flanges 302*b* fit tight against the exterior side of the add-on connector 313. FIG. 13 shows the web 313*a* and flange 313*b* protruding from the U-shape spacer brace 302. The add-on connector 313 has an indentation 313*i* at the web 313*a* and flanges 313*b* with the flanges 313*b* abutting against the web 42*a* of the support member. The web 313*a* has a web extension 313*we* that fits over the web 42*a* of the support member at the anchor space 355 where the first leg 129*a* of the hook receiver 129 extends downward against the opposing side of the web 42*a* then extending horizontally outward from the web 42*a* forming the second leg 129*b* with the third leg 129*c* extending upward leaving a gap 45 between the first leg 129*a* and the third leg 129*c*. In FIG. 14 the web 313*a* of the add-on connector 313 is installed directly over the web 302*a* of the U shaped spacer brace 302 so the web 302*a*, flanges 302*b* and the indentation 313*i* abut the web 42*a* of the support member and the web extension 313*we* rest upon the anchor space 355 with the first leg 129*a* extending over the support member. In FIG. 15 the web 313*a* of the add-on connector 313 is attached to the web 309*a* of the hold-down spacer brace 309 as shown as a one piece hold-down spacer brace 309 in FIG. 12.

FIGS. 16-19 show various W-shaped clips 307 or U-shaped clips 308 passing the through the holes 36 in the web 42*a* of the support members, over or under the web 42*a* of support members, connecting adjacent support members together and how the W-shaped clips 307 or U-shaped clips 308 connect to adjacent spacer braces.

Figure 16:
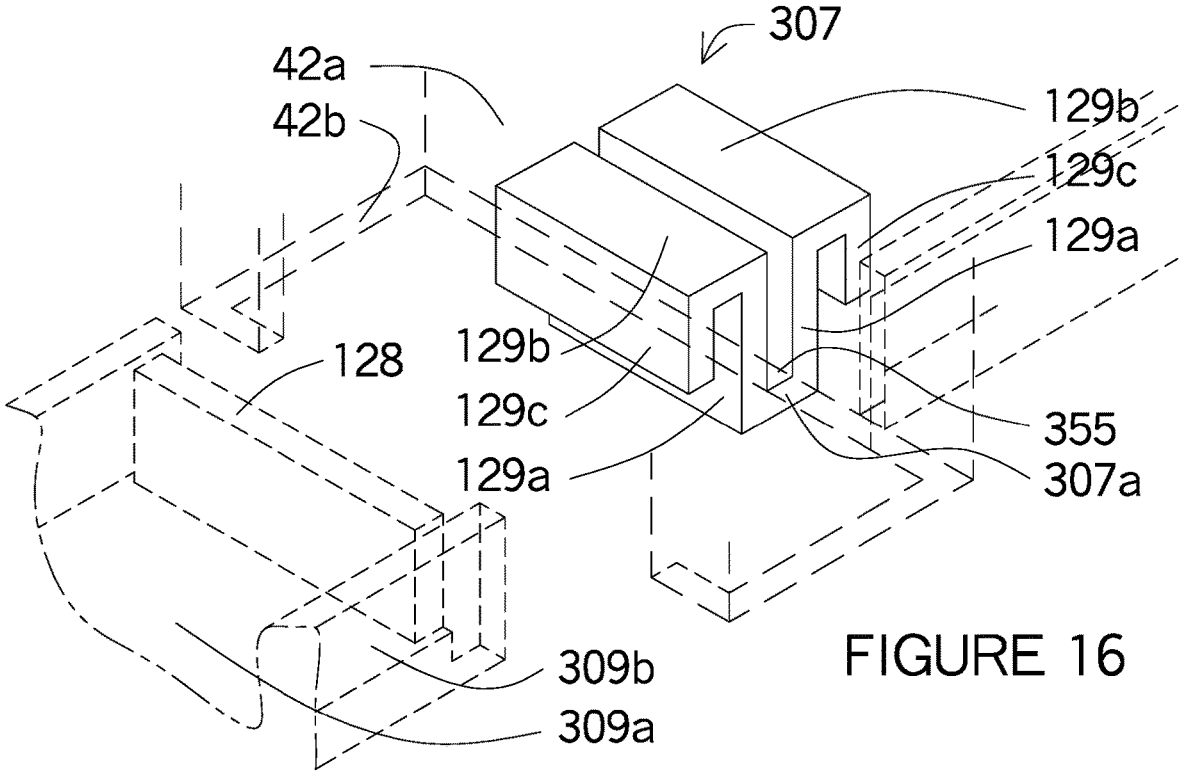
FIG. 16 shows the W-shaped clip having a hook receiver on both sides of the bottom edge of the web of a support member.
Figure 18:
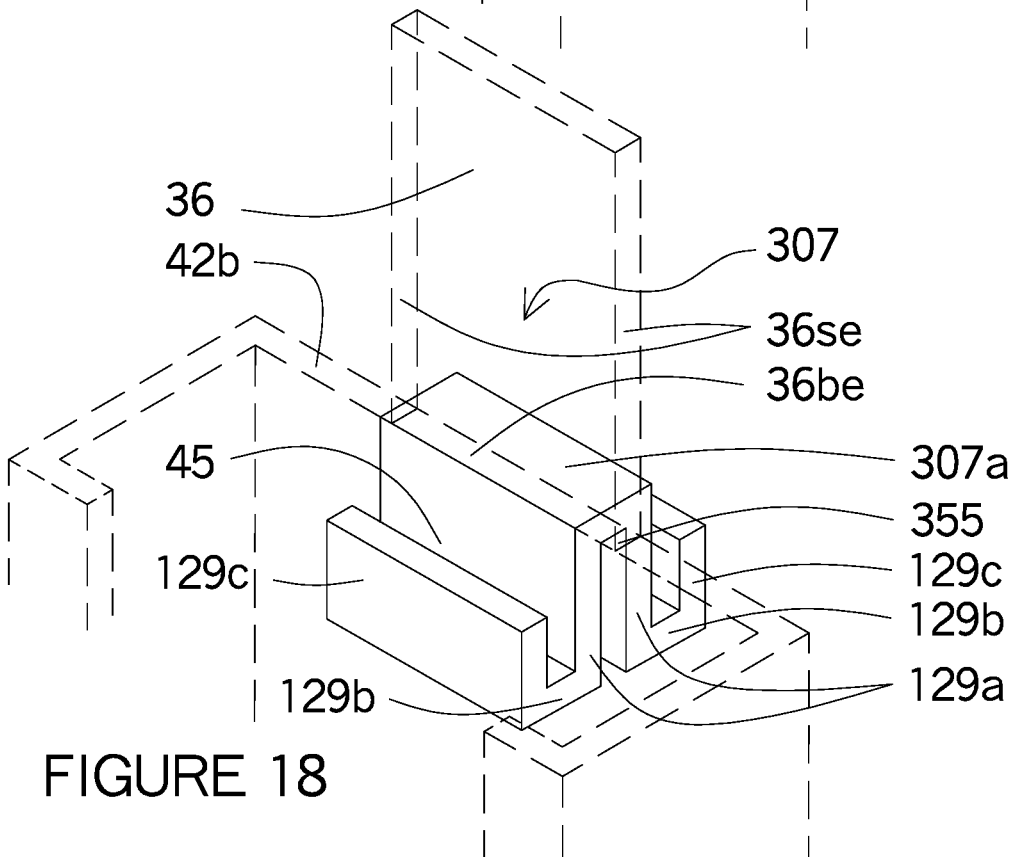
FIG. 18 shows the W-shaped clip having hook receivers on both sides of the hole or top edge of the support member at the web.
Figure 45:
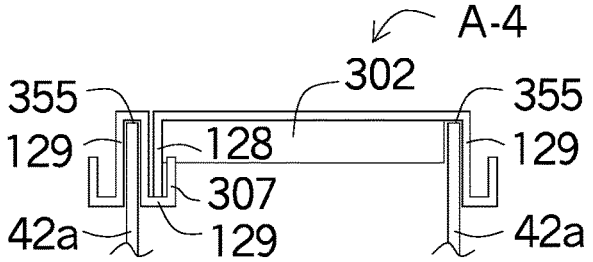
FIG. 45 shows an schematic view of a construction assembly using spacer braces spanning between two support members having the anchor space of a W-clip engage the support member with the hook receiver on the right side end engaging the hooked tongue of the spacer brace with a hook receiver end on the right side end.
Figure 46:
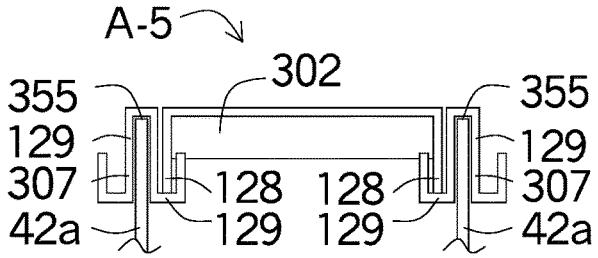
FIG. 46 shows an schematic view of a construction assembly using spacer braces spanning between two support members having the anchor space of a W-shaped clip engage the support member with the hook receiver on the right side end engaging the hooked tongue of the spacer brace with a hook tongue end on the right side end engaging the hook receiver of on the left side of the W-clip with its anchor space engaging the support member.

FIGS. 16 & 18 show the same W-shaped clip 307 however in FIG. 16 the W-shaped clip 307 fits under the web 42*a* of the support member at the anchor space 355 with the hood receivers 129 are oriented with the gaps 45 opening downward and in FIG. 18 the web 42*a* of the support member fits under the web 307*a* at the anchor spacer 355 and the hook receivers 129 have the gaps 45 opening upward in the opposite direction. In FIG. 18 the W-shape clip 307 has a horizontally oriented web 307*a* where the web 307*a* is the extension that fits over the thickness of the web 42*a* of the support member and extends over both the vertical side edges of the web 42*a* so a hook receiver 129 can be installed on both sides of the web 42*a* of the support member and the first leg 129*a* extends downward against the web 42*a* with the second leg 129*b* extending outward from the web 42*a* forming a gap 45 where the third leg 129*c* extends upward forming a U-shape hook receiver 129 on both sides of the web 42*a* of the support member. The W-shape clip 307 is also shown passing over the hole bottom edge 36*be* of a support member engaging the hole side edges 36*se*. FIG. 16 shows the same W-shaped clip 307 however the web 42*a* of the support member fits on top of the interior side of the web 307*a* and the exterior side fit against the floor and the hook receiver 129 has the U-shape turned downward. To the left of the W-shaped clip 307 shows the hook tongue 128 extending upward from the web 309*a* of the hold-down spacer brace 309. One of the third engagements described in FIGS. 45 & 46 shows the hook tongue 1238 fitting into the gap 45 lodging the W-shaped clip 307 to the hook tongue 128. Any shape spacer brace can be used in and the hook tongue 128 for any spacer brace can fit into the W-shaped clip 307.

Figure 17:
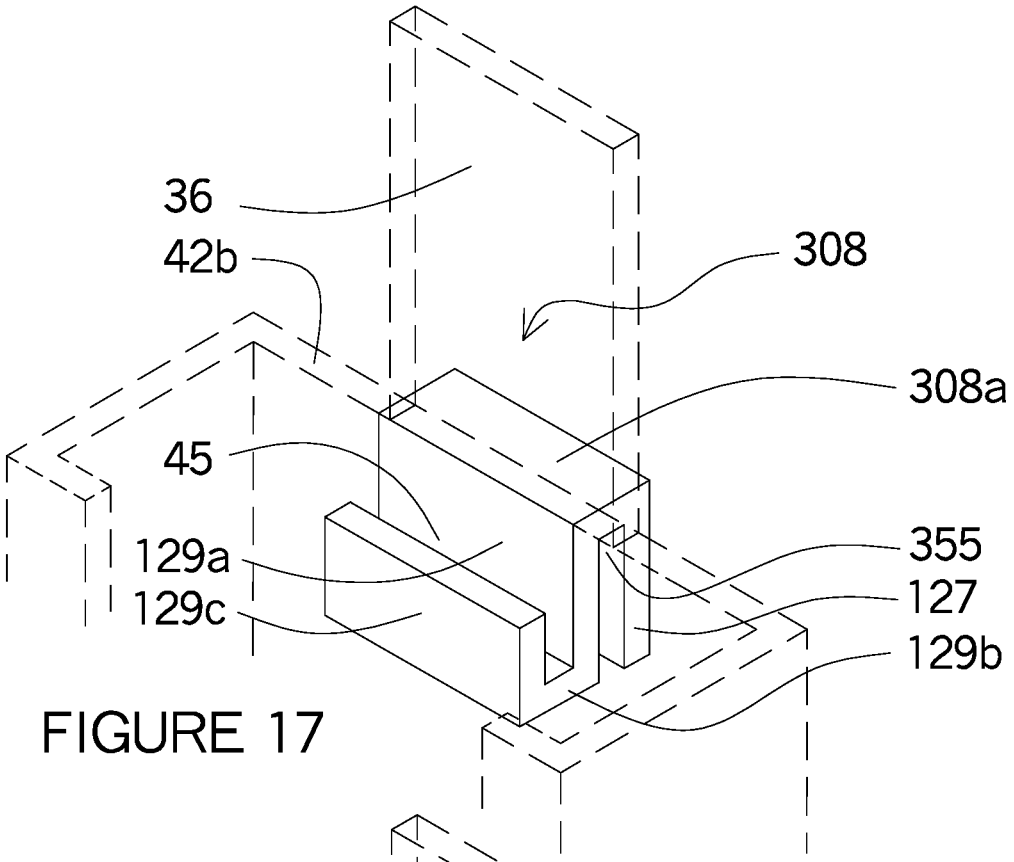
FIG. 17 shows the U-shaped clip having only one hook receiver side and the opposite end secured to the web at a hole or the top end of the support member at the web.
Figure 19:
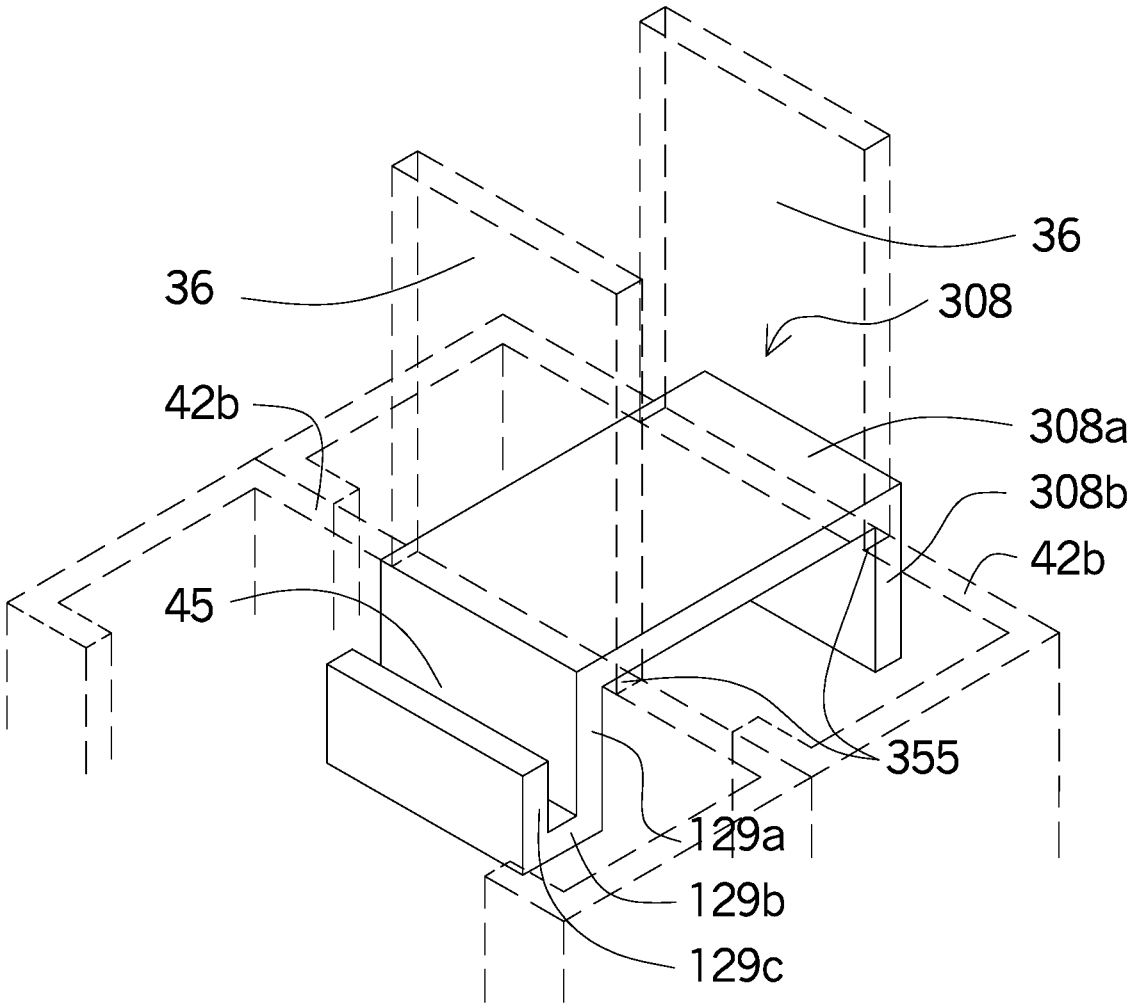
FIG. 19 shows a horizontally oriented U-shaped clip having a hook receiver on one side with an anchor space over two support members and a hook finger over the opposing end.

FIGS. 17 & 19 how the same U-shaped clip 308 however in FIG. 19 the U-shape clip 308 connects two adjacent support members together. FIG. 17 shows the U-shape clip 308 having a web 308*a* that extends over the thickness of the web 42*a* at the anchor space 355 and extending over both the vertical side edges of the web 42*a* so a hook finger 127 can be installed against the web 42*a* of the support member and the opposing end of the web 308*a* can be installed against the opposing side of the web 42*a* of the support member so the first leg 129*a* extends downward against the web 42*a* with the second leg 129*b* extending outward from the web 42*a* forming a gap 45 where the third leg 129*c* extends upward forming a U-shape hook receiver 129 on both sides of the web 42*a* of the support member. In FIG. 19 the same U-shaped clip 308 is shown, however the web 308*a* extends over the top of two webs 42*a* or the holes bottom edge 36*be* and shown as the anchor space 355 in the webs 42 of the support members. Many times a cripple support member (a less than full height support member is used together with a full height wall support member to frame a door or window opening) is adjacent to a support member for structural support when framing a wall.

Figure 20:
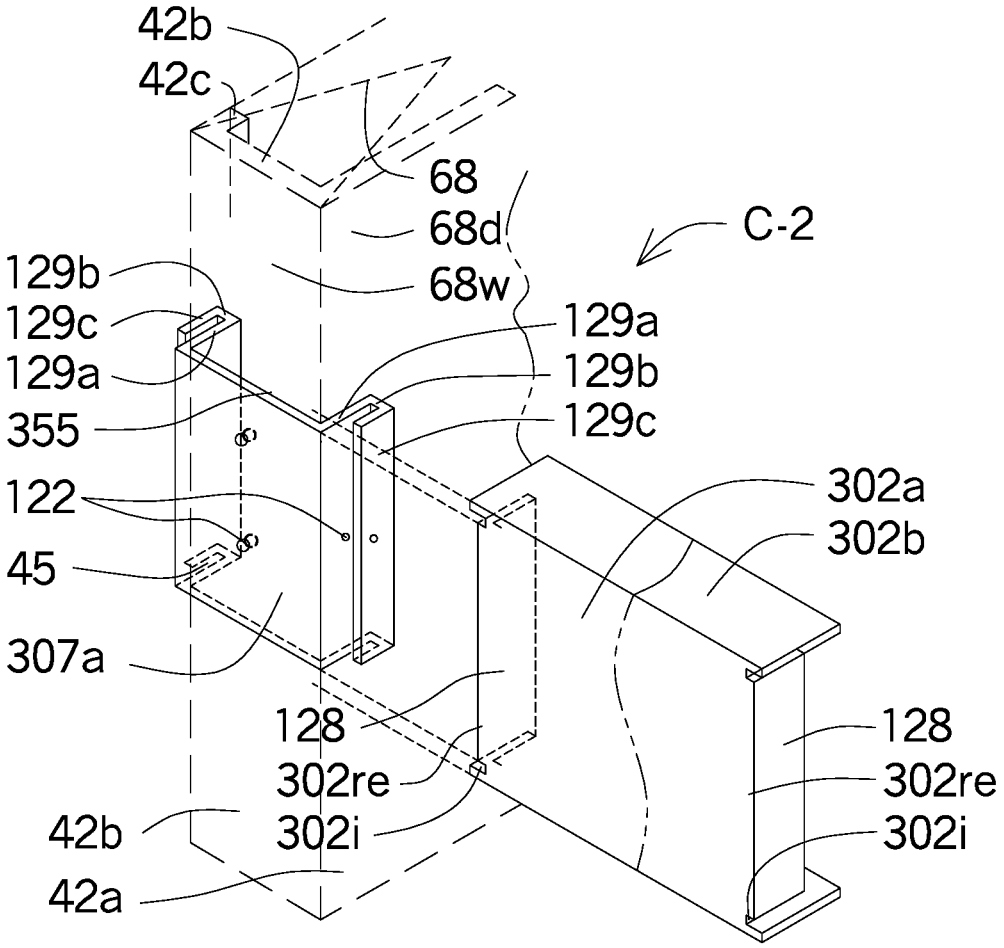
FIG. 20 shows a vertically oriented W-shaped clip having the web anchored to the vertical face of the support member with hook receivers at each end with a hook tongue of an adjacent spacer brace being connected.

FIG. 20 is similar to FIG. 18 except in FIG. 20 the W-shaped clip 307 has a vertical oriented web 307*a* and the interior side has the anchor space 355 against the flange 42*b* of a vertical support member or against the width side 168*w* of a wood support member 168. The web 307*a* extends over the flange 42*b* or the depth side 168*d* of the wood support member 168. Both sides of the web 307*a* have the first leg 129*a* of the hook receiver 129 extend horizontally against the sides of their respective surfaces then vertically extending away from the first leg 129*a* forming a second leg 129*b* leaving a gap 45 for a third leg 129*c* to extend vertically toward the web 307*a* of the W-shaped chip 307. To the right of the W-shaped clip 307 shows a vertically oriented U-shaped spacer brace 302 where the web 302*a* is flush with the web 307*a* of the W-shaped clip 307 and the flanges 302*b* extend inwardly leaving the exterior side flush with the W-shaped clip 307. Both ends of the U shaped spacer brace 302 show hook tongues 128 extending internally from the web 302*a* having an indentation 302*i* with a receiver extension 302*re* that abuts the web 307*a* of the W-shaped clip 307 with a hook tongue 128. The hook tongue 128 is inserted into the gap 45 of the hook receiver 129 with the flanges 302*b* bracing the side edges of the hook receiver 129 from moving horizontally within the gap 45. Since the W-shaped clip 307 and the U shaped channel 302 are oriented vertically, the W-shaped clip 307 needs to be secured at the web 307*a* and the hook receiver 129 and hook tongue 128 need to be fastened together with fasteners 122. A spacer brace having hook tongues 128 at both ends is also shown in a schematic drawing in FIG. 46.

Figure 21:
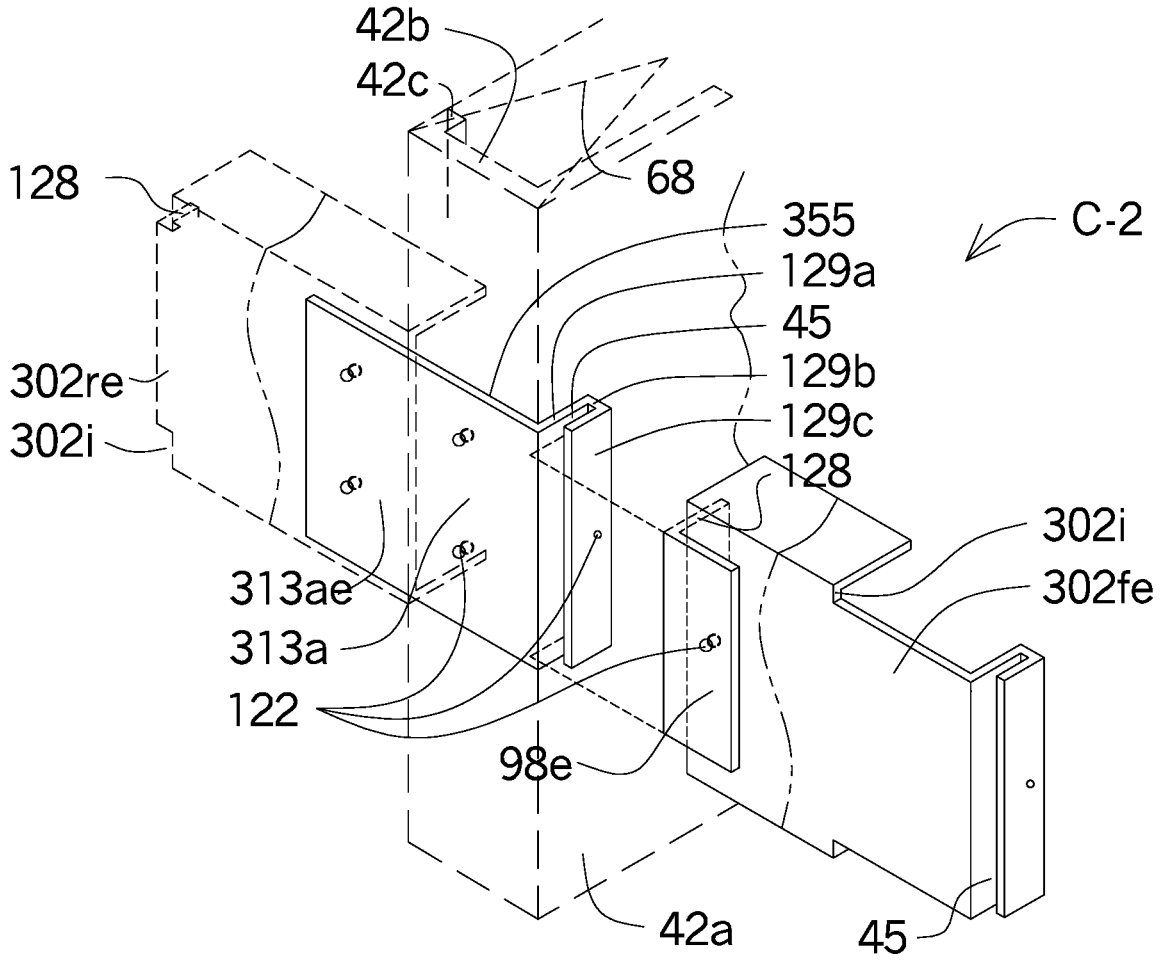
FIG. 21 shows an vertically oriented add-on hook receiver clip having the anchor space extended over the flange of a support member connected onto the cut-off end of the horizontally installed with a vertically oriented web of the adjacent spacer brace with the adjacent spacer brace having the hook tongue cut from the web and flanges of the adjacent spacer brace.
Figure 22:
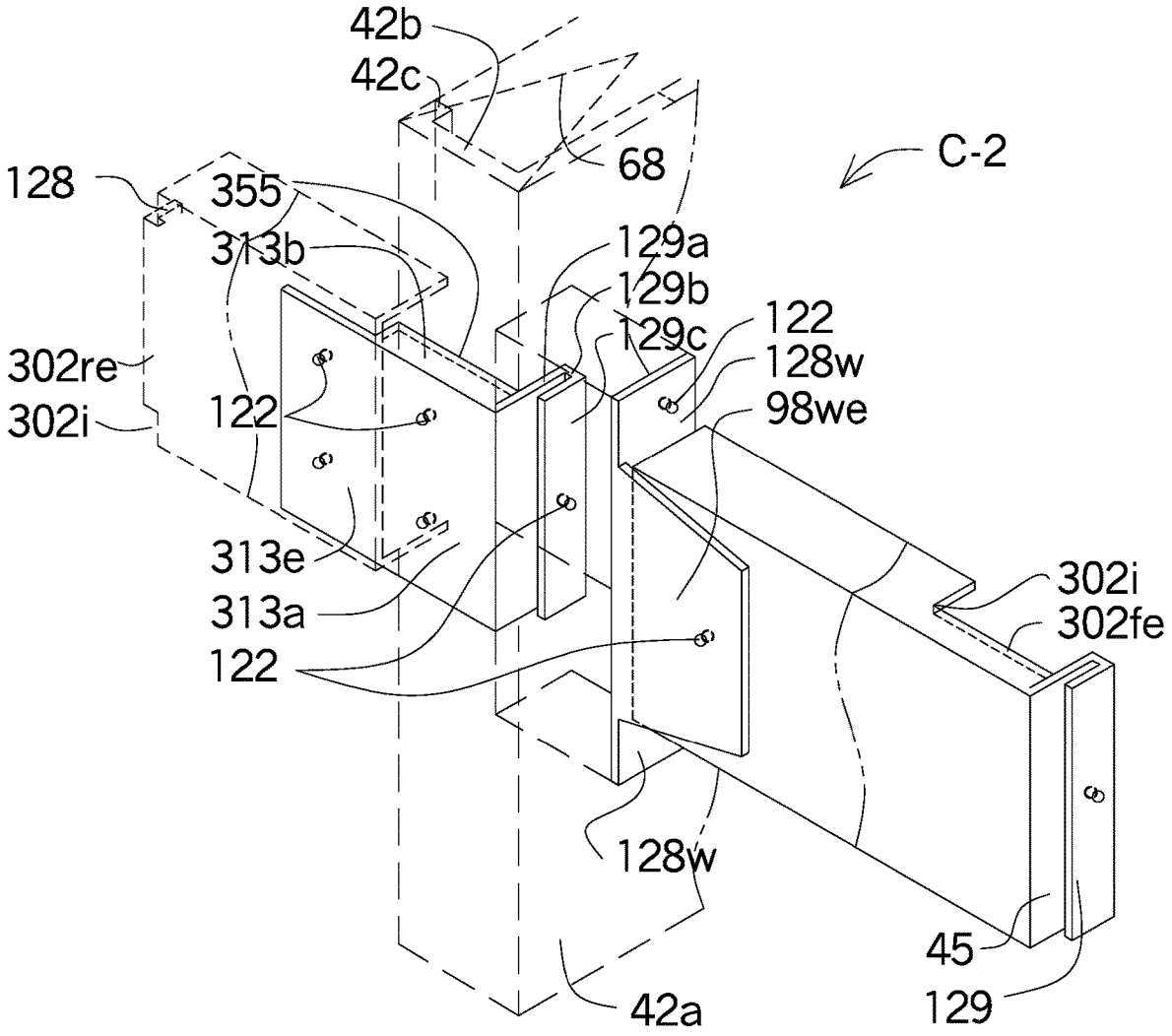
FIG. 22 shows the vertically oriented add-on hook receiver clip as shown in FIG. 21 but with having flanges that extend the add-on hook receiver clip away from the face of the support member.

FIGS. 21 &22 are similar as both are shown as add-on connectors 313 and are shown being connected to a vertically oriented U-shaped spacer brace 302 where the web 302*a* is vertically oriented with two flanges 302*b* extending horizontally. The right end of the U-shaped spacer brace 302 has the web 302*a* and flanges 302*b* abutting the vertical support member with the web 302*a* flush with the flange 42*b* of the C channel 42 or the width 68*w* of the wood framing member 68 and the left side shows an indentation 302*i* at the web 302*a* and flanges 302*b* where the web 302*a* has a receiver extension 302*re* for the hook tongue 128 shown bent internally. The add-on connector 313 in FIG. 21 is shown having the web 313*a* installed over the flange 42*b* at the anchor space 355 with the web extension 313*we* installed over the web 302*a* of the U shaped spacer brace 302. The right side shows the hook receiver 129 being attached to the web 313*a* so the first leg 129*a* is installed against the web 42*a* of the support member then turned 90 degrees forming the second leg 129*b* leaving a gap 45 between the third leg 129*c* and the first leg 129*a*. The add-on connector 313 is used where a standard length of a spacer brace is not available and is cut to accommodate another support member. If a spacer brace is cut it is easy to just cut the flanges 302*b* so the web 302*a* can be bent to form a hook tongue 129 or a bent angle 98 could be attached at the bent angle extension 98*e* to the web 302*a* with the opposing leg is a hook tongue 129.

FIG. 22 is similar to FIG. 21 however the U shaped spacer brace 302 extends away from the flange 42*b* of the support member so the add-on connector 313 extends outward from the flange 42 becoming the anchor space 355 as the web 313*a* has the bottom edge of the flanges 313*b* engage the flange 42*a* of the support member with the left side having a web extension 313*we* that overlaps the web 302*a* and is secured by a fastener 122 and the right side has a hook receiver 129 that has its first leg 129*a* with its interior side abut the web 42*a* of the support member then extending outwardly forming the second leg 129*b* leaving a gap 45 for the third leg again bent 90 degrees. The hook tongue 128 is formed by a bent angle 98 where the bent angle 98 is attached by fasteners 122 to the web 302 of the adjacent U shaped spacer brace 302, however the hook tongue is a wide hook tongue 129*w* where the ends extend past the width of the U shaped spacer brace 302 enough for fasteners 122 can be installed through the wide hook ends into the web 42*a* of the support member.

Figure 23:
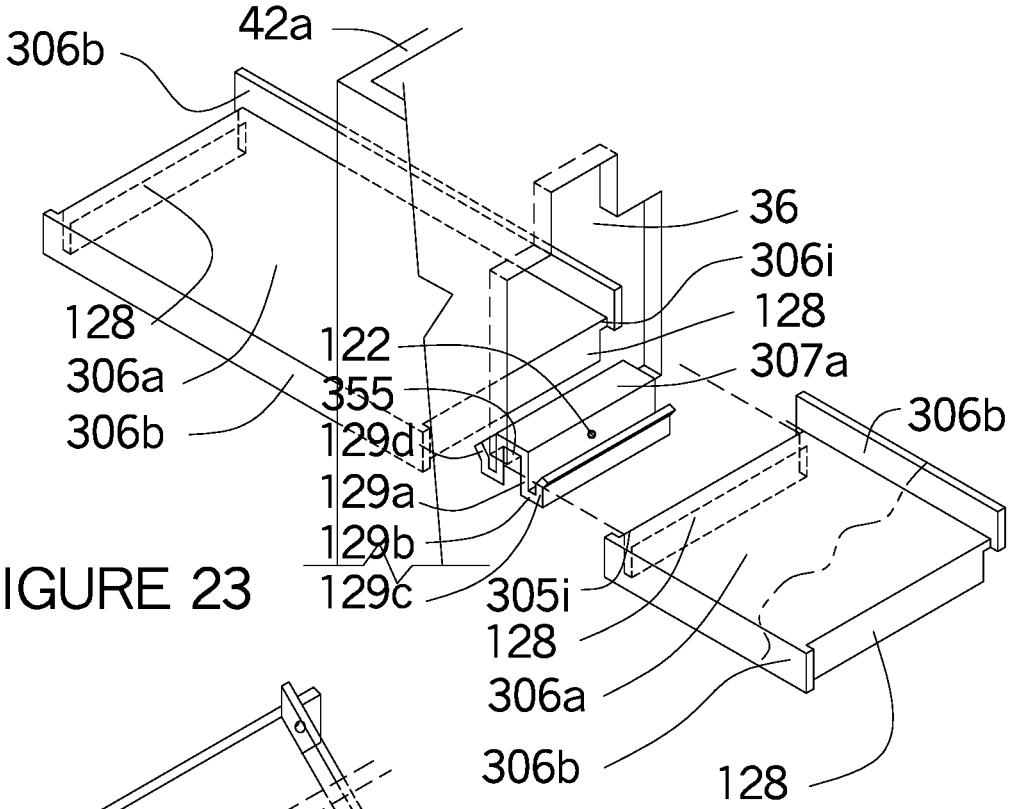
FIG. 23 shows a J-shaped spacer brace having both end having hook tongues with a hook clip having both upward oriented U-shaped hook ends on each side with the throat passing firming through the hole of the support member.
Figure 24:
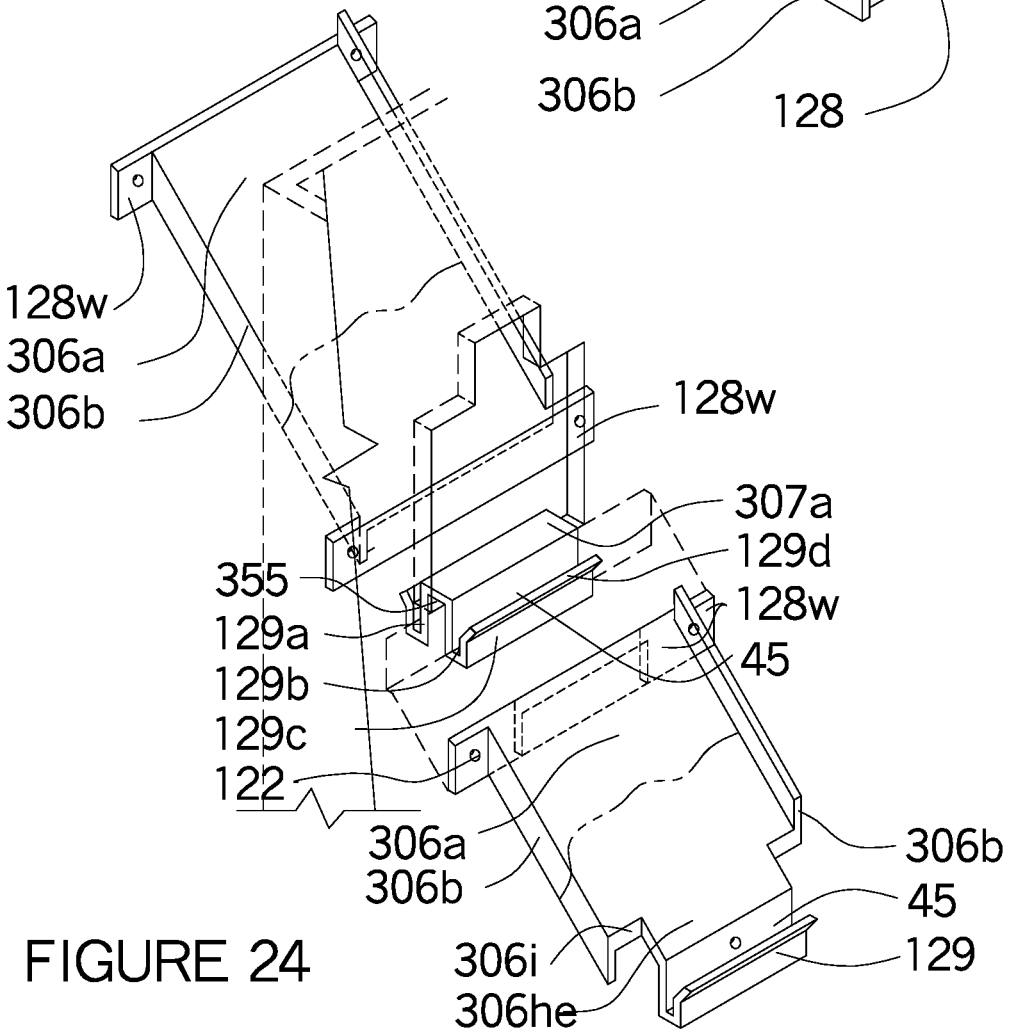
FIG. 24 shows the I-shaped spacer braces having both ends having hook tongues that extend longer than the width of the I-shaped spacer braces with a hook clip having both upward oriented U-shaped hook ends on each side with the throat passing firming through the hole of the support member
Figure 25:
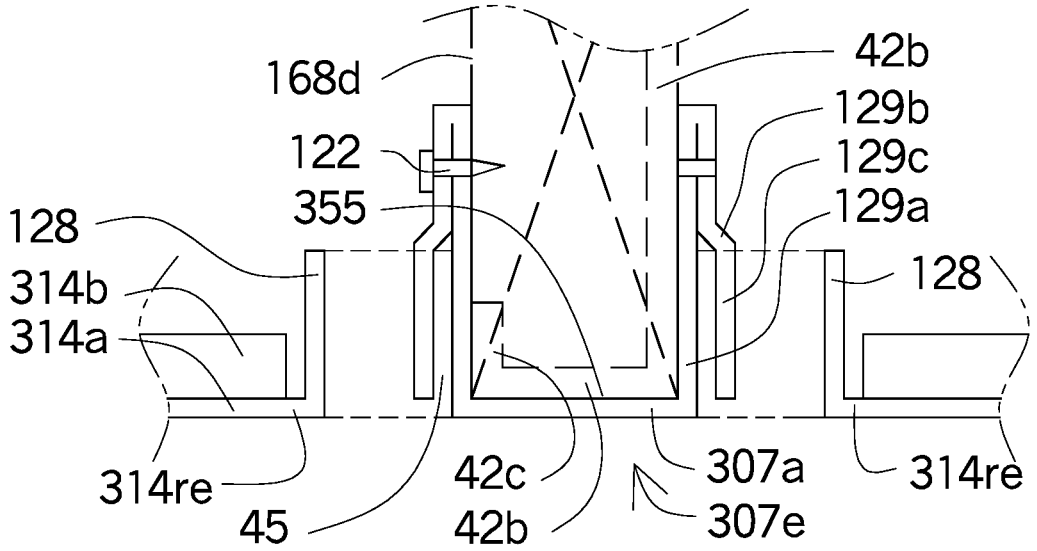
FIG. 25 shows a plan view of the hook clip having the U-shape hook ends extending outward on both sides of the flange or wood support member and shown with the hook tongues of the spacer braces being installed into the U-shaped hook ends.

FIGS. 23 &24 are similar to FIGS. 7 & 8 as the spacer braces are both horizontally oriented and both connect at the hole 36 of the support member. FIGS. 23 & 25 both show J-shaped spacer braces being connected to a W-shaped clip 307 at the hook tongue 128 of the hook receivers 129 and supported at the anchor space 355 in the hole 36. FIGS. 54-59 show various configurations of the W-shape clip 307 including the flare 129*d* shown here. FIG. 23 shows the hook tongue 128 at both ends as in FIG. 21 and the same configuration is shown in FIG. 46. FIG. 24 shows the wide hook tongues 128*w* similar to FIG. 8 By using the hook tongue 128 at both ends with a hook receiver 129 extending through the hole 36, a spacer brace can be installed in tandem between support member without having to use a full length spacer brace having a hook tongue and hook receiver at the end. Since the J-shaped spacer braces 306 is horizontal no fasteners will be required to secure the J shaped spacer brace 306 and the W-shaped clip 307 to the hole 36 as the side edges of the W-shape clip 307 will engage the side edges of the hole 36. On the other hand, FIG. 24 shows the J-shaped spacer braces 306 installed diagonally between alternating hole 36 in the webs 42*a* of two adjoining support members shown as C channels 42 (only one shown). The J shaped spacer braces 306 are shown with hook tongues 128 on both ends of the J shaped spacer brace 306, however the hook tongues are wide hook tongue 128*w* where the length of the wide hook tongue 128*w* is longer than the width of the web 306*a* so that a fastener 122 can be installed at the end of the wide hook tongue 128*w* to be fastened into the web 42*a* of the C channel 42. Since the J shaped spacer brace 306 has a wide hook tongue 128*w* at each end, the diagonal oriented J shaped spacer brace 306 can be installed between support members after the metal framed wall has been erected in order to provide additional stiffness to the wall construction should it be needed.

Figure 26:
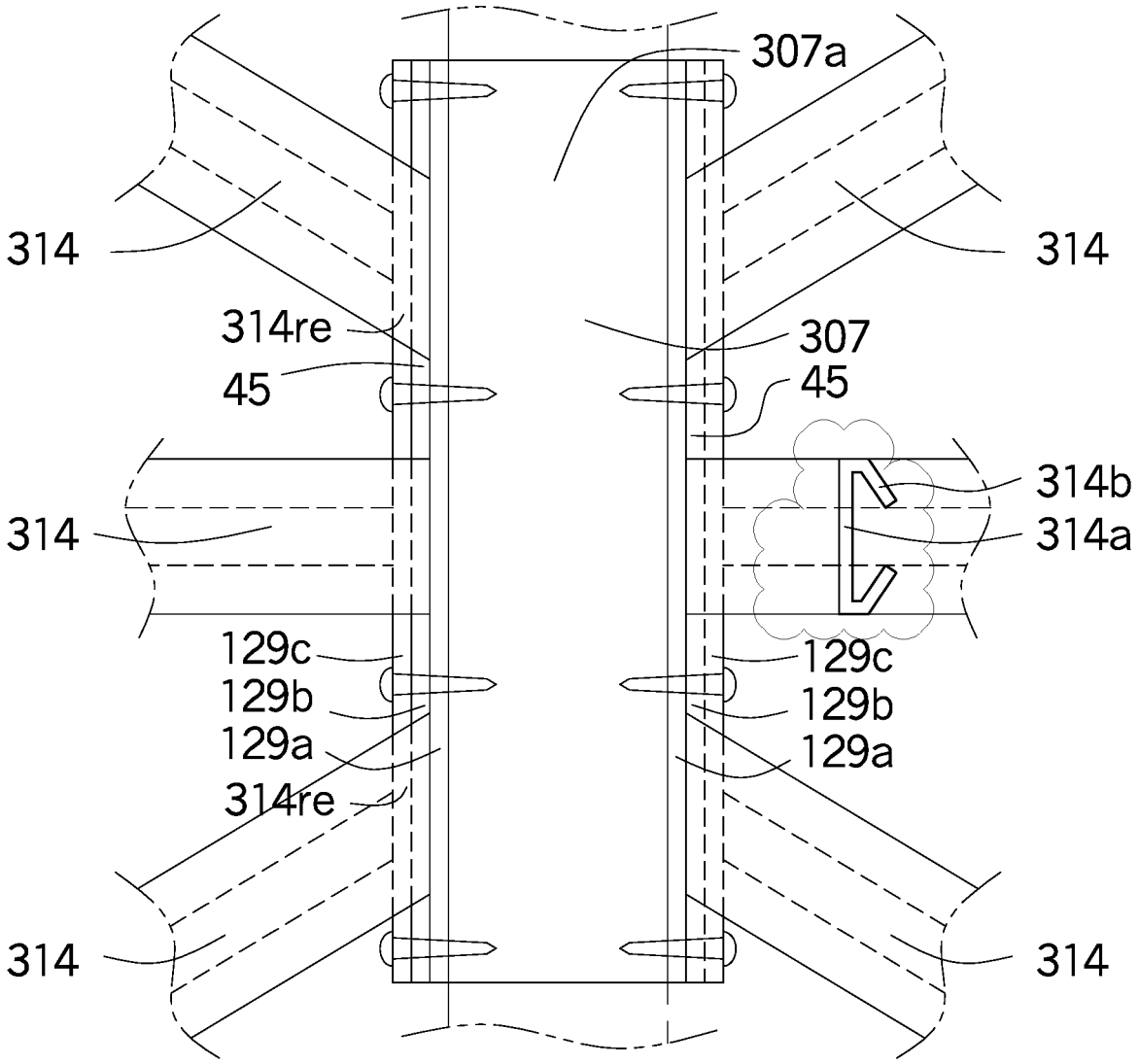
FIG. 26 shows an elevation of six spacer braces installed over the flange or wood support member by a long hook clip.

FIG. 25 is a plan view and FIG. 26 is an elevation view of an elongated W-shaped clip 307*e*. FIG. 26 shows 6 strap braces 314 intersecting the elongated W-shaped clip 307*e* where 3 braces are attached to each side of the hook receiver 129. The interior side of the web 307*a* is the anchor space 355 that abuts the flange 42*a* or the width 68*w* of a wood framing member for the elongated W-shaped clip 307*e*. The hook receivers 129 on both sides have the first leg 129*a* extending along the web 42*a* or lip 42*c* of the C channel 42 or the width side 68*w* of the wood support member 68 with the second leg 129*b* extending outward from the support member forming a gap 45 where the third leg 129*c* is bent parallel to the first leg 129*a*. A hook tongue 128 is shown going into the gap 45 having a receiver extension 314*re* extending from the web 314 of the strap brace 314. The strap brace 314 is shown having a cross section of the web 314*a* with flanges 314*b* bent about 135 degrees forming a narrow profile so insulation can more easily fit around the profile of the strap brace 314. In fact any of the vertical oriented flanges 314*b* shown on the previous figures can have the narrow profile of the strap brace 314. In FIG. 25 the section at the fasteners 122 does not show the gap 45 as the gap could be formed without the gap 45. When the fastener 122 is connected to both the first leg 129*a* and the third leg 129*c* together when the hook receiver 129 is installed in the gap 45, the fastener 122 acts as a stop and the fastener 122 is not able to move past the fasteners 122 when installed on both sides of the hook tongue 128

Figure 27:
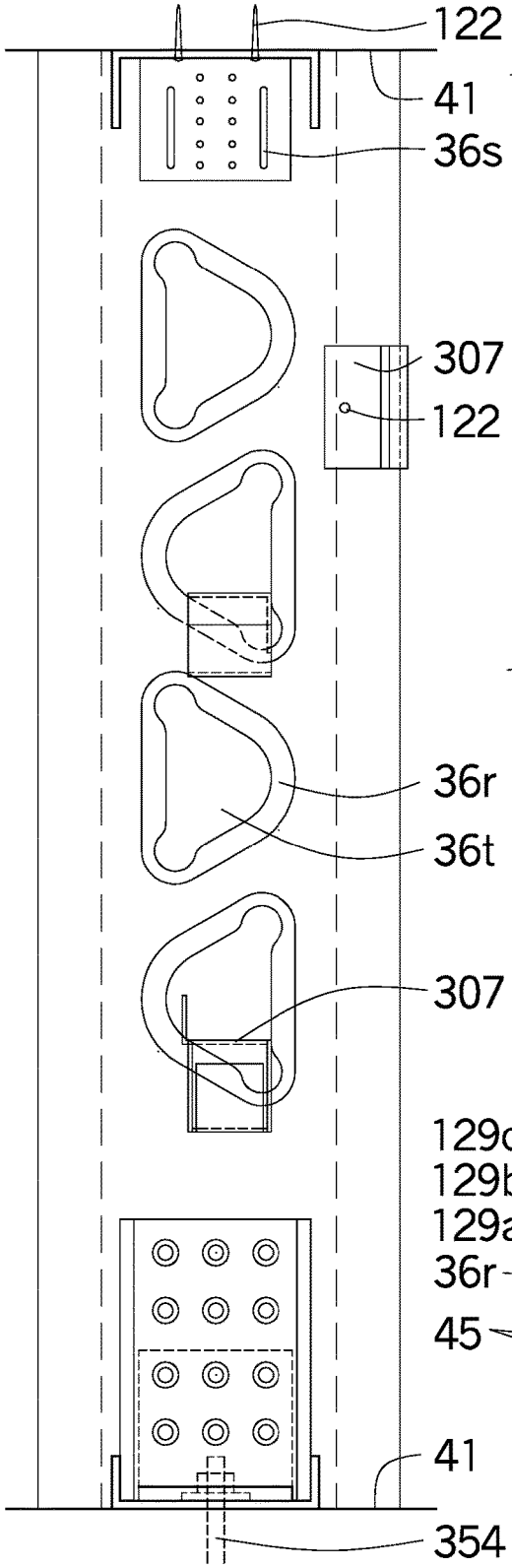
FIG. 27 shows a side elevation of a support member having triangular shaped holes where a combined J-shaped and reverse lip shape for a hook clip that has its lips with notches engage the diagonally oriented side band of the triangular hole and the opposite oriented sides have U-shaped hook ends engaging the web of the support member and the angular band of the triangular shaped hole.
Figure 28:
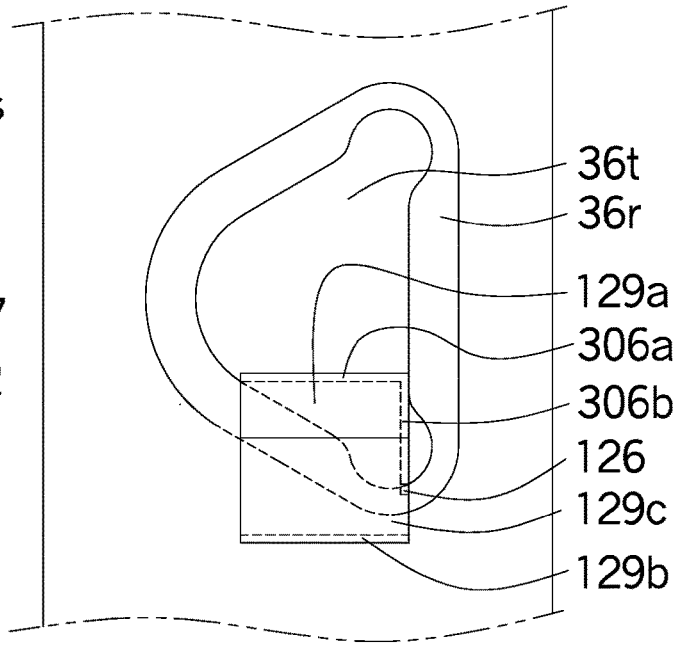
FIG. 28 shows a close up view of the triangular hole with the hook clip described in FIG. 27.
Figure 29:
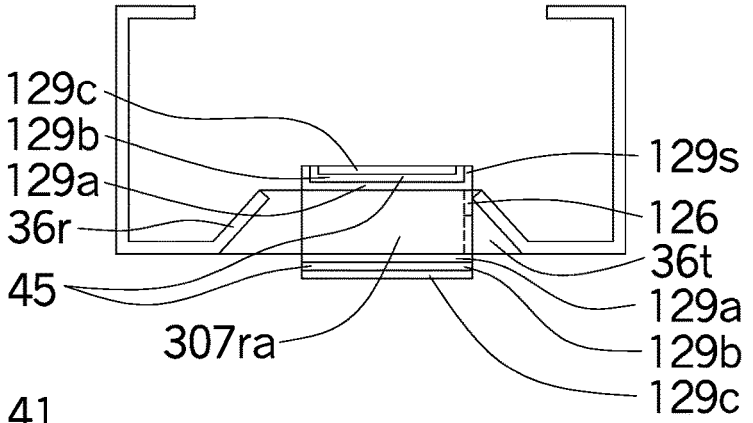
FIG. 29 shows a plan view of the support member with the hook clip installed in the triangular hole as shown in FIGS. 27 & 28.
Figure 40:
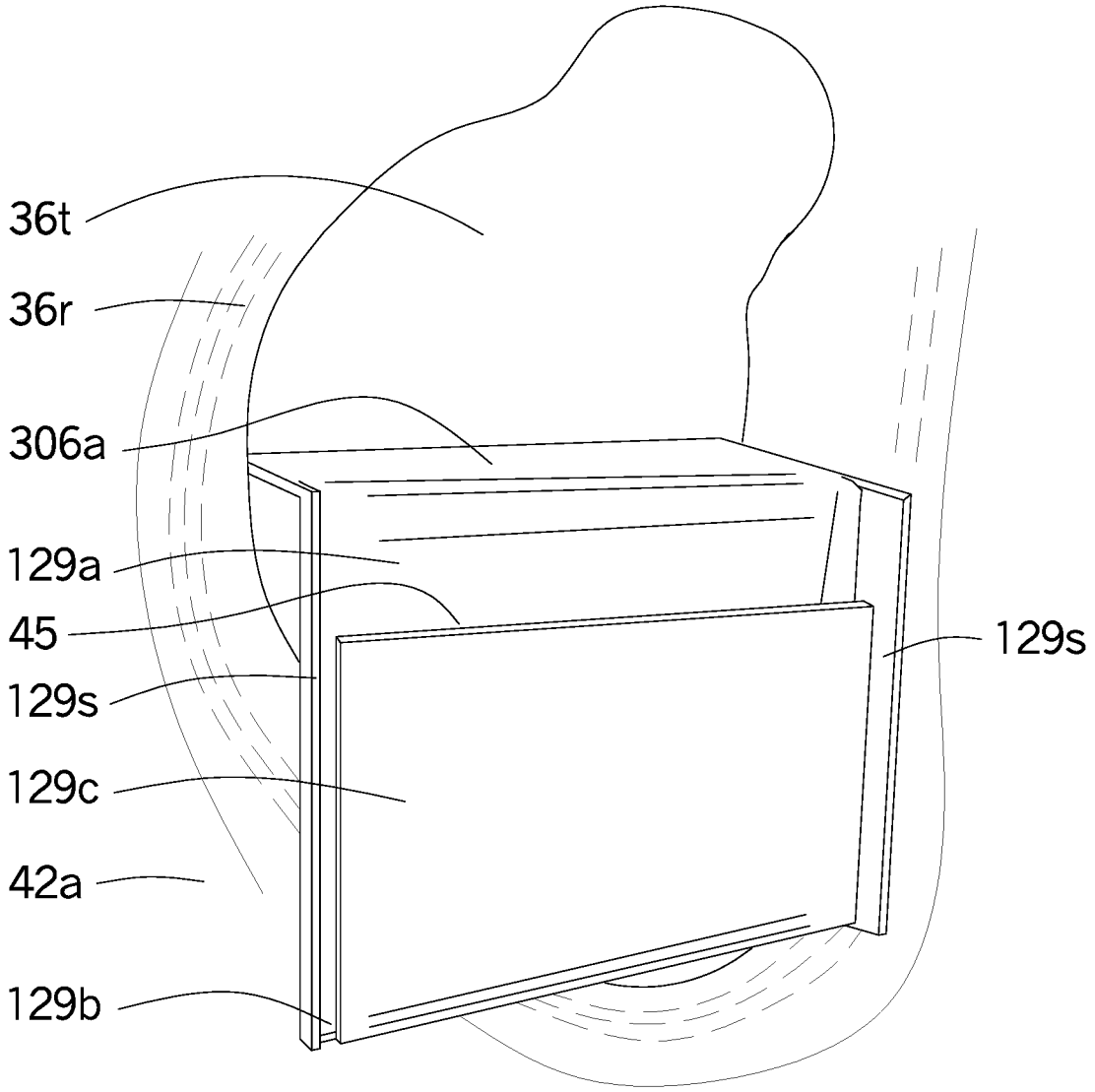
FIG. 40 shows a photograph of the web side of a vertical support member having a triangular shape hole with a W-shape clip with the hook receiver extending over the hole.
Figure 41:
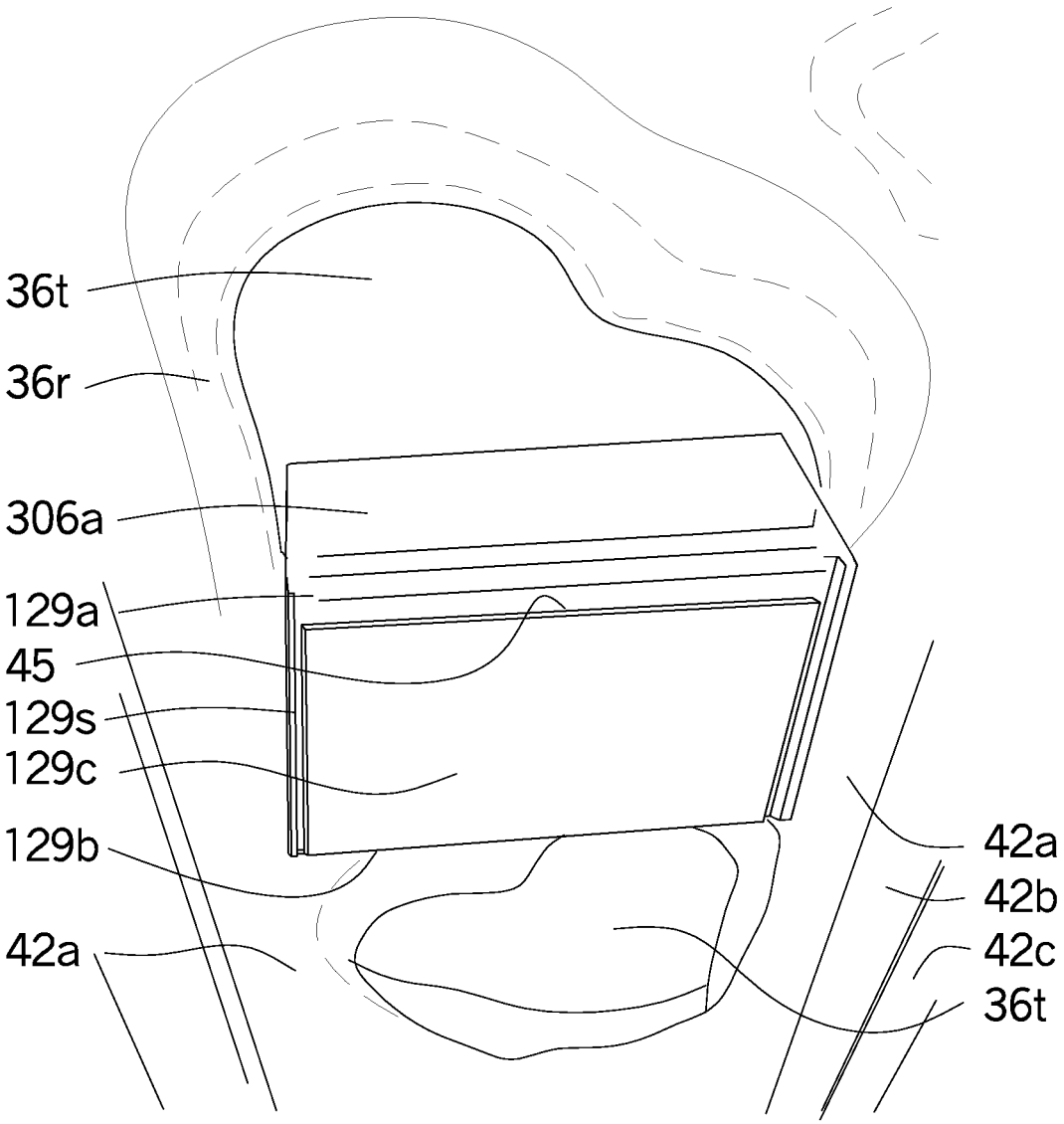
FIG. 41 shows a photograph of the interior side of the vertical support member showing the lips and flanges with a triangular shape hole with its projecting rims at the web with a W-shape clip with it flanges and the hook receiver extending over the rim of the hole.

FIG. 27 shows a metal framing wall section with triangular shaped holes 37*t* with rims 36*r* with hold-downs spacer braces 309 shown in FIGS. 9-12 attached to the floor 141 with anchor bolts 354 or the floor 141 above at the top of the metal framing wall connected by fasteners 122. The different variations of the spacer braces or clips are shown in the triangular holes 36*t* and are shown in FIGS. 38 & 29 or in FIGS. 33-42. FIG. 28 shows an enlarged elevation view, FIG. 29 a plan view and FIGS. 40 & 41 perspective views of a horizontally oriented W-shaped clip 307 inserted into a triangular shaped hole 36*t* with rims 36*r* extending inward on the interior side of the C channel 42 on the side where the flanges 42*b* and lips 42*c* are also located. Some metal stud manufactures like to add rims to the edges of the holes to add strength and when doing so the rims 36*r* add depth to the triangular shaped holes 36*t* and are usually shown at an angle. When describing the W-shape clip 307 in FIG. 118 the web 307*a* is the depth of the rim 36*r* and the depth of the first leg 129*a* of the hook receiver 129 is long enough to extend to the bottom edge of the triangular shaped hole 36*t* on the exterior side. In the plan view shown in FIG. 29 the web 307*a* is the depth of the rim 36*r* of the triangular shaped hole 36*t*. The elevation view in FIG. 28 shows a downward extending flange 307*b* from the web extending beyond the bottom edge of the deepest point of the triangular shaped hole 36*t*. The W-shaped clip 307 can rest directly on the rim 36*r* or can be longer in order to form a notch 126 at the bottom edge of the flange 307*b*. The first triangular shaped hole 36*t* near the base of the metal framing shows a W-shaped clip also having a flange 307*b* extending upward from the web 307*a*, however the triangular shaped hole 36*t* is smaller at that side and the upward oriented flange 307*b* is not very long as shown in the photograph of FIG. 40. Since the triangular shaped hole 36*t* has such an irregular shape the first leg 129*a* of the receiver is very long in order to get support from the web 42*a*, therefore requiring the third leg 129*c* to be long to form the gap 45 and the second leg 129*b* as previously described. Since the rims 36*r* penetrate into the interior side a substantial distance it becomes difficult to support the hook tongue 128 into the hook receiver 129. As previously described the third leg and the first leg could be fastened together to form a stop so the hook tongue 128 does not slide out of the gap 45 off the hook receiver 129. Another method to keep the hook tongue 128 from sliding out of the hook receiver 129 is to have the side edges of the first leg 129*a* or the third leg 129*c* have a hook end stop 129*s* where the side edge are bent outward past the gap 45 to form a stop for the hook tongue 128 from moving. FIG. 40 shows a perspective view of the web 42*a* of a vertical support member having a triangular shape hole 36*t* with a W-shape clip 307 with the hook receiver 129 extending over the triangular shape hole 36*t*. FIG. 41 shows a perspective view of the interior side of the vertical support member shown as a C channel with the web 42*a*, lips 42*c* and flanges 42*b* with a triangular shape hole 36*t* with its projecting rims 36*r* at the web 42*a* with a W-shape clip 307 with it flanges 307*b* and the hook receiver 129 extending over the rim 36*r* of the triangular shape hole 36*t*.

Figure 30:
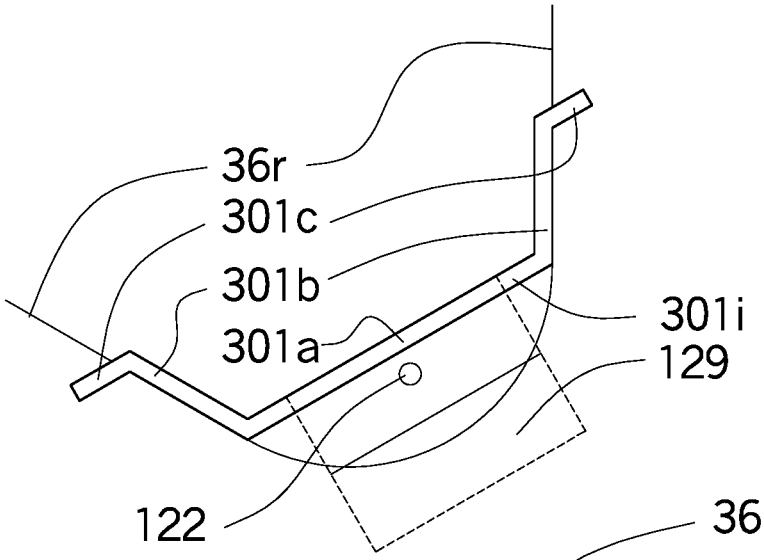
FIG. 30-32 show three different spacer brace configurations passing through the triangular shaped hole shown in FIG. 3.
Figure 31:
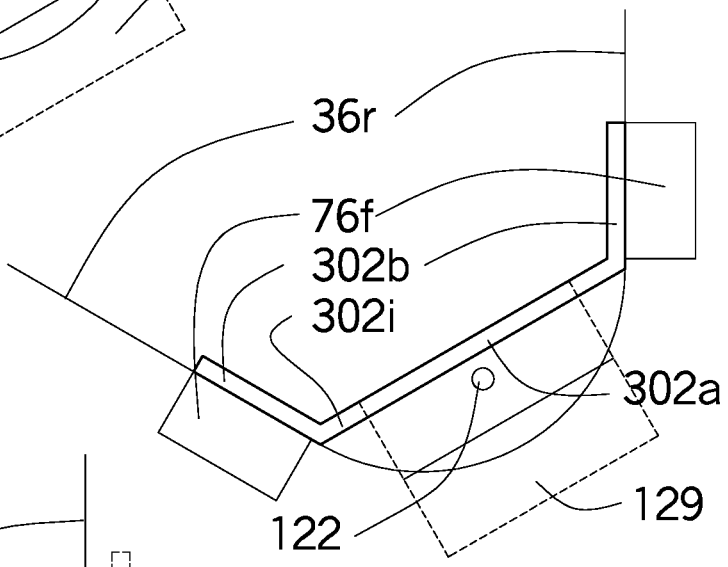
Figure 32:
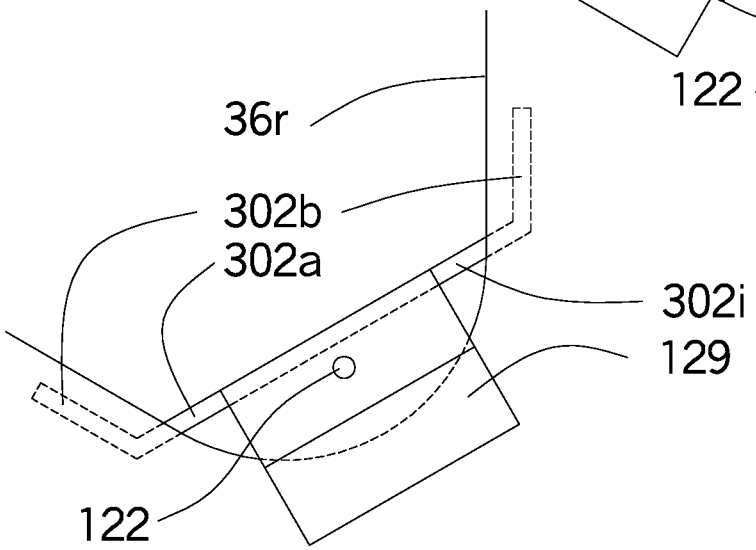

FIGS. 30-32 show three different spacer braces being connected at a triangular shape holes 36*t* (not shown with the rims 36*r*) shown in FIG. 3 in the web 42*a* of a C channel 42. The reverse lip spacer brace 301 in FIG. 30 shows the exterior side at an angle so the web 301 *a* and sides 301 *b* can fit through the triangular shape hole 36*t*, however the lips 301 *c* act as a flap 76 as shown in FIG. 31 where the flaps 76 abuts the web 42*a*. The flaps 76 or the ends of the lips 301 *c* abut the web 42*a* on one side of the web 42*a* and the web 301 *a* of the reverse lip spacer brace 301 has an indentation 301 *i* and then an hole extension 301 *he* (not shown in this view, but required when extending through a hole 36) so the hook receiver 129 can extend over to the opposite side of the web 42*a* and the interior side of the hook tongue 128 can abut the web 42*a* and fastened by a screw 122 into the web 42*a*. FIG. 31 shows the web 302*a* and the flanges 302*b* extending through the triangular shape hole 36*t* and flaps 76 that extend away the angular oriented flanges 302*b*. The flaps 76 are rectilinear in shape and are perpendicular to the flanges 302*b*. FIG. 32 shows an elevation of the U shaped spacer brace 302 where the hook receiver 129 is fastened with screws 122 on the viewers side of the web 42*a*, the holed extension 302*he* is the thickness of web 42*a* of the support member and the indentation 302*i*, web 302*a* and the flanges 302*b* is on the opposite side of the web 42*a*. Some spacer braces are attached to the web 42*a* or by the hook finger 127 or the U shaped hook receiver 129 when installed in tandem.

Figure 33:
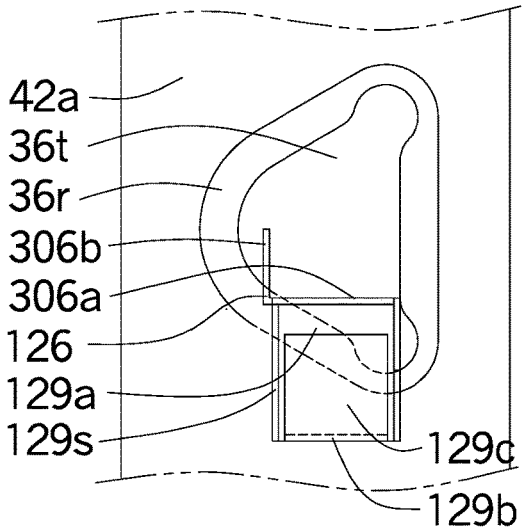
FIG. 33 shows an elevation of the support member at the web with its triangular shaped hole having a J-shaped spacer brace where the web and the upward oriented flange have notches engaging the angular band at the hole in the support member and the downward oriented flange having a notch at its lower edge that engages another edge of the triangular hole.
Figure 34:
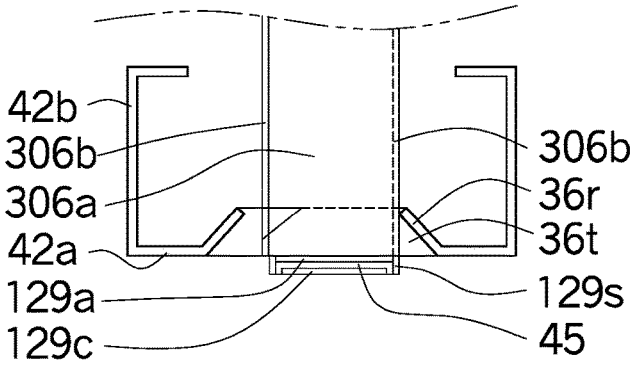
FIG. 34 shows a plan view of the L-shaped spacer brace passing through the triangular hole as shown in FIG. 33.
Figure 35:
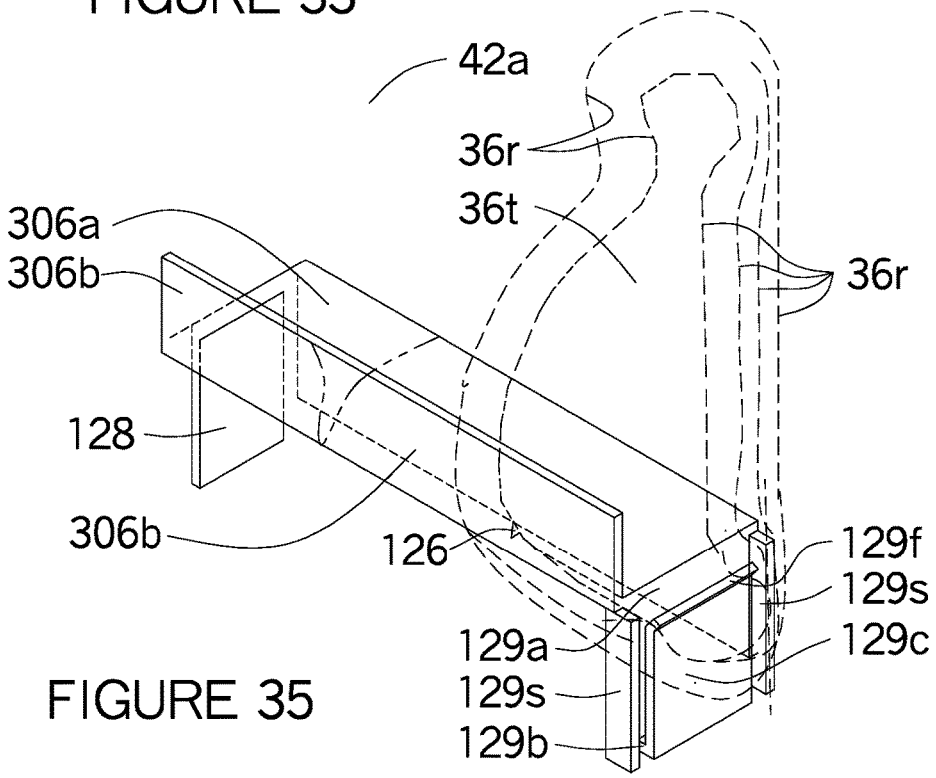
FIG. 35 shows an isometric of the L-shaped spacer brace passing through the triangular shaped hole as described in FIGS. 33-34.

FIGS. 33-35 shows a horizontally oriented J shaped spacer brace 306 in elevation in FIG. 33 with a plan view in FIG. 34 and a isometric view in FIG. 35. The J shaped spacer brace 306 shows the web 306*a* intersecting the triangular shape hole 36*t* with one side of the web 306*a* resting on the rim 36*r* and the opposite side of the web 306*a* abutting the vertical edge of the rim 36*r* with one flange 306*b* extending downward resting on the lower edge of the rim 36*r*. The left side of the web 306*a* can rest directly on the rim 36*r* or the rim 36*r* can have a rim notch 126*rm* for the web 306*a* to rest upon and another flange 306*b* extending upward for additional strength. Since the J shaped spacer brace 306 does not have flanges 306*b* that extend on both sides a hook receiver 129 to keep the hook tongue 128 from sliding out of the hook receiver 129, side edges between the first leg 129*a* or the third leg 129*c* have a hook end stop 129*s* where the side edge are bent outward past the gap 45 to form the end stop 129*s* for the hook tongue 128 from moving.

Figure 36:
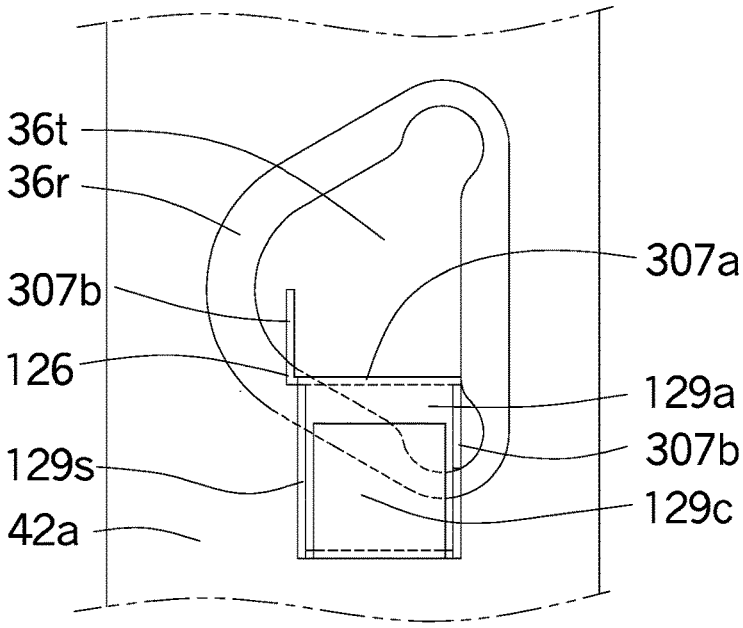
FIG. 36 shows an elevation of the triangular shaped hole with a hook clip having a combination J-shaped at the throat and the U-shape hook receiver on both sides of the web of the support member.
Figure 37:
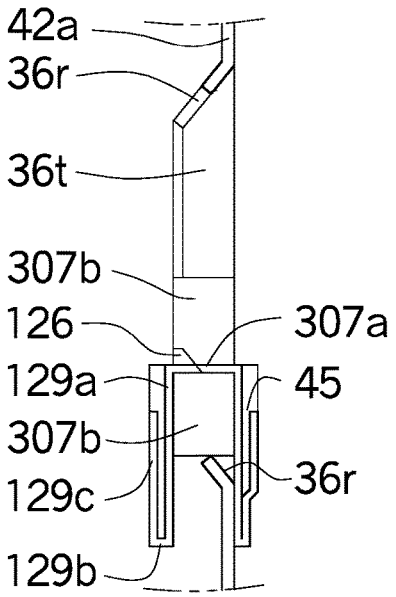
FIG. 37 shows a section through the triangular shaped hole with the notches shown on the upper and lower flanges and web.
Figure 38:
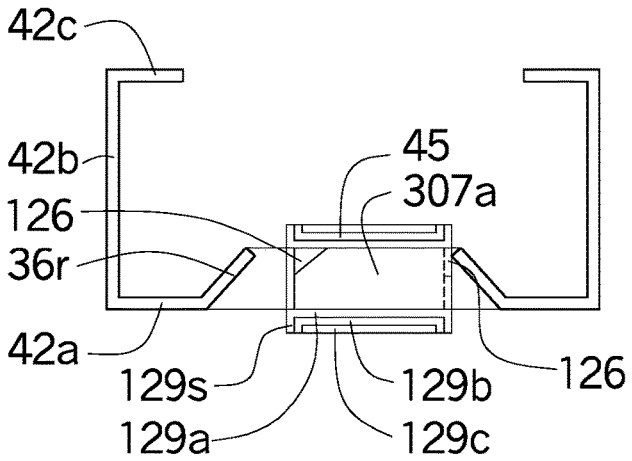
FIG. 38 shows a plan view of the hook clip showing the location of the notches engaging the angular band of the hole in the support member.
Figure 39:
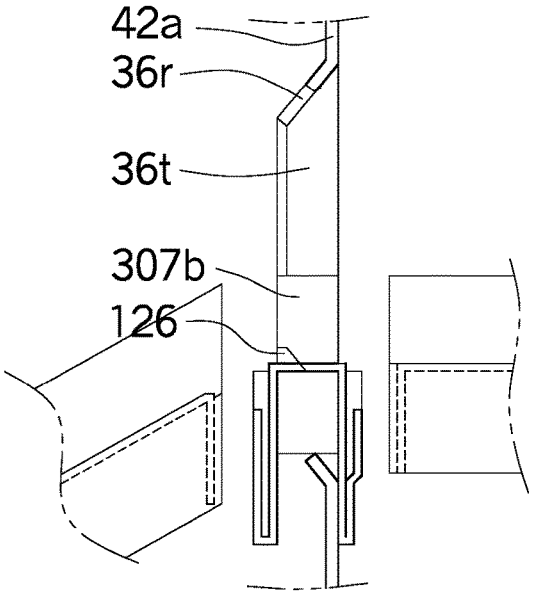
FIG. 39 shows the same section as FIG. 37, however two spacer braces with the tongue sides are about ready to be installed into the hook clip described in FIGS. 36-38.

FIGS. 36-39 shows a horizontally oriented W-shaped clip 307 inserted into a triangular shaped hole 36*t* having rims 36*r* extending inward on the interior side of the C channel 42 on the side where the flanges 42*b* and lips 42*c* are located. FIG. 36 shows the W-shape clip 307 at the triangular shape hole 36*t* similar to the J shaped spacer brace 306 shown in FIGS. 33-35. A plan view is shown in FIG. 38 while FIG. 37 and FIG. 39 show the W-shaped clip 307 in section with FIG. 39 showing the hook tongues 128 of the J shaped spacer brace 306 intersecting the W-shaped clip 307 horizontally and diagonally into the hook receivers 129 at both ends of the W-shape clip 307.

FIGS. 36-41 shows a horizontally oriented W-shaped clip 307 inserted into a triangular shaped hole 36*t* having rims 36*r* extending inward on the interior side of the C channel 42 on the side where the flanges 42*b* and lips 42*c* are located. Some metal stud manufactures like to add rims to the edges of the holes to add strength and when doing so the rims 36*r* are usually at an angle and have a depth. When describing the W-shape clip 307 the web 307*a* spans the thickness or depth of the rim 36*r* of the triangular shape hole 36*t* and each side of the W-shape clip 307 has a hook receiver 129 extending from the each side of the web 307*a*. The first leg 129*a* on the exterior side of the web 42*a* is longer in length due to shape of the triangular hole 36*t* that is the first leg 129*a* extends over the bottom edge of the triangular hole 36*t* to give the W-shape clip 307 additional strength. The W-shape clip 307 has a flange 307*b* that extends internally and parallel to the vertical edge of the rim 36*r* and extends downward until the bottom edge rest on the bottom edge of the rim 36*t*. The internally extending flange 307*b* give the W-shape clip 307 stability since the bottom edge and the exterior side of the flange 307*b* rest against the rim 36*r* or can rest on a notch 126 cut at the rim 36*r* as shown in the cross section of the hole 36*t* in FIGS. 37 & 39. An end stop 129*s* is shown at the side edges of the first leg 129*a* of the hook receiver 129 which is required to keep the hook tongue 128 from sliding horizontally in the gap 45 between the first leg 129*a* and 129*c* as also previously explained in other figures. The end stops 129*s* could extend from the web 307*a* or from the first leg 129*a*. In FIGS. 37 & 39 one side of the hook receiver 129 shows the first leg 129*a* and third leg 129*c* pressed together should a fastener (not shown) be structurally required to secure the W-shape clip 307. FIGS. 36 & 38 also show another flange 307*b* extending dorsally above the W-shape clip for additional strength or stability if so required. FIG. 40 shows a perspective drawing the web 42*a* of a vertical support member having a triangular shape hole 36*t* with a W-shape clip 307 with the hook receiver 129 extending over the triangular shape hole 36*t*. FIG. 41 shows a perspective drawing of the interior side of the vertical support member shown as a C channel with the web 42*a*, lips 42*c* and flanges 42*b* with a triangular shape hole 36*t* with its projecting rims 36*r* at the web 42*a* with a W-shape clip 307 with it flanges 307*b* and the hook receiver 129 extending over the rim 36*r* of the triangular shape hole 36*t*.

Figure 42:
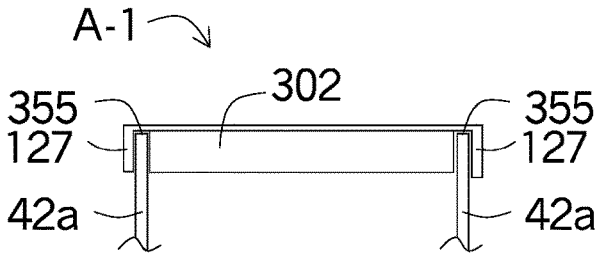
FIG. 42 shows a schematic view of a construction assembly using spacer braces spanning between two support members having the anchor space between the hook finger end and the flanges engage the support member.

FIG. 42 shows a schematic view of a construction assembly A-1 comprising a U shaped spacer brace 302 spanning between the web 42*a* of two support members having the anchor spaces 355 on both ends engage the interior side of the hook finger 127 ends on the left side and the side edges of the flanges 302*b* engage the interior sides of the U shaped spacer brace 302 at the support member on the left side. The right side shows the reverse of the left side where the flanges 203*b* have the side edges of the U shaped spacer brace 302 engage the left side edge of the web 42*a* with the extension 302*e* (many different types of extensions are mentioned in the specifications) having its interior side being the anchor space 355 for the extension 302*e* to engage the support member and the interior side of the hook finger 127 engage the right side edge of the right web 42*a*.

Figure 43:
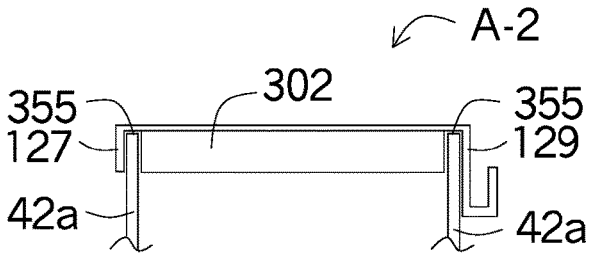
FIG. 43 shows an schematic view of a construction assembly using spacer braces spanning between two support members have a hook finger on the left end with a hook receiver end on the right side end.

FIG. 43 shows an schematic view of a construction assembly A-2 comprising a U shaped spacer brace 302 spanning between two support members where the left end of the U shaped spacer brace 302 has the interior side of a hook finger 127 engage the left side of the web 42*a* with the anchor space 355 resting on the support member with the flanges 302*b* engaging the opposite side of the web 42*a* while the right side of the U shaped spacer brace 302 has the flanges 302*b* engaging the left side of the web 42*a* with the interior side of the hook receiver 129 engaging the right side of the web 42*a*.

Figure 44:
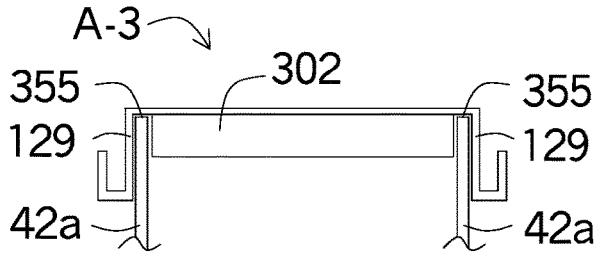
FIG. 44 shows an schematic view of a construction assembly using spacer braces spanning between two support members have a hook finger on the left end with a hook receiver end on the right side end.

FIG. 44 shows an schematic view of a construction assembly A-3 comprising a U shaped spacer brace 302 spanning between two support members have a hook receiver 129 on the left end with a hook receiver 129 end on the right side end. The U shaped spacer brace 302 is secured to the web 42*a* where the interior side of the hook receivers 129 has the side edges of the flanges 302*b* between the web 42*a* with the interior side of the anchor space 355 engaging the top edge of the web 42*a*.

FIG. 45 shows an schematic view of a construction assembly A-4 comprising a U shaped spacer brace 302 spanning between two support members having the interior side of the anchor space 355 of a W-shaped clip 307 engage the top edge of the support member with the hook receiver 129 on the right side end engaging the hooked tongue 128 of the U shaped spacer brace 302 and the right support member engage the side edges of the flanges 302*b* on the left side of the web 42*a* and the interior side of the hook receiver 129 end engaging the right side of the web 42*a*.

FIG. 46 shows an schematic view of a construction assembly A-5 comprising a U shaped spacer brace 302 spanning between two support members having the anchor space 355 of a W-shaped clip 307 engage the support member with the hook receiver 129 on the right side end engaging the hooked tongue 128 of the U shaped spacer brace 302 with a hook tongue 128 end on the right side end engaging the hook receiver 129 of on the left side of the W-clip 307 with its anchor space 355 engaging the support member.

FIG. 47 shows an schematic view of a construction assembly A-6 comprising a U shaped spacer brace 302 spanning between two support members having the anchor space 355 of a U-shaped clip 308 engage the support member with the hook receiver 129 on the right side end engaging the hook tongue 128 of the U shaped spacer brace 302 with the opposite end of the U shaped spacer brace 302 also having a hook tongue 128 that engages the hook receiver 129 of the U-shaped clip 308 where the anchor space 355 has a hook finger 127 engaged on the opposite side of the support member.

Figure 48:
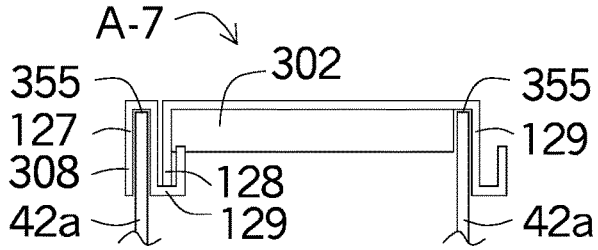
FIG. 48 shows an schematic view of a construction assembly using spacer braces spanning between two support members having the anchor space of a U-clip engage the support member with the hook receiver on the right side end engaging the hooked tongue of the spacer brace with the spacer brace extension passing over the support member where the anchor spacer is between the flanges and the hook receiver extending over the right side of the support member.

FIG. 48 shows an schematic view of a construction assembly A-7 comprising a U shaped spacer brace 302 spanning between two support members having the anchor space 355 of a U-shaped clip 308 engage the support member with the hook receiver 129 on the right side end engaging the hooked tongue 128 of the U shaped spacer brace 302 with the opposite end of the U shaped spacer brace 302 having the ends of flanges 302*b* abut the support member with its anchor space 355 and the interior side of the hook receiver 129 abutting the opposite side of the web 42*a*.

Figure 49:
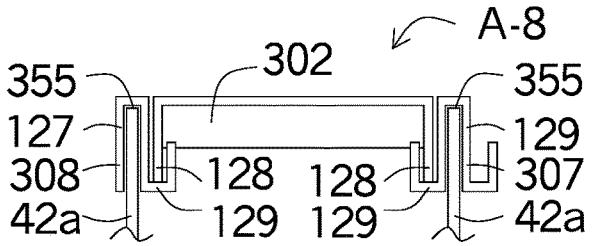
FIG. 49 shows an schematic view of a construction assembly using spacer braces spanning between two support members having the anchor space of a U-shaped clip engage the support member with the hook receiver on the right side end engaging the hooked tongue of the spacer brace and the right side of the spacer brace has a hook tongue that engages the left side of a hook receiver or a W-clip where the anchor space engages the support member.

FIG. 49 shows an schematic view of a construction assembly A-8 comprising a U shaped spacer brace 302 spanning between two support members having the anchor space 355 of a U-shaped clip 308 engage the support member with the hook receiver 129 on the right side end engaging the hook tongue 128 of the U shaped spacer brace 302 and the right side of the U shaped spacer brace 302 has a hook tongue 128 that engages the left side of a hook receiver 129 or a W-clip 307 where the anchor space 355 engages the support member.

Figure 50:
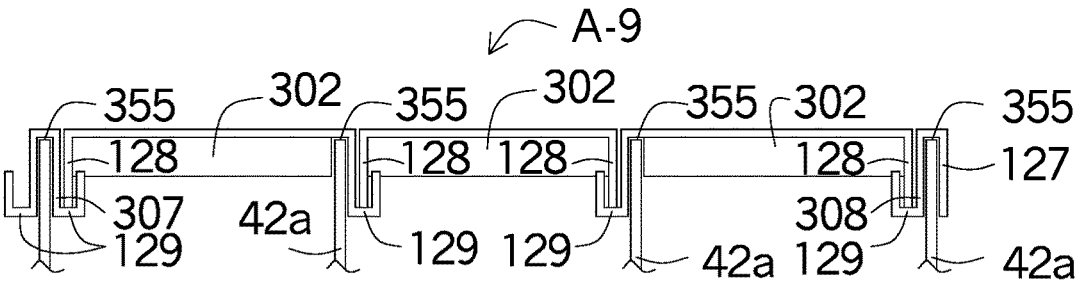
FIG. 50 shows a schematic view of a construction assembly using the middle spacer brace having a hook tongue at each end and connected to adjacent spacer braces where the hook receivers extends over the support member on both the left and right sides and the side edges of the flanges on the first and third spacer braces engage the opposite sides of the web of the support members.

FIG. 50 shows a schematic view of a construction assembly A-9 comprising the middle U shaped spacer brace 302 having a hook tongue 128 at each end and connected to the adjacent U shaped spacer braces 302 where the hook receivers 129 extends over the web 42*a* of the support member on both the left and right sides and the side edges of the flanges 302*b* on the first and third U shaped spacer braces 302 engage the opposite sides of the web 42*a* of the support members.

Figure 51:
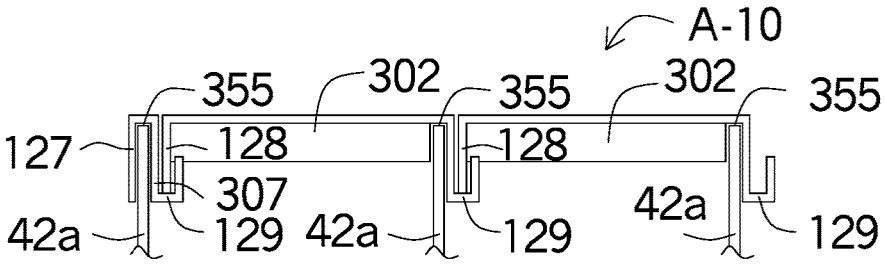
FIG. 51 shows a schematic view of a construction assembly using two adjoining spacer braces where each spacer brace has a hook tongue end on one side and a hooked receiver on the opposite end and connected to the support members having the ends of the flanges abut one side of the web and the interior side of the hook receiver abut the opposite side of the web being connected by the anchor space of the extension at the web.

FIG. 51 shows a schematic view of a construction assembly A-10 comprising two adjoining U shaped spacer braces 302 where each U shaped spacer brace 302 has a hook tongue 128 end on one side and a hooked receiver 129 on the opposite end and connected to the support members having the ends of the flanges 302*b* abut one side of the web 302*a* and the interior side of the hook receiver 129 abut the opposite side of the web 42*a* being connected by the anchor space 355 of the extension 302*e* at the web 42*a*.

Figure 52:
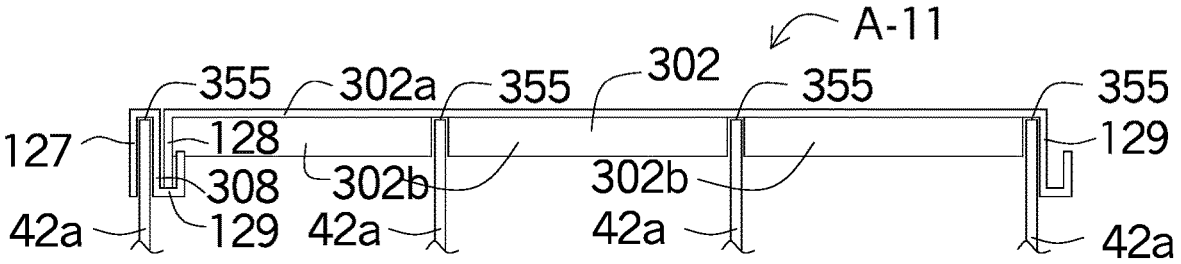
FIG. 52 shows a schematic view of a construction assembly using combination of spacer braces spanning over two support members where the left side is connected to the hook receiver of a U-shaped clip and the right side is has the ends of the flanges abut the one side of the web and the interior side of the hook receiver abuts the opposite side of the hook receiver end.

FIG. 52 shows a schematic view of a construction assembly A-11 comprising a U shaped spacer brace 302 spanning over two support members where the left side is connected to the hook receiver 129 of a U-shaped clip 308 and the right side is has the ends of the flanges 302*b* abut the one side of the web 42*a* and the interior side of the hook receiver 129 abuts the opposite side of the hook receiver 129 end and the intermediate connections at the support members have the end of the flanges 302*b* abut both sides of the support member at the anchor space 355 of the web 302*a*.

Figure 53:
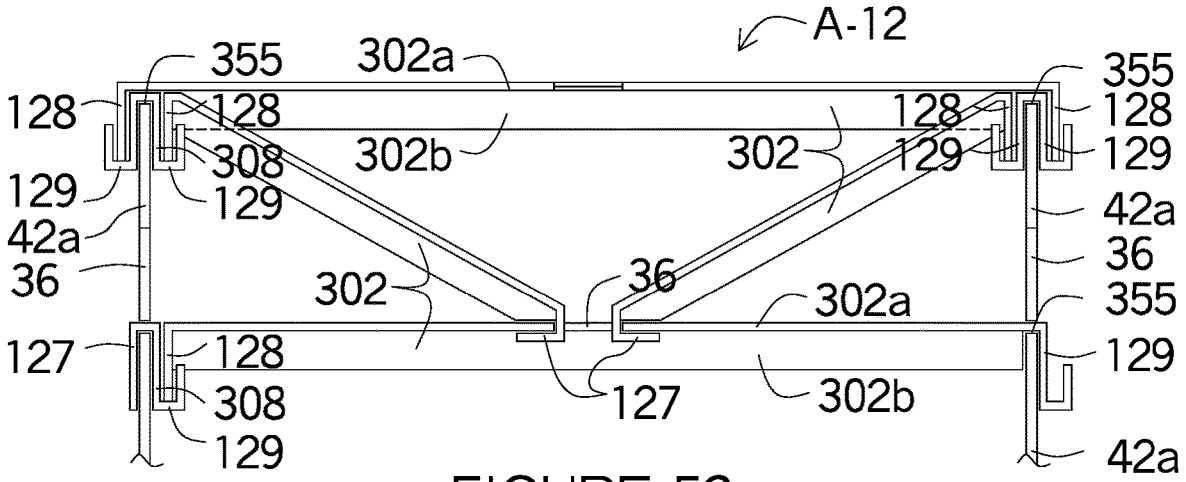
FIG. 53 shows a schematic view of one of many possible combinations of a spacer brace assembly where a truss joist is formed using horizontal and diagonal spaces braces between support members.

FIG. 53 shows a schematic view of a construction assembly A-12 comprising a one of many possible combinations of U shaped spacer braces 302 assembly where a truss joist 402 is formed using horizontal and diagonal spaces braces between support members. This truss joist 402 has a U-shaped clip 308 with the hook receiver 129 protruding from the interior side of the support member where the hook receiver 129 end at the lower chord has a hook tongue 128 and the opposite end of the U shaped spacer brace 302 has the end of the flanges 302*b* abut the web 42*a* of the support member with the hook receiver 129 extend past the web 42*a*. The lower chord has a hole 36 at the web 302*a* where the hook finger 127 is attached to the interior side of the web 302*a* of the U shaped spacer brace 302. The upper chord of the truss joist 402 is formed by another U shaped spacer brace 302 where each end has a hook tongue 128 and is engaged into the outer most side hooked receiver 129 of the W-shaped clip 307 and the opposite sides of the W-clip 307 has a hook receiver 129 where the opposite end of the diagonal oriented U shaped spacer brace 302 is inserted into the hooked receivers 129. The horizontal U shaped spacer 302 has a wider web 302*a* so the diagonally oriented U shaped spacer brace 302 can be connected to the hooked receiver 129 of the W-shaped clip 307 at the upper horizontal chord.

Figure 54:
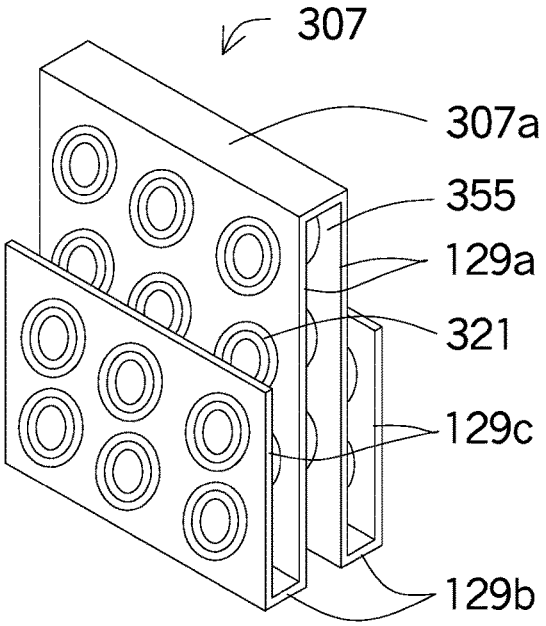
FIG. 54 shows an isometric view of a W-shaped clip having dimples protrude from the first and third legs of the hooked receiver.
Figure 55:
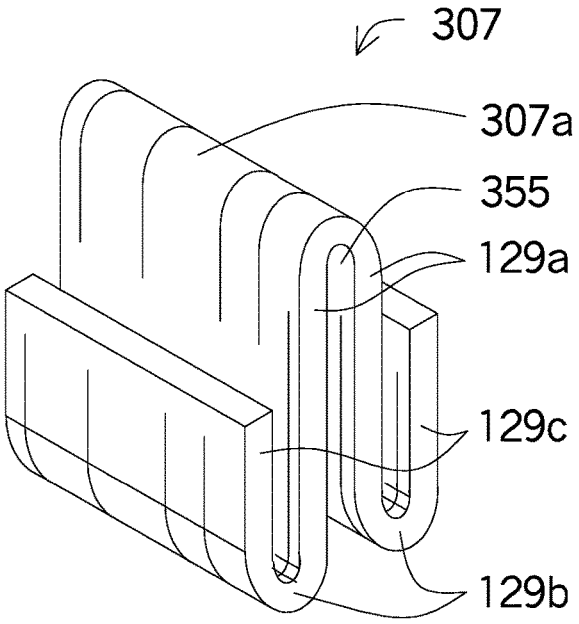
FIG. 55 shows an isometric view of a W-shaped clip have rounded edges at the web of the W-shaped clip and the second leg of the hooked receiver.
Figure 56:
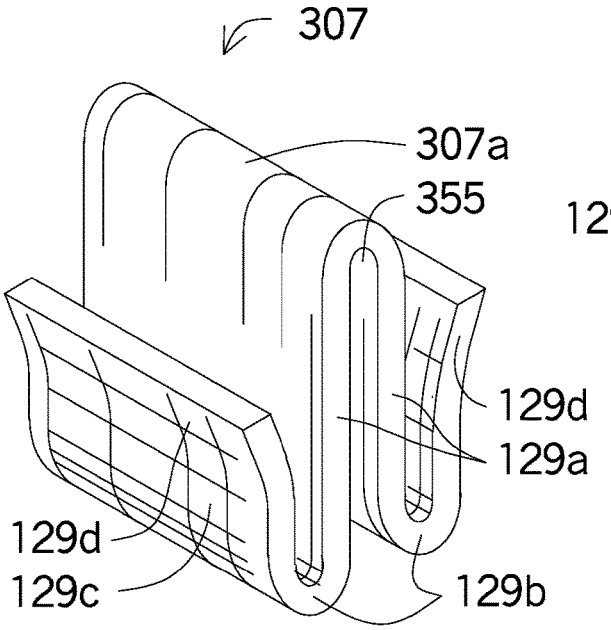
FIG. 56 shows a similar view of a W-shaped clip in FIG. 55 except here are flared end at the third legs of the hooked receiver.
Figure 57:
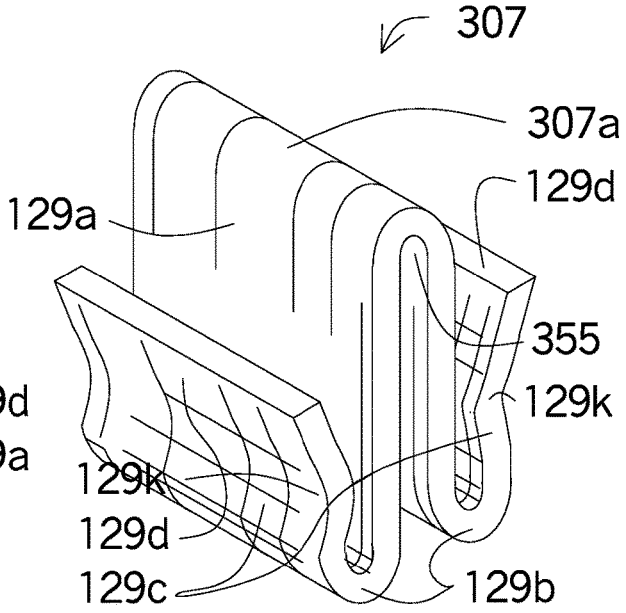
FIG. 57 shows a similar view of a W-shaped clip in FIG. 56 except here the third leg of the hooked receiver has an indentation compressing the first and third legs closer together.
Figure 58:
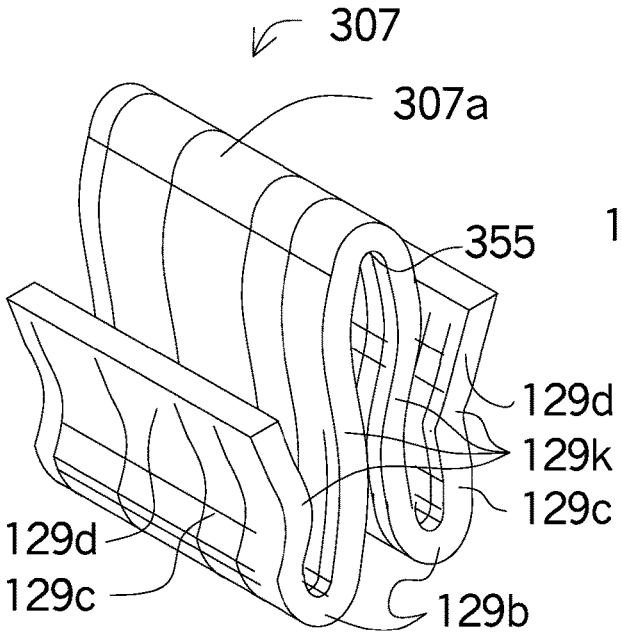
FIG. 58 shows a similar view of a W-shape clip in FIG. 57 except here the first leg of both hooked receiver have an indentation compressing the both first legs closer together.
Figure 59:
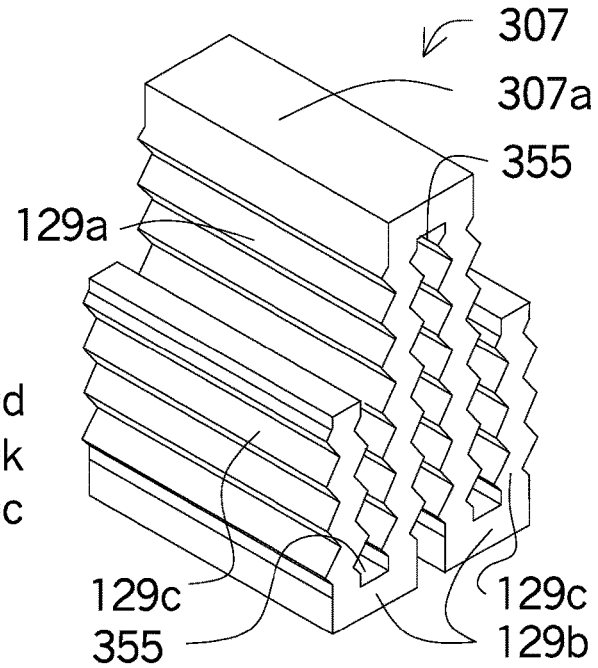
FIG. 59 shows an isometric view of the W-shaped clip in FIG. 54 without the dimples however here horizontal ridges form an abrasive planar surface connections.
Figure 60:
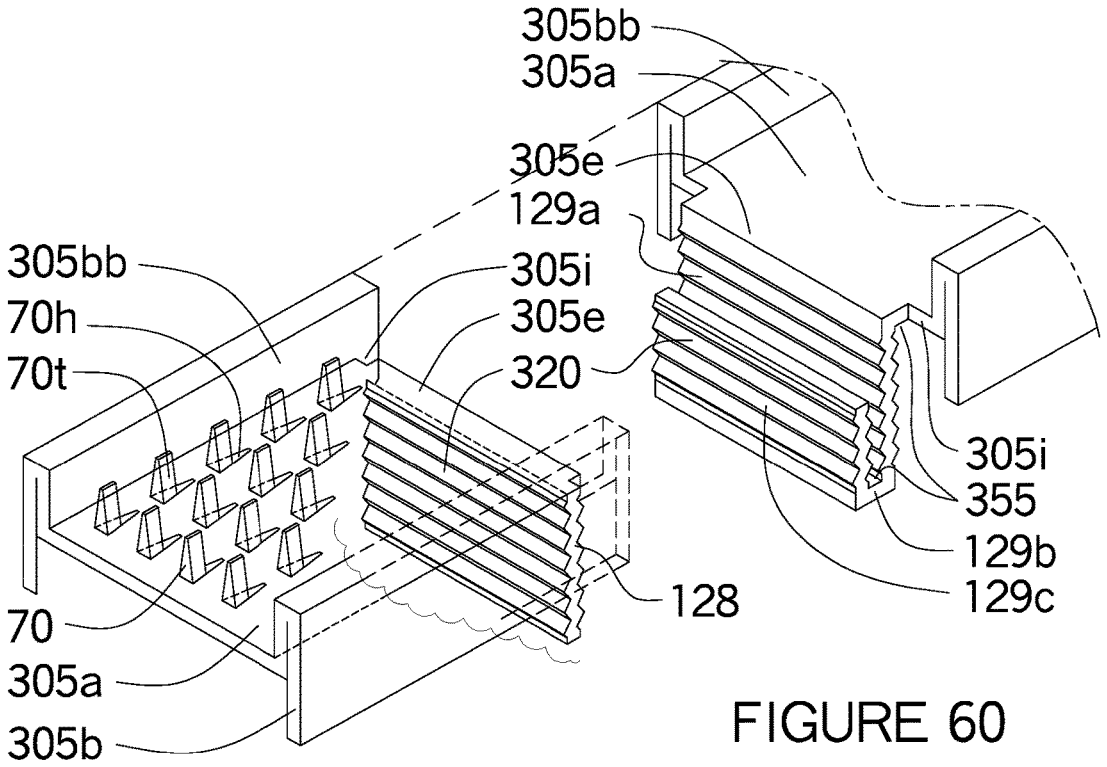
FIG. 60 shows an isometric view of an I shaped spacer brace having horizontal ridges in the hook receiver end and the adjacent I shaped spacer brace having horizontal ridges in the hook tongue along with punch out teeth extending from the web.

FIGS. 54-59 show different configurations or characteristics of the W-shaped clip 307 that will allow the W-shaped clip to have a tighter fit to the web 42*a* not shown in any of the figures. FIG. 54 is a similar U shaped spacer brace 307 having hooked receivers 129 on both sides with a first leg 129*a* extending downward from the web 307*a* having an outward second leg 129*b* and extending again upward forming a third leg 129*c* with a gap 45 between the first and third legs 129*a* & 129*c*. Dimples 321 are shown as one of many types of an abrasive planar surface showing a fixation connection which protrudes inward and outward in the gap 45 and inward between the first legs 129*a*. Other types of abrasive planar surfaces could be the shape of the connection, ridges, grooves, abrasive surface, however could also be a smooth surface. The fixation connection could be affected by the material used and whether the W-shape clip 307 is flexible enough to retain its shape after being moved. FIG. 55 shows a more curvilinear configuration of a fluid shape W-shaped clip 307 where the hook receivers 129 have a curved configuration between the web 307*a* and the first legs 129*a* and a curved configuration between the end of the first legs 129*a* through the second leg 129*b* to the start of the thirds leg 129*c*. FIG. 56 shows the same configuration as FIG. 55 except a flare 129*d* is shown at the end of the third leg 129*c*. FIG. 57 look similar to FIG. 56 except a kink 129*k* or indentation is shown on the interior side of the gap 45 between the first leg 129*a* and the third leg 129 so the kink 129*k* in the third leg 129*c* is tight to the first leg 129*a*. FIG. 58 is similar to FIG. 57, however here the W-shaped clip has a more fluid curvilinear configuration along with a double kink 129*k* where the first leg 129*a* of each receiver 129 are close to one another forming a tight connection between both sides of the web 42*a* (not shown) and again the same kink 129*k* between the first leg 129*a* and the third leg 129*c*. FIG. 59 shows the W-shaped clip having ridges 130*a* the first and third legs 129*a* & 129*c* to increase the resistance by having more abrasive planar surfaces. FIG. 60 shows the hook receiver 120 with the ridges 130 attached to the end of the I-shaped spacer brace 305. At the left side of FIG. 60, another I-shaped spacer brace 305 is shown with the opposing end having the hook tongue 128 also shown having ridges 130. When the hooked tongue 128 is inserted into the gap 45 of the hook receiver 129 the ridges 130 will interlock between each other to increase a vertical resistance force that could separate the hook tongue 128 from the hook receiver 129. The hook receivers shown in FIGS. 55-59 with the dimples 321, ridges 130, kinks 129*k* or curvilinear configurations al contribute to adding resistance between the hook tongue and hook receivers and any of the hook receivers can be added as a hook receiver at the end of the any spacer brace. The hook tongue acts as a restraining plate that rest on the anchor space 355 at the interior of the gap 45 on the second leg 129*b*. The dimples 321, ridges 130, kinks 129*a* and the curvilinear shape of the hook tongue 128 interlocks with the hook receiver to increase the resistance between each other. The left side of FIG. 60 shows the tongue side of the I-shaped spacer brace 305 with punched hole teeth 70 extending upward from the web 305*a*. The teeth 70*t* extend upward from the punch hole 70*h* which forms a very abrasive surface connection to have insulation installed between metal framing from coming loose. In addition, the hook receiver 129 at the I shaped spacer brace 305 shows an extension 305*e* over the anchor space 355, however the extension 305*e* could extend over any hole, web or other previously describe anchor space 355. In order to have the flanges 305*b* abut the support member, the web 305*a* has an extension 305*e* that spans across the third leg 129*c* of the hook receiver 129 allowing the hook tongue 128 with its abrasive planar surface to extend into the gap 45 of the hook receiver 129.

Figure 61:
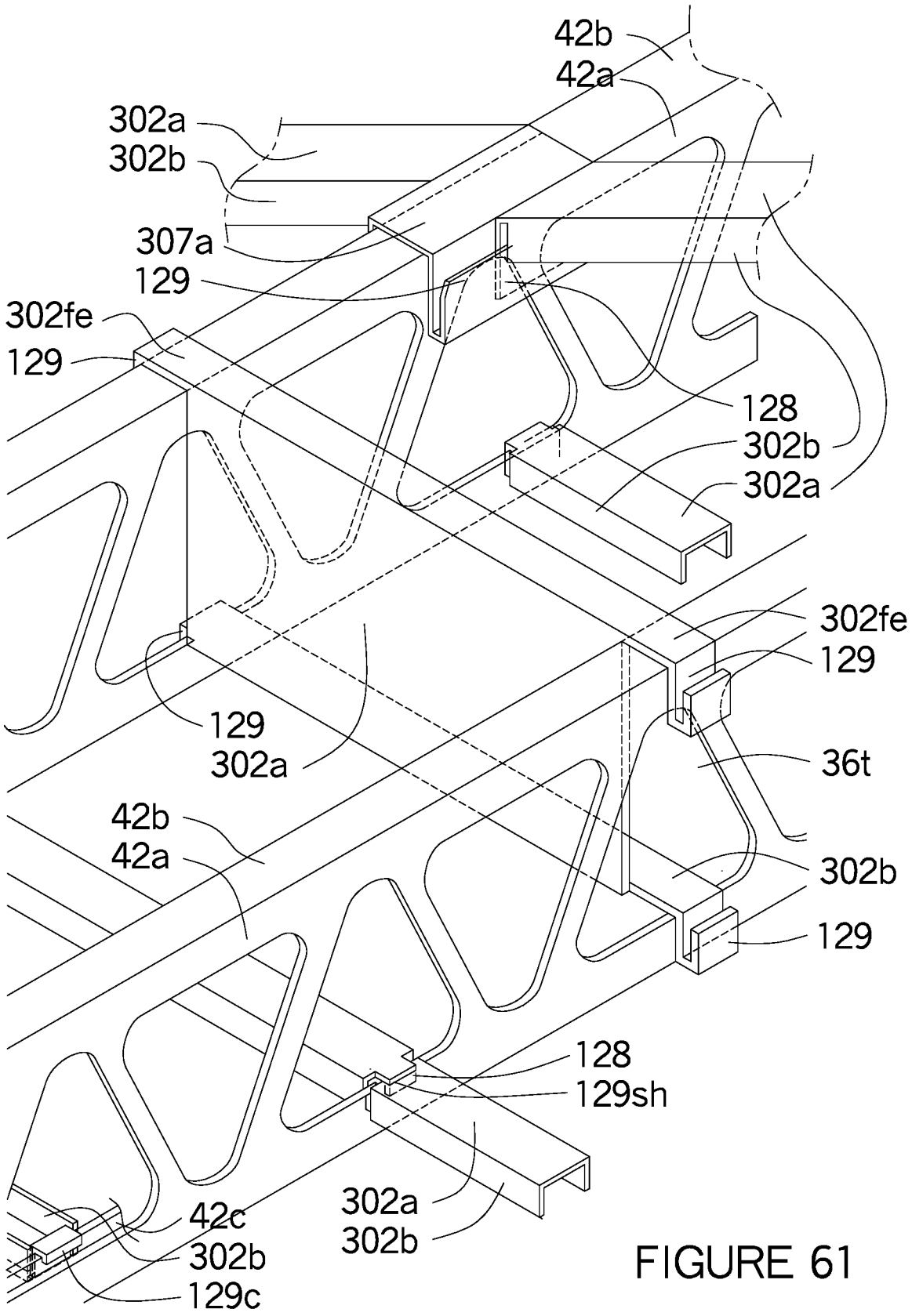
FIG. 61 shows an isometric view of horizontal oriented support member having triangular holes showing a U shaped spacer brace connected to a W-shaped clip along with a vertically oriented spacer brace having the tab of the punch out holes secured to the ledge of the triangular shaped hole and a U shaped spacer brace having the hooked tongue inserted into the slotted hole in the web and another U shaped spacer brace connected to the lip of a horizontal C channel.

FIG. 61 an isometric view of floor or ceiling joists shown as horizontally oriented support members shown as C channels 42 having triangular shapes holes 36*t* and connected together by using U shaped spacer braces 302 having a web with two extending flanges. The bottom left side shows a U shaped spacer brace 302 with its ventral side facing upward with the third leg 129*c* of the hook receiver 129 extend over the lip 42*c* so the dorsal side is face down making an easy connection to the top plate or the top U shaped spacer brace 302 of a metal framed wall (not shown here but previously shown at the wall section in FIG. 27. The adjacent U shaped spacer braces 302 is shown connected to an another U shaped spacer brace 302 in tandem with the hook tongue 128 being installed into the slot hole receiver 129*sh* in the web 302*a* of the adjacent U shaped spacer brace 302. A larger U shaped spacer brace 302 is oriented vertically where the height or web 302*a* of the U shaped spacer brace 302 is equal to the height or the web 42*a* of the support member. The flange 302*b* has a flange extension 302*fe* at the flange 42*b* of the support member, however the lower flange extension 302*fe* extends over the bottom edge of the triangular shape hole 36*t*. At the top of the isometric drawing shows a W-shaped clip 307 where the web 307*a* extends over the web 42*a* of the support member. The W-shaped clip is slightly longer as two horizontally oriented U shaped spacer braces 302 are installed horizontally but are oriented at a diagonal as to provide diagonal bracing between the horizontally arrayed support members shown as a C channel 42. The U shaped spacer braces 302 have hook tongue 128 ends that fit into the hook receiver 129 ends of the W-shape clip 307 which is also shown in FIG. 46.

Figure 62:
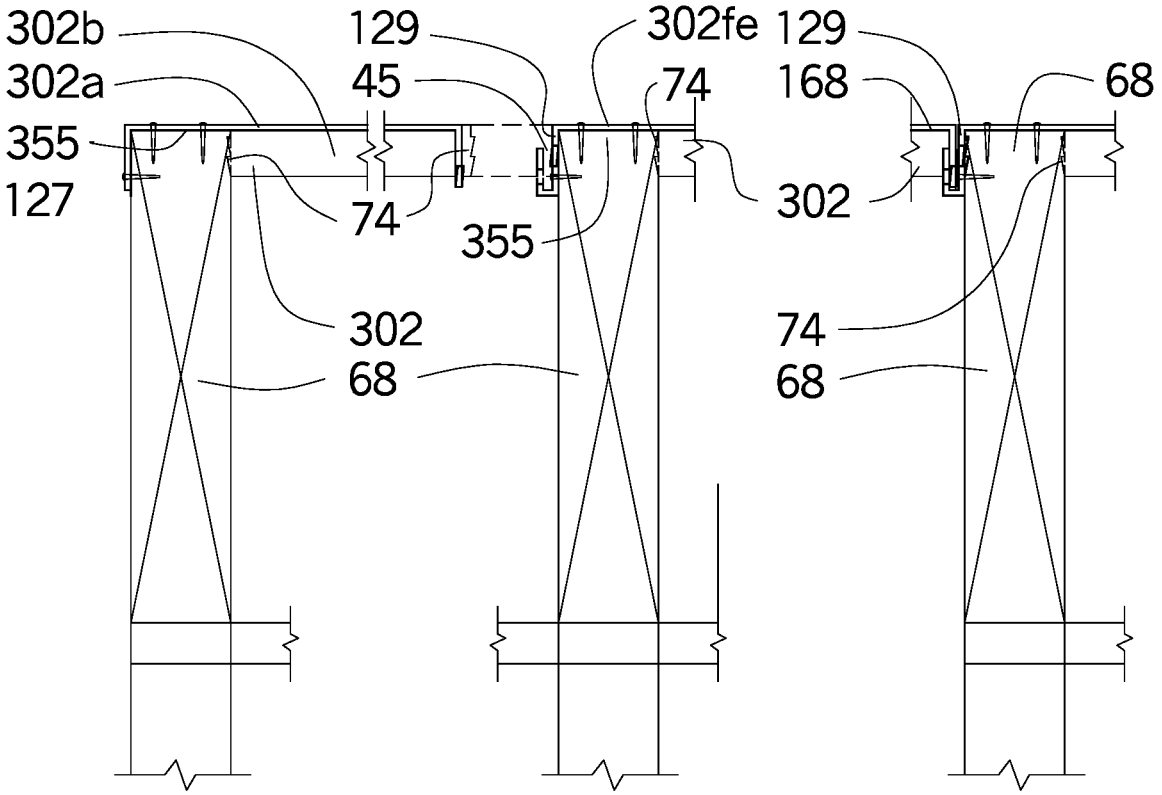
FIG. 62 shows three wood horizontal joists or the bottom chord of the truss joist in FIG. 78 where the top edge of the support member show the U-shaped hook receiver with the L-shaped hook tongue attached as well as an angular oriented spacer brace.

FIG. 62 shows three wood joists as wood framing members 68 (shown with light weight lines) where the top surface of the wood framing members 68 show a U-shaped spacer brace 302 (in section) being connected together. The exterior side is on the top side of the U-shaped spacer brace 302 and the sides 302*b* extend downwardly from the web 302*a*. The first engagement connection is where the edges of the sides 302*b* abut the wood framing member with the jagged edges 74. The second engagement connection is placing the flange extension 302*fe* over the horizontal edge of the width side 68*w* of the wood framing member 68 also referred to as the anchor space 355 with the hook receiver 129 being U-shaped. The third engagement connection is the installation of an adjacent spacer brace having a hook tongue 128 fitting into the air gap 45 of a hook receiver 129 shown on the top side of the right wood framing member 68. The right wood framing member 68 shows the second and third engagement connection attached to the width side 68*w* of the wood framing member 68 with the hook tongue 128 from an adjacent spacer brace attached into the hook receiver 129. The left wood framing member 68 shows the second engagement connection of the first U-shaped spacer brace 302 as a hook finger 127 installed over the wood framing member 68.

Figure 63:
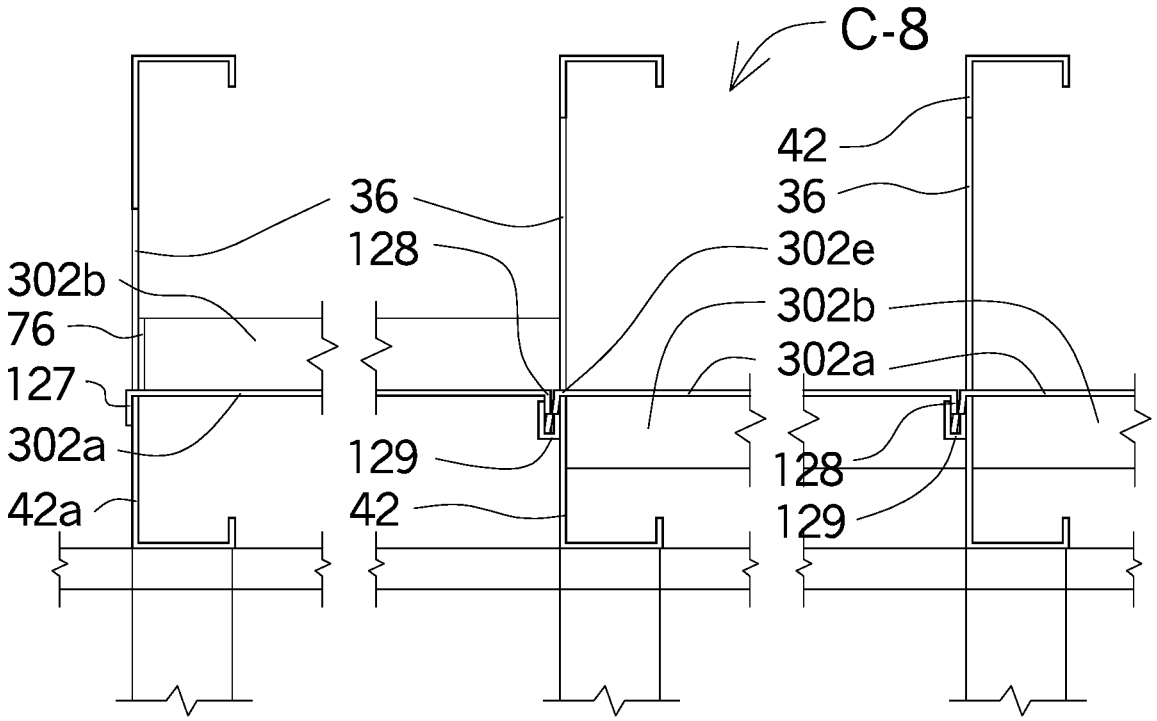
FIG. 63 shows three metal support members with the top edge of the support member showing the U-shaped hook tongue with the L-shaped hook tongue attached into the U-shape hook receiver. Two spacer braces are downward oriented and the left spacer brace is upward oriented, however the L-shape hook tongue of the upward oriented spacer brace fits into the U-shaped hook receiver of the downward oriented spacer brace.

FIG. 63 shows three horizontal support members as C shaped channels 42 having a vertical exterior as a web 42*a* with two horizontally extending flanges 42*b* and with lips 42*c*. The left C channel 42 shows a horizontally oriented U-shaped spacer brace 302 having the exterior on the bottom side where the web 42*a* is horizontal and the flanges 42*b* are extending upward. The web 302*a* has the hole extension 302*he* passing through the bottom edge of the hole 36 and the hook finger 127 extends downward over the web 42*a*. The middle U channel 42 shows the opposite end of the U-shape spacer brace 302 where the hook tongue 128 fits into the gap 45 from the hook receiver 129 being U-shaped that had passed through the hole 36 in the middle U-shaped spacer brace 302. The middle U-shaped spacer brace 302 has the exterior side on the top side and therefore the web 302 had the hole extension 302*he* and the hook receiver 129 being U-shaped connected to an upward oriented U-shape spacer brace 302. The isometric drawing in FIG. 61 showed a similar arrangement using the triangular shaped holes 36*t*.

Figure 64:
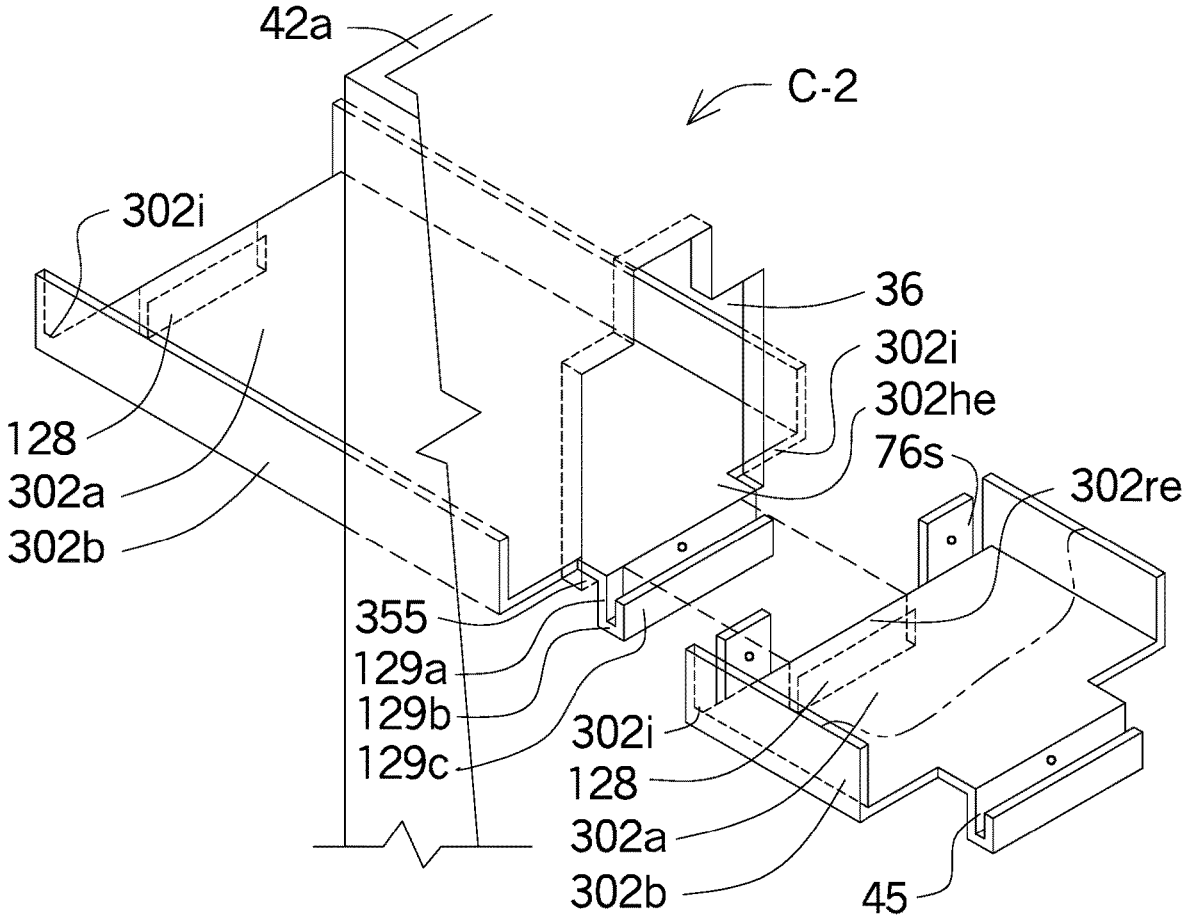
FIG. 64 shows a U-shaped spacer brace where the flanges extend upward from the web and the exterior is bent downward at the bottom edge of the hole with a receiver have a U-shape for a tongue to fit into.

FIG. 64 is similar to FIG. 4 where the U-shaped spacer brace 302 was oriented downward while in FIG. 64 the exterior is located on the bottom side where the web 302*a* has the flanges 302*b* extending upward from the web 302*a*. Both ends of the elongated U shaped spacer brace 302 has an indentation 302*i* at the flanges 302*b* and web 302*a* having the side edges of the flanges 302*b* and a portions of the webs 302*a* engaging the web 42*a* on both ends between the support members to form the first engagement connection. The U-shaped spacer brace 302 is wider than the hole 36 so the indentation 302*i* ends at the hole 36 and an hole extension 302*he* passes over the bottom edge of the hole 36 at the anchor space 355 with the hook receiver 129 installed on the opposing side of the web 42*a*. When the hole extension 302*he* extends over the bottom edge of the hole 36 the hook receiver 129 having a U-shape end has a downward oriented first leg 129*a* then bending outward 90 degrees forming a second leg 129*b* then bending upward 90 degrees again forming third leg 129*c* leaving a gap 45 between the first & third legs 129*a* & 129*c* forming the second engagement connection. On the right side of the support member or as shown here, another U-shaped spacer brace 302 is shown having the hook tongue 128 on the opposite end. The hook tongue 128 has a receiver extension 302*re* that extends over the third leg 129*c* of the hook receiver 129 that fits into the gap 45 between the downward oriented first leg 129*a* and upward oriented third leg 129*c* thereby completing the third engagement connection by engaging two U-shaped spacer braces 302 together. In addition, a flap 76 is shown extending upward from the receiver extension 302*re* on the tongue side of the spacer brace so the flap 76 can be installed against the web 42*a* of the support member for fasteners (not shown) can pass through the holes into the support member if so required.

Figure 65:
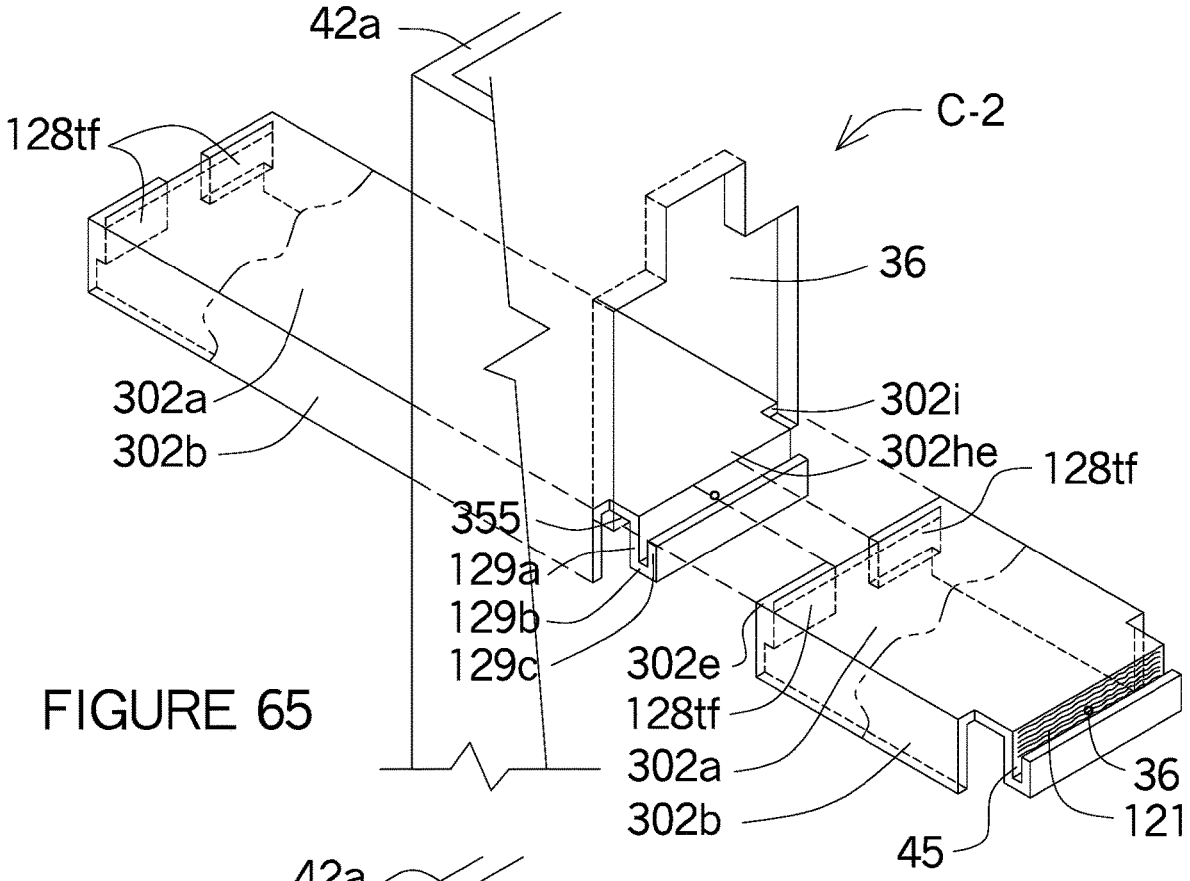
FIG. 65 shows a U-shaped spacer brace where the flanges extend downward from the web and the extension on the interior side extends downward forming a receiver being U-shaped for a tongue having the flanges turned inward forming a flap for the receiver.

FIG. 65 is similar to FIG. 4 except the hook tongue 128 has two tongue flaps 128*tf* that extend inward toward on interior side from the flanges 302*b*. The tongue flaps 128*tf* have a similar function as the hook tongue 128 in FIG. 4; however in FIG. 65 tongue flaps 128*tf* fit into the gap 45 between the downward oriented first leg 129*a* and the upward oriented third leg 129*c* of the hook receiver 129 thereby engaging the U-shape spacer braces 302 together. As previously mentioned the U shaped spacer brace 302 has an indentation 302*i* for the hole extension 302*he* can be supported at the anchor space 355. In addition, the tongue flaps 128*tf* can have any type of fixation means or abrasive means as shown like the grooves 121 to secure the two U shaped spacer braces 302 together.

Figure 66:
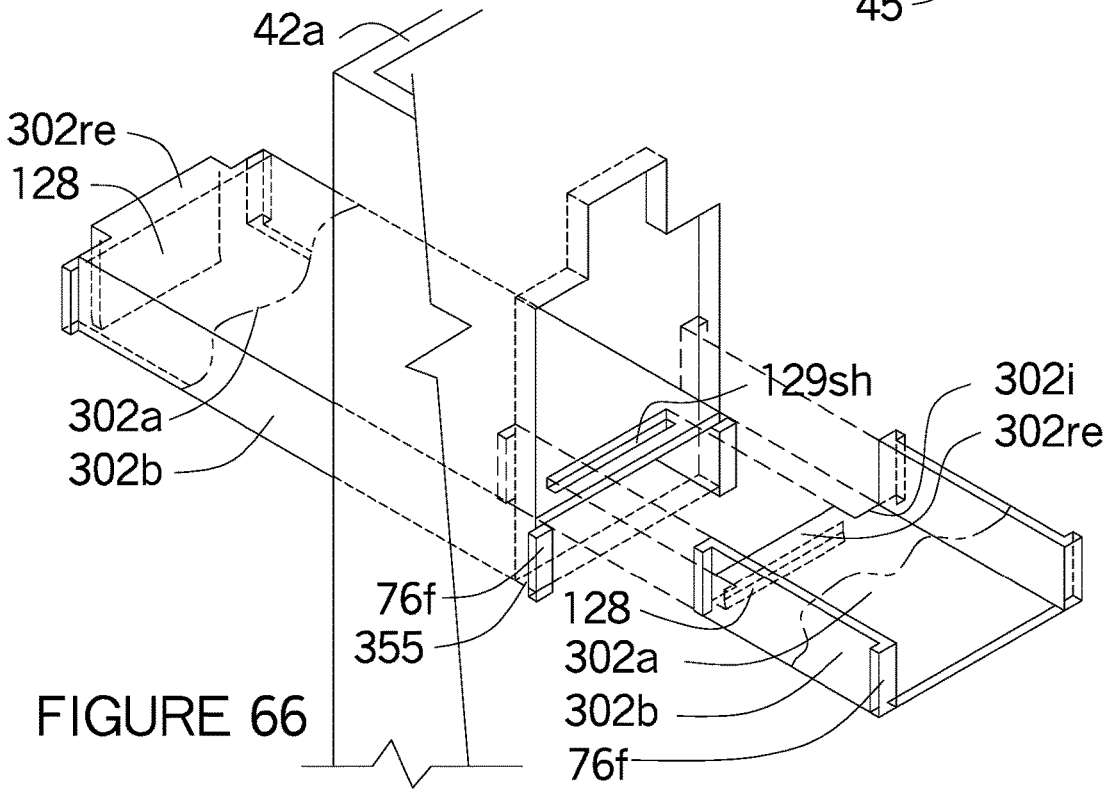
FIG. 66 shows two U-shaped spacer braces where the lower U-shaped spacer brace has the flanges oriented downward while the upper U-shaped spacer brace has the exterior fitting above the lower U-shaped spacer brace for a tongue to fit into the slot hole of the lower spacer brace.

FIG. 66 shows two U-shaped spacer braces 302 fitting over each other. The lower U-shaped spacer brace 302 is downward oriented so the exterior is on top. The upper U shaped spacer brace 302 is oriented upward where the flanges 302*b* extend upward from the web 302*a*. Both the lower and upper U shaped spacer brace 302 are the same width as the hole 36 and both spacer braces the flanges 302*b* with flange flaps 76*f* that extend outward. The flange flaps 76*f* on the U shaped spacer braces 302 make the spacer braces wider than the hole 36 so the U shaped spacer braces 302 have to be turned so the flange flaps 76*f* can extend to the opposing side of the web 42*a*. The lower U shaped spacer brace 302 has a slot hole receiver 129*sh* for the hook tongue 128 from the adjacent shape spacer brace 302 that extends downward can fit into. The left side shows a receiver extension 302*re* that would pass through the hole 36 so the hook tongue 128 could extend into the slot hole receiver 129*sh* of an adjacent U shaped spacer brace 302.

Figure 67:
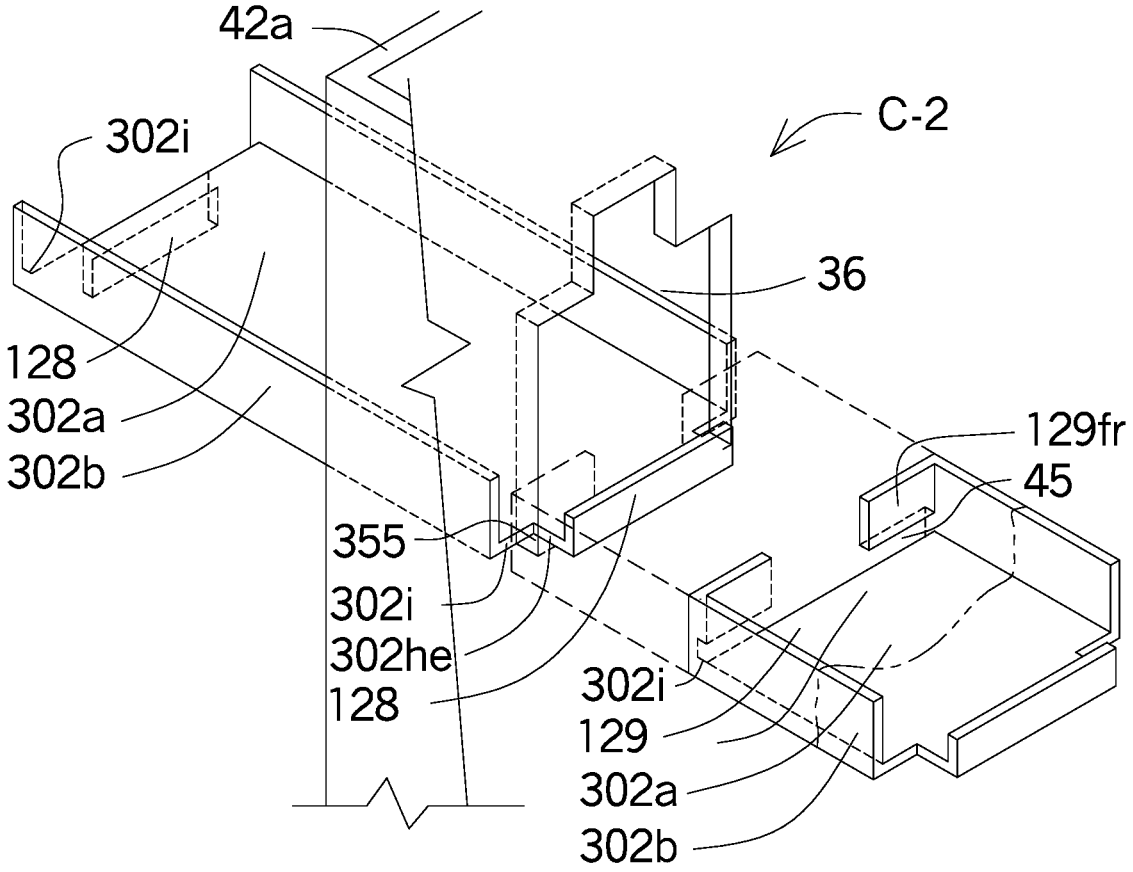
FIG. 67 shows an upward oriented U-shaped spacer brace having the exterior at the bottom edge of the support member hole with an upward receiver for the tongue having two flaps bent inward to fit into the receiver.

FIG. 67 is similar to a combination of some of the earlier U shaped spacer braces 302 where the exterior side is against the anchor space 355 on the bottom edge of the hole 36, but in FIG. 67 the indentation 302*i* with the hole extension 36*he* has a hook tongue 128 extending interior upward and the opposing side of the U shaped spacer brace 302 has flange receiver 129*fr* extend from the flanges 302*b* interior inward from each flange 302*b*. The flange receiver 129*fr* extend far enough away from the web 302*a* so a gap 45 is formed the thickness of the hook tongue 128. The hook tongue 128 fits into the gap 45 so the hook tongue 128 is secured between the interior side of the flange receivers 129*fr* and the edge of the width of the web 302*a*. The opposing side of the flange receivers 129*fr* abuts the web 42*a* of the support member securing the flange receivers 129*fr* and hook tongue 128 by any type of fixation means.

Figure 68:
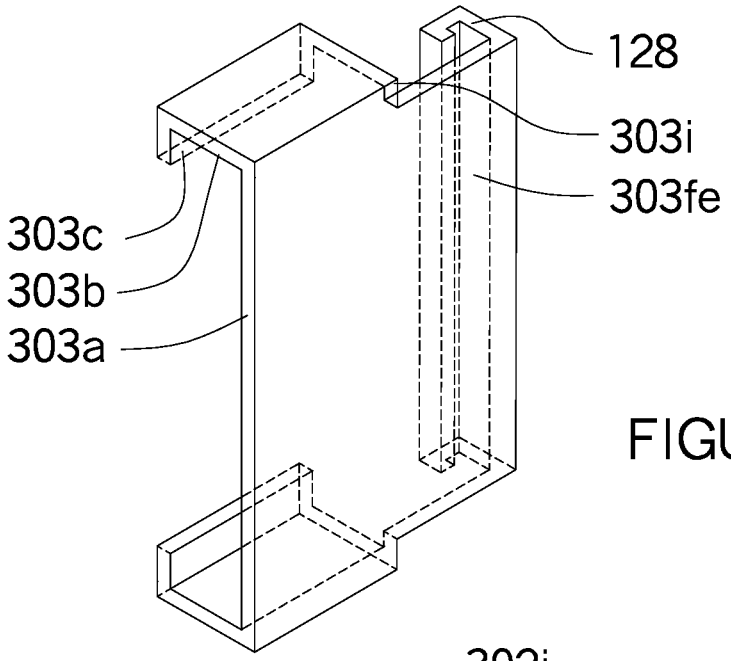
FIG. 68 shows a C-shaped spacer brace having the flanges bent inward on the interior side of the spacer brace.

FIG. 68 shows a C shape spacer brace 303 where the exterior side is vertical and the interior side has flanges 303*b* extending horizontally to the lips 303*c* that extend inwardly forming a C-shape. An indentation 303*i* is formed at the flanges 303*b* and web 303*a* with an flange extension 303*fe* where a hook tongue 128 is shown having a U-shape similar to FIG. 70.

Figure 69:
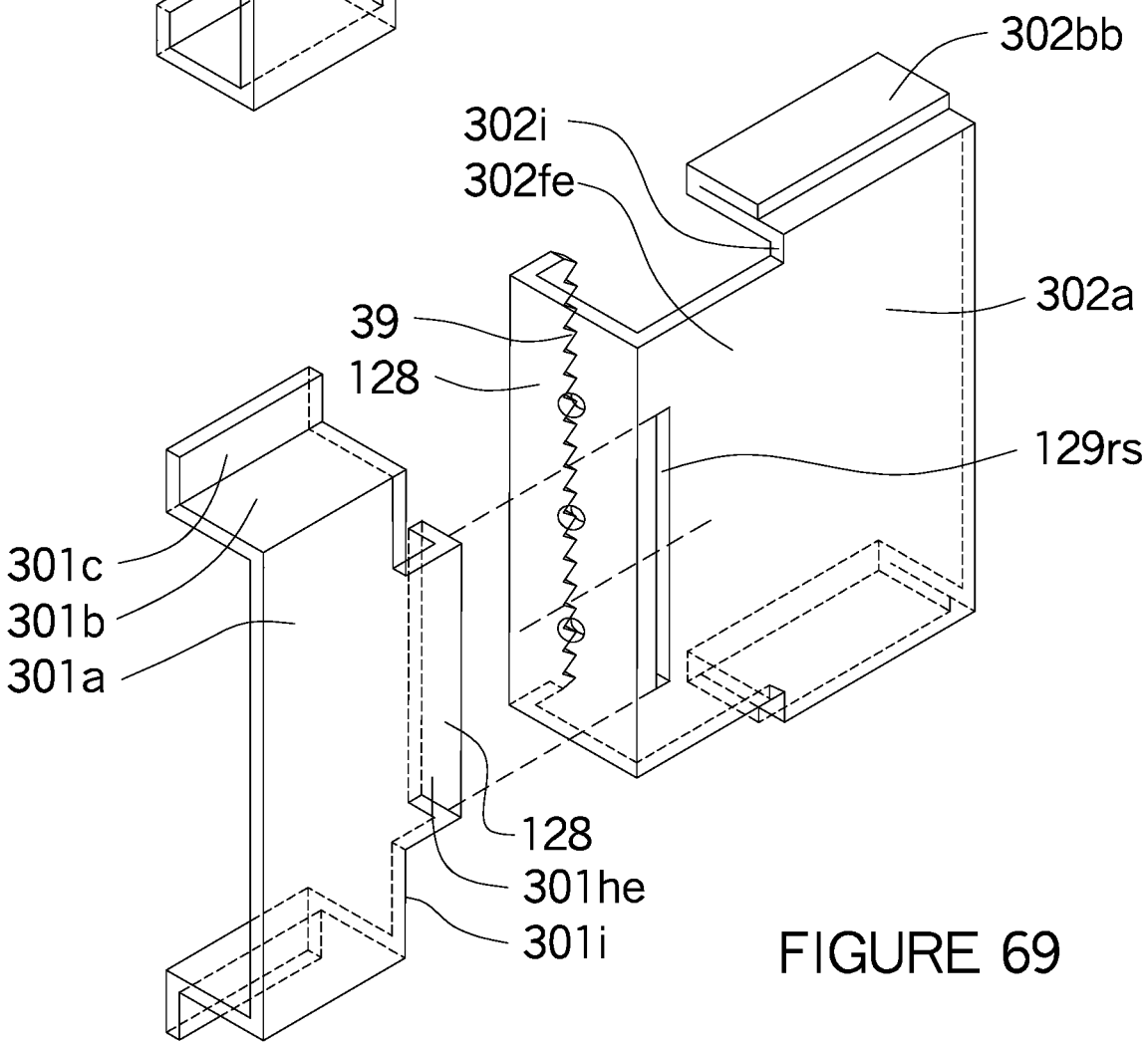
FIG. 69 shows a vertically oriented spacer brace with the lips extending outward having a tough extending into the slot of an adjoining spacer brace.

FIG. 69 shows a reverse lip spacer brace 301 on the left side with a vertical orientation having a web 301*a* with flanges extending internally from the web 301*a* with lip 301 *c* extending outwardly from the flanges 301*b*. The tongue side has an indentation 301*i* with an flange extension 301*fe* and a hook tongue 128 extending inward on the interior side. The vertically oriented adjacent U shape spacer brace 302 has double flanges 302*bb* extending internally with an indentation 302*i* and hole extension 302*he*. The hole extension 302*he* is slightly longer for a receiver slot hole 120*rs* where the hook tongue 128 has an L-shape end with an abrasive edge or fixation connection that would grip a support member placed against it. The interior side of the flange extension is the anchor space 355 and the receiver slot hole 120*rs* along with the hook tongue 128 become the third connection means.

Figure 70:
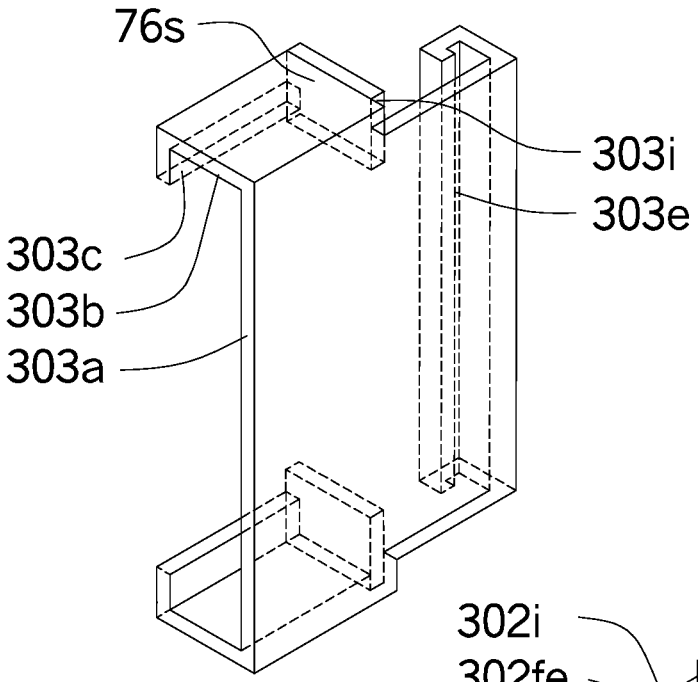
FIG. 70 shows the vertically oriented C-shaped spacer brace where the support flaps are flanges turned inward and abut the support member.

FIG. 70 shows a C-shape spacer brace 303 where the flange 303*b* is bent inward internally so that the bent flange or support flap 78*s* rests against the lip 303*c* giving additional support to the support flap 78*s*.

Figure 71:
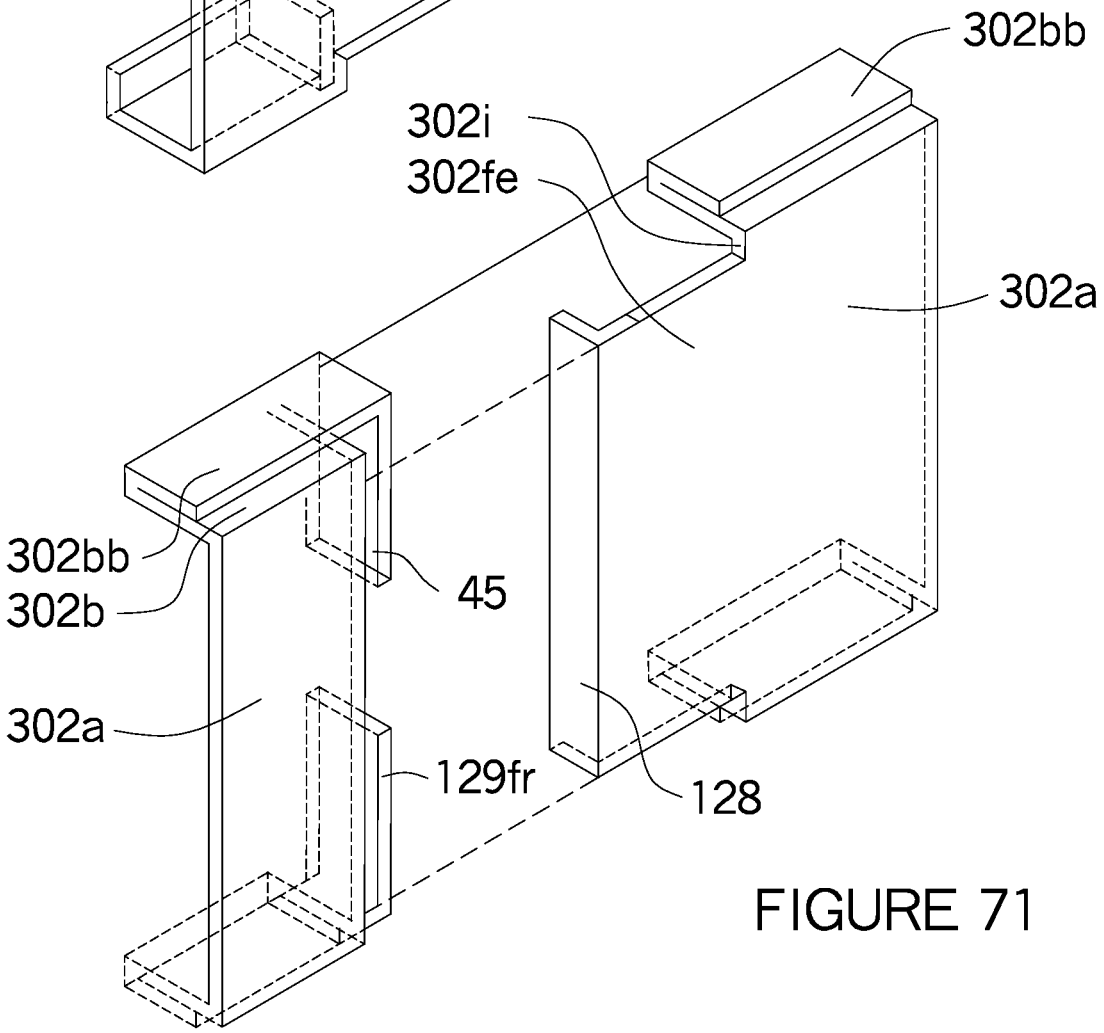
FIG. 71 shows the vertically oriented U-shaped spacer brace having a double flange and where the outer portion of the double flange extends past the web for the tongue to fit between the flaps and the web forming a flange receiver.

FIG. 71 shows the U-shape spacer brace 302 with the double flange 302*bb* on both spacer braces. The left U-shape spacer brace 302 is the receiving end as the outer portion of the double flange 302*bb* is extended longer than the web 302*a* and the inner portion of the web 302*b* so a gap 45 exists when the outer portions of the double flanges 302*bb* are bent inward forming a flap receiver 129*fr*. The adjacent U-shape spacer brace has the indentation 302*i* at the web 302*a* and flanges 302*bb* with a flange extension 302*fe* and a hook tongue 128 bent internally so the hook tongue 128 can fit into the gap 45 between the web 302*a* and inner portion of the flange 302*b* and the interior side of the flange receiver 129*fr*. Not shown, however if the hook tongue 128 were L-shape or U-shape in other figures the ends of the hook tongue 128 would wrap around flange receiver 129*fr*.

Figure 72:
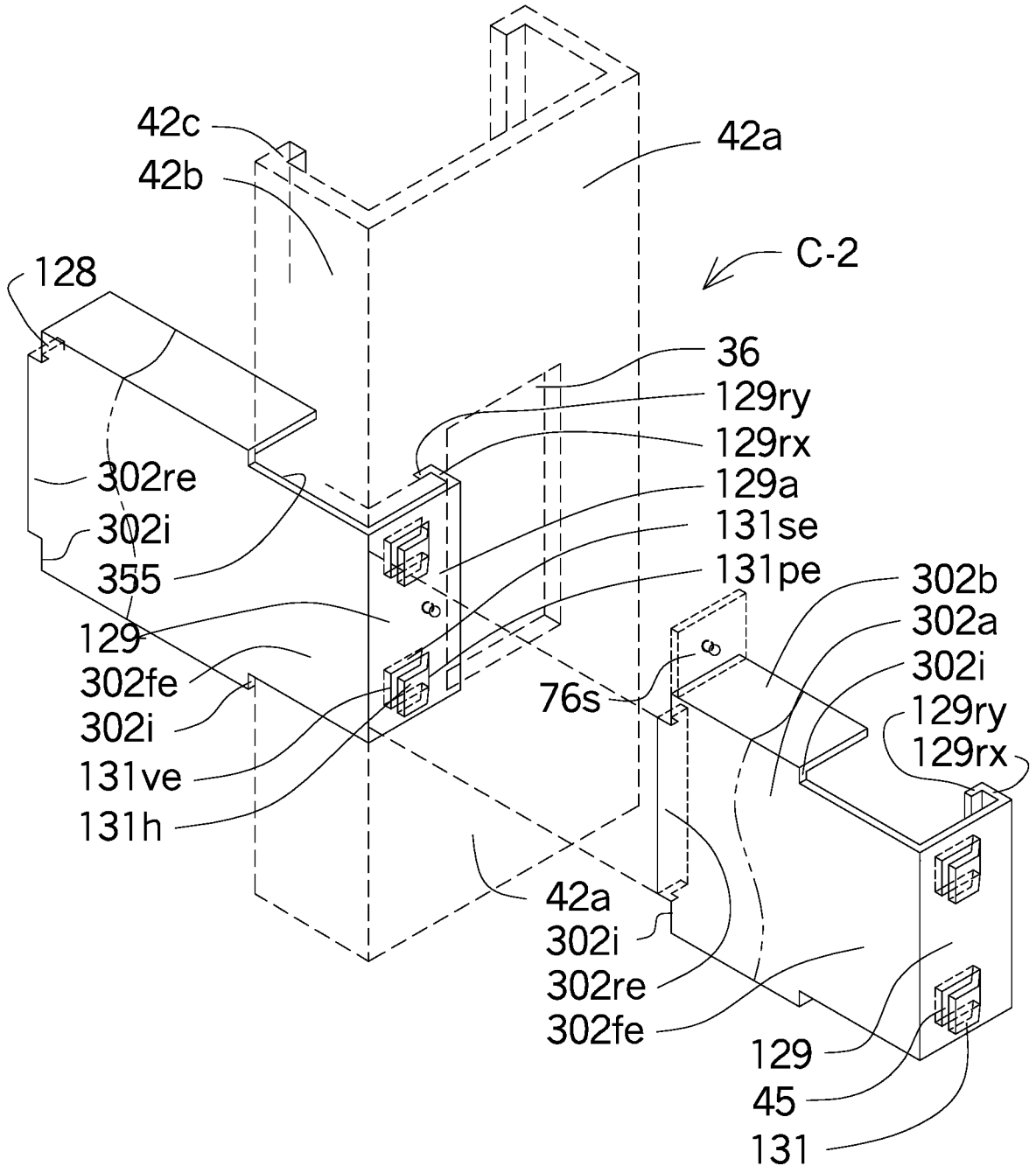
FIG. 72 shows the U-shaped spacer brace extending over the support member with a finger wrapped around the hole and having punched out hooks for a receiver where a tongue is installed into the receiver and support flaps connect to the support member.

FIG. 72 shows vertically oriented U shaped spacer braces 302 being connected at a vertically oriented support member where the left U shape spacer brace 302 having flanges 302*b* that abut the lip 42*c* of the C shaped channel 42 at the indentation 302*i* so the interior side of the flange extension 302*fe* is the anchor space 355 that extends across the flange 42*b* to a hook receiver 129 where the first leg 129*a* is along the web 42*a* then turned 90 degrees across the side edge of the hole 36 at the receiver extension x axis 129*rx* the turned back to the receiver extension y axis 129*ry* on the interior side of the support member at the web 42*a*. The first leg 129*a* has punched out hooks 131 with a vented edge 131*ve* and two side edges 131*se* and a pivot edge 131*pe* where the hook 131*h* protrudes away from the pivot edge 131*pe* leaving a gap 45 for a hook tongue 128 to fit into. Two different hook tongues 128 are shown at each U shaped spacer brace 302. The left hook tongue shows the web 302*a* having a receiver extension 302*re* extend from the web 302*a* at the indentation 302*i* with the hook tongue 128 extending internally inward. The right U shaped spacer brace 302 shows the same hook tongue 128 however support flaps 76*s* extend outward from the flanges 302*b* along with a hole 36 should the support flaps be required to be fastened to the web 42*a*.

Figure 73:
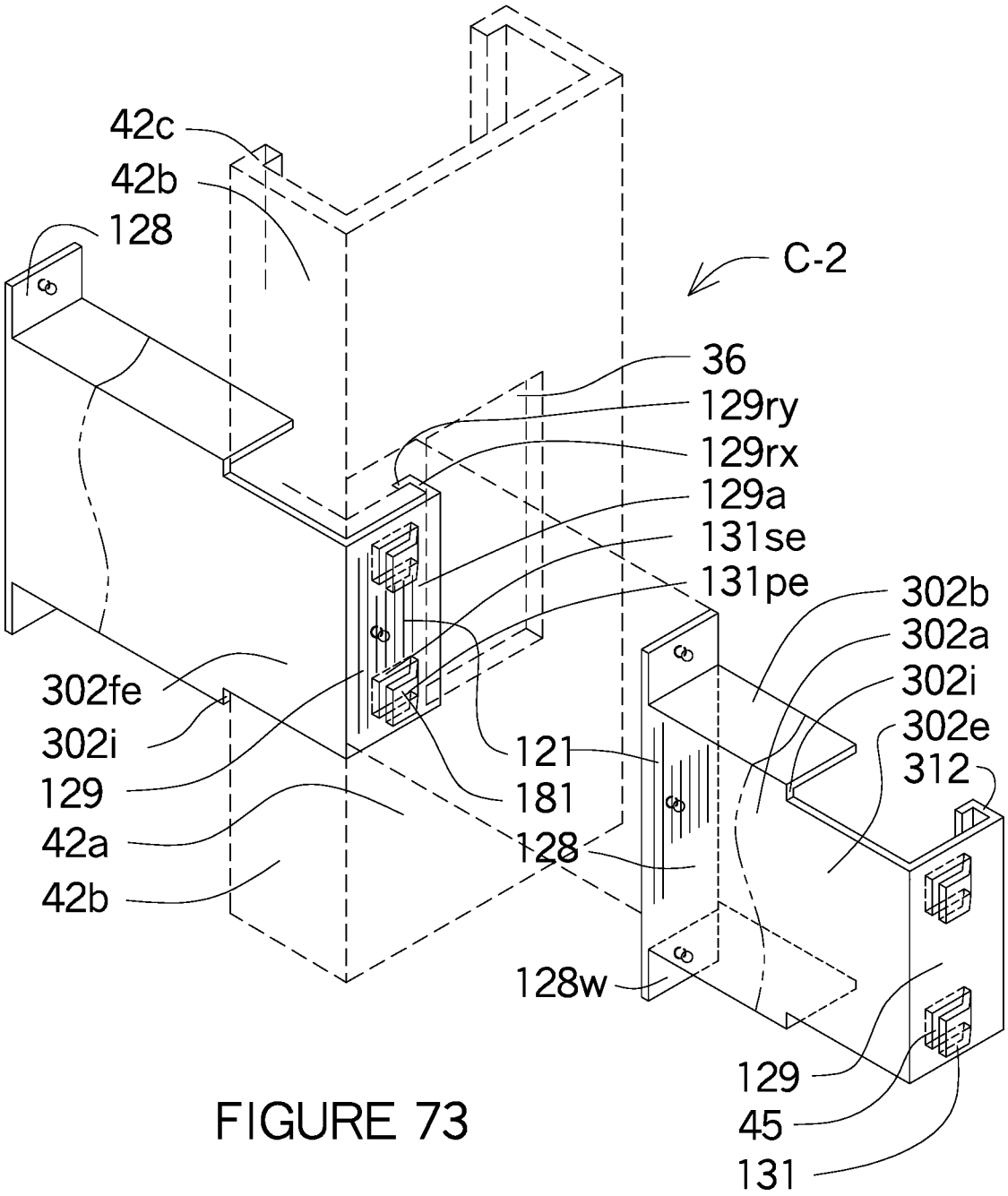
FIG. 73 shows a wider length tongue extending wider than the receiver for the tongue can be fastened to the support member.

FIG. 73 is similar to FIG. 72 except the tongue side has a wide hook tongue 128 where both sides of the hook tongue is an extension of the flanges 302*b* forming the wide hook tongue 128*w* of hook tongue 128. The wide hook tongue 128*w* and the hook tongue 128 are one piece and are separated by cutting the end of the flanges 302*b* prior to bending the hook tongue 128. Groove 121 are shown in both the hook tongue 128 and the first leg 129*a* of the hook receiver 129 to provide a fixation connection over and above the punched out hooks 131 as shown in FIG. 72 that will resist any movement for the two U shaped spacer braces 302 from separating. The wide hook tongue 128*w* function similar to the support flap 76*s* in previous figures.

Figure 74:
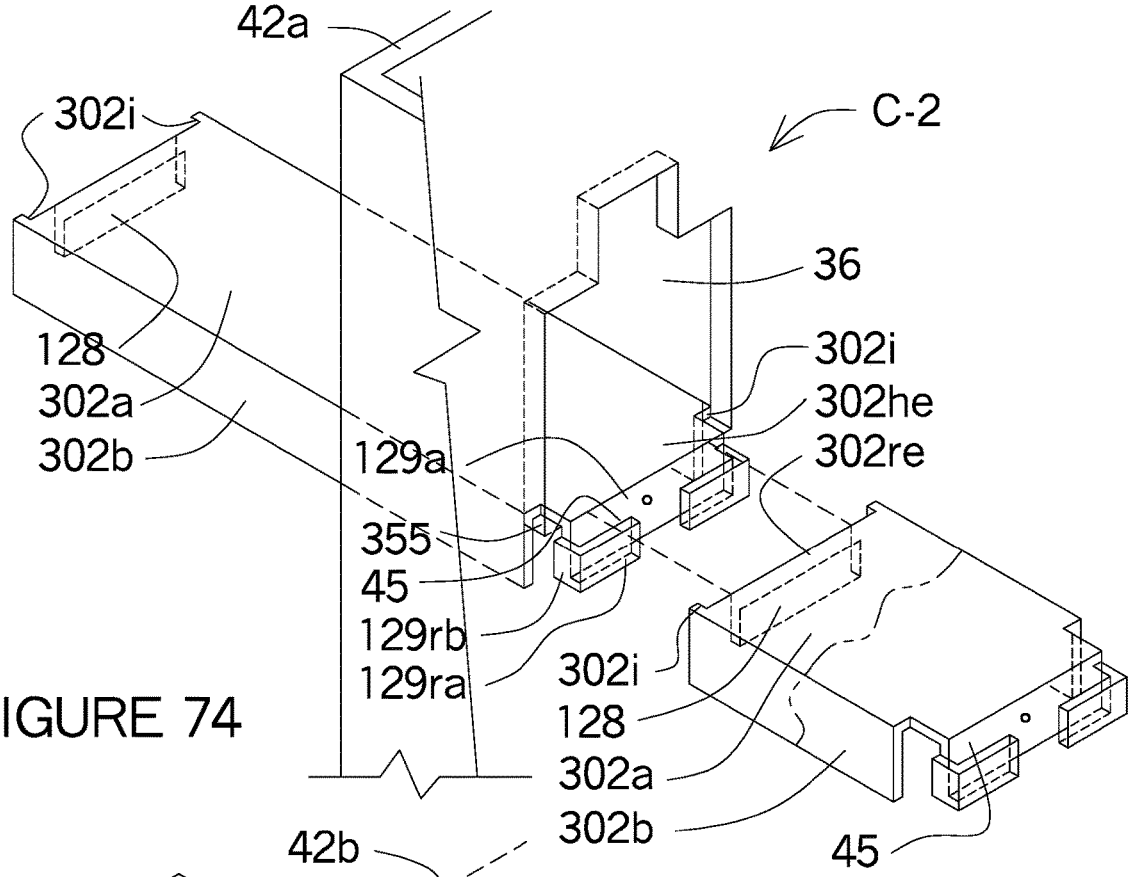
FIG. 74 shows the receiver having receiver elbows and receiver arms at the sides extending outward forming a gap for a tongue to fit into with the extension fitting over the bottom edge of the hole.

FIG. 74 shows the U-shape spacer brace 302 oriented horizontally where the flanges 302*b* extend downward from the web 302*a*. The flanges 302*b* and web 302*a* abut the web 42*a* of the support member at the indentation 302*i* that has a hole extension 302*he* that extends across the bottom edge of the hole 36 at the anchor space 355 where the hook receiver 129 has the first leg 129*a* extend downward over the opposing side of the web 42*a*. The downward oriented first leg 129*a* of the hook receiver 129 has receiver elbows 129*rb* that extend outward with the receiver arm 129*rm* extending in front of the exterior side of the hook tongue 129. The hook tongue 128 of the adjacent U-shaped spacer brace 302 has a receiver extension 302*re* that extends over the receiver arm 129*rm* and fits between the receiver arm 129*ra*, receiver elbow 129*rb* and the first leg 129*a* of the hook receiver 129 securing the hook tongue 128 and hook receiver 129 together. The hook tongue 128 could have an L-shape or U-shape end (not shown) that could wrap around a hole 36 as shown in FIG. 73.

Figure 75:
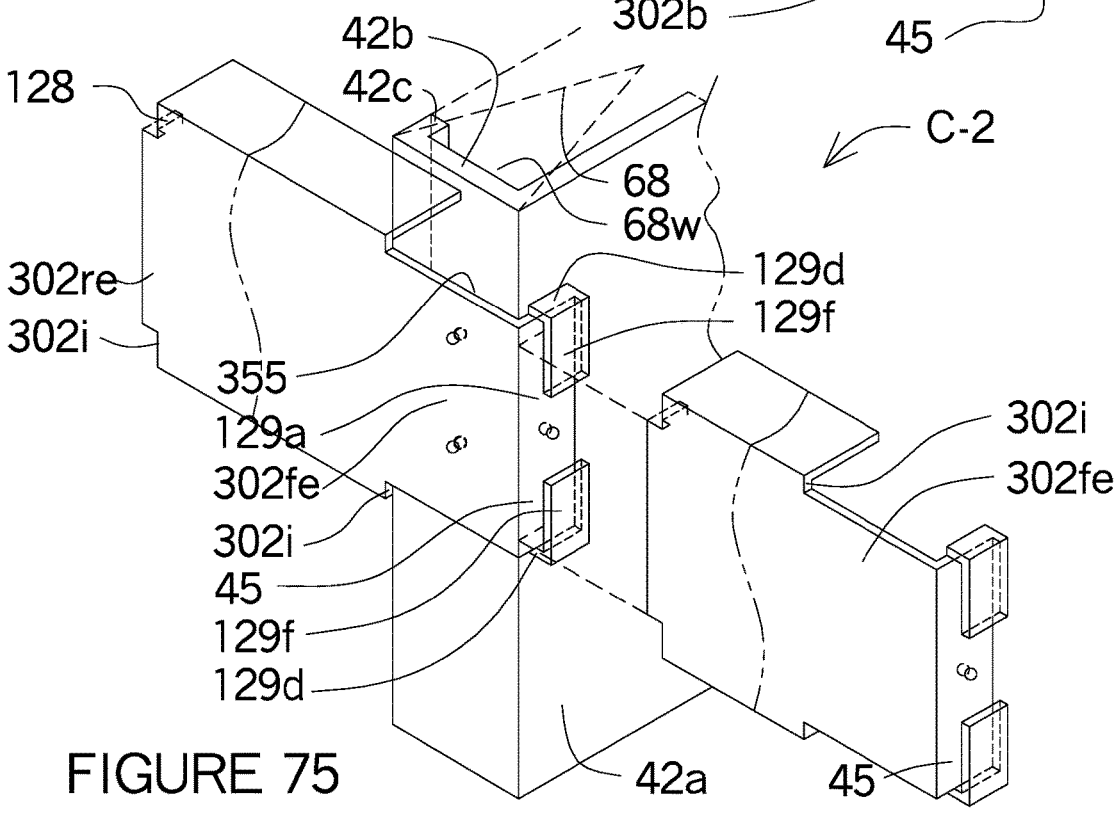
FIG. 75 shows the same configuration as FIG. 74 however the extension is fitting over the flange of a support member.

FIG. 75 is similar to FIG. 74, except the U-shape spacer brace 302 is oriented interiorly and the hole extension 302*he* has its interior side abutting the flange 42*b* of a C shape channel 42 and the anchor space 355 abuts the outer surface of wood frame members 68 at the width 68*w* or the flange 42*b* of a C channel 42 at the flange extension 302*fe*.

Figure 76:
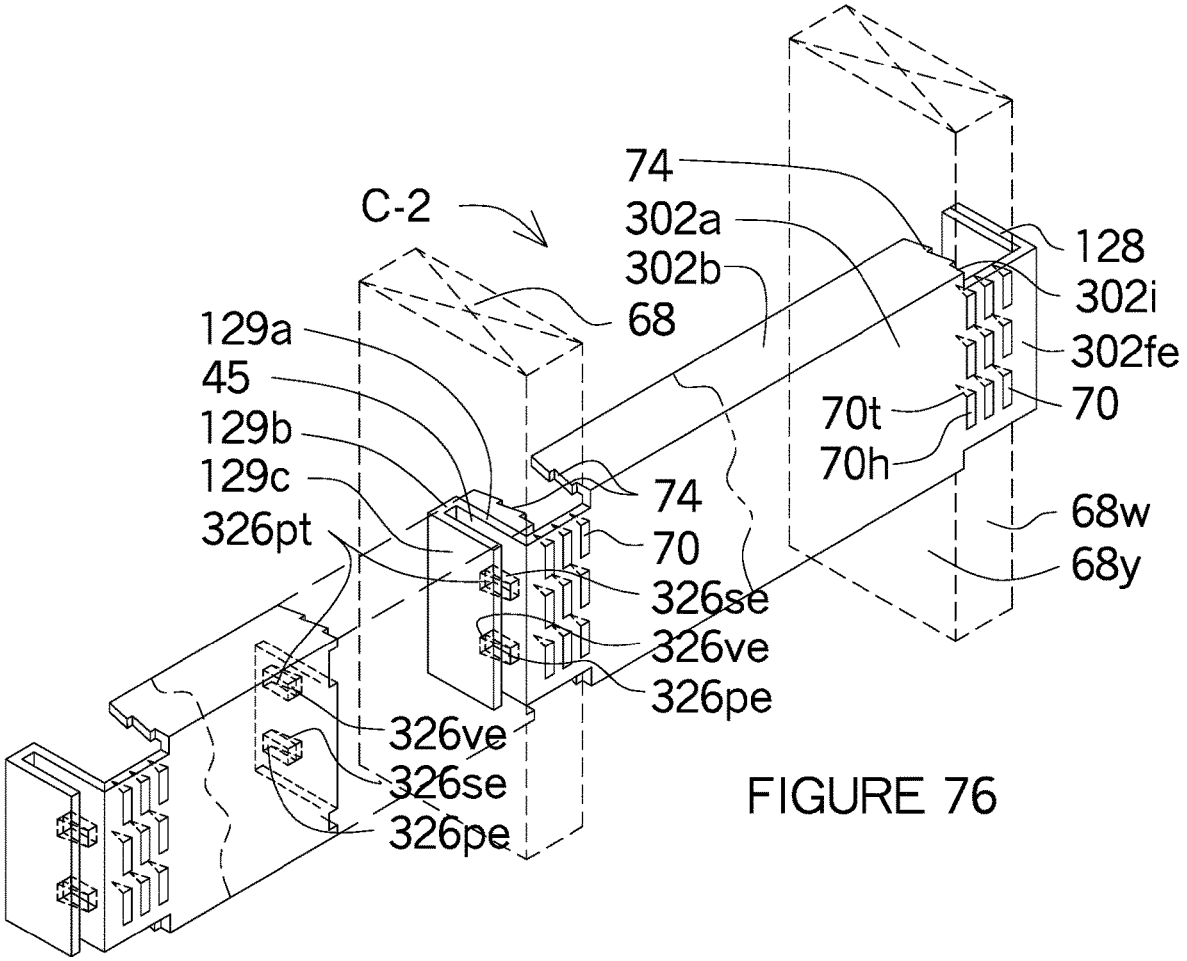
FIG. 76 shows the U-shaped spacer brace with the U-shape hook receiver at one end and an adjacent spacer brace with its L-shape hook tongue extending into the U-shape hook tongue.

FIG. 76 shows the U-shaped spacer braces 302 installed with the interior side in a vertical orientation and installed over vertically oriented wood framing members 68. The web 302 has two flanges 302*b* extending outwardly with jagged edges 74 at the ends of the flanges 302*b* that penetrate the depth 68*d* into the wood framing members 68. The flanges 302*b* and webs 302*a* are indented at the depth 68*w* at the indentations 302*i* and the flange extension 302*fe* extends over width 68*w* of the wood framing member 68 also referred to as the anchor space 355 to the opposite side of the depth 68*d* for a hook receiver 129 having a first leg 129*a* then extended 90 forming the second leg 129*b* and extending parallel to the first leg 129*a* forming a gap 45 between, the first leg 129*a* and the third leg 129*c*. Fasteners can be installed in the hook receiver 129 or at the extension 302*e* for a secure connection. Punched hole teeth 70 are shown on the exterior side of the extension 302*e* in the U shaped spacer brace 302 so the teeth 70*t* for the punched hole 70*h* can penetrate the wood framing member 68. The opposing end of the U-shaped spacer brace 302 shows the hook tongue 128 or when the adjacent U-shaped spacer brace 302 is installed, the hook tongue 128 fits into the hook receiver 129. Other types of receiver ends similar to the hook receiver 129 are shown in some of the other additional figures. In addition, the hook receiver 129 can have bumps, abrasions or any other connection to create frictional connection between the interior side of the hook receiver 129 at the wood framing member 68 or metal framing members shown in other figures. Typically the T shaped spacer brace 302 is wider than the hook receiver 129 in order for the flanges 302*b* with the jagged edges 74 to extend into the wood framing member 68.

Figure 77:
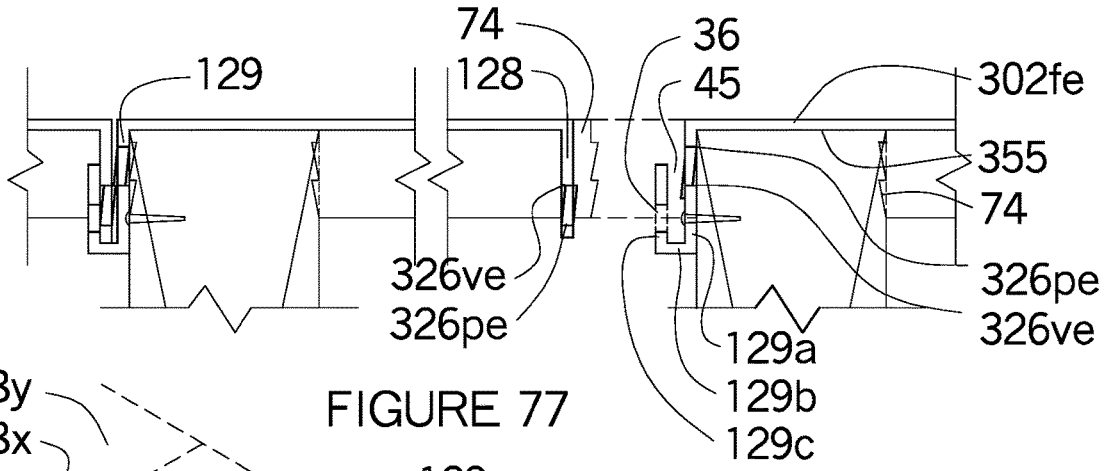
FIG. 77 shows a section through the spacer brace at the U shaped hook receiver and the L-shape hook tongue intersecting.

FIG. 77 is a vertical section of the isometric view in FIG. 76 where the U shape spacer brace 302 has the exterior side on the top side 302*a* with the flanges 302*b* extending interiorly downward. The jagged edges 74 are engages in the wood framing member 68 and the extension 302*e* extends over the top edge of the wood framing member 68 and the U shaped hook receiver 129 extends downward over the opposite edge of the wood framing member 68 as shown at the first leg 129*a* and extended horizontally forming the second leg 129*b* is then bent outward to form a gap 45 when the third leg 129*c* is bent upward. The adjacent U shape spacer brace show the opposite end having a hook tongue 128 that fits into the gap 45 of the hook receiver of an adjacent U shaped spacer brace 302. The jagged edges 74 of the flanges 302*b* are slightly longer that the hook tongue 128 so the jagged edges 74 can engage the wood framing member 68.

Figure 78:
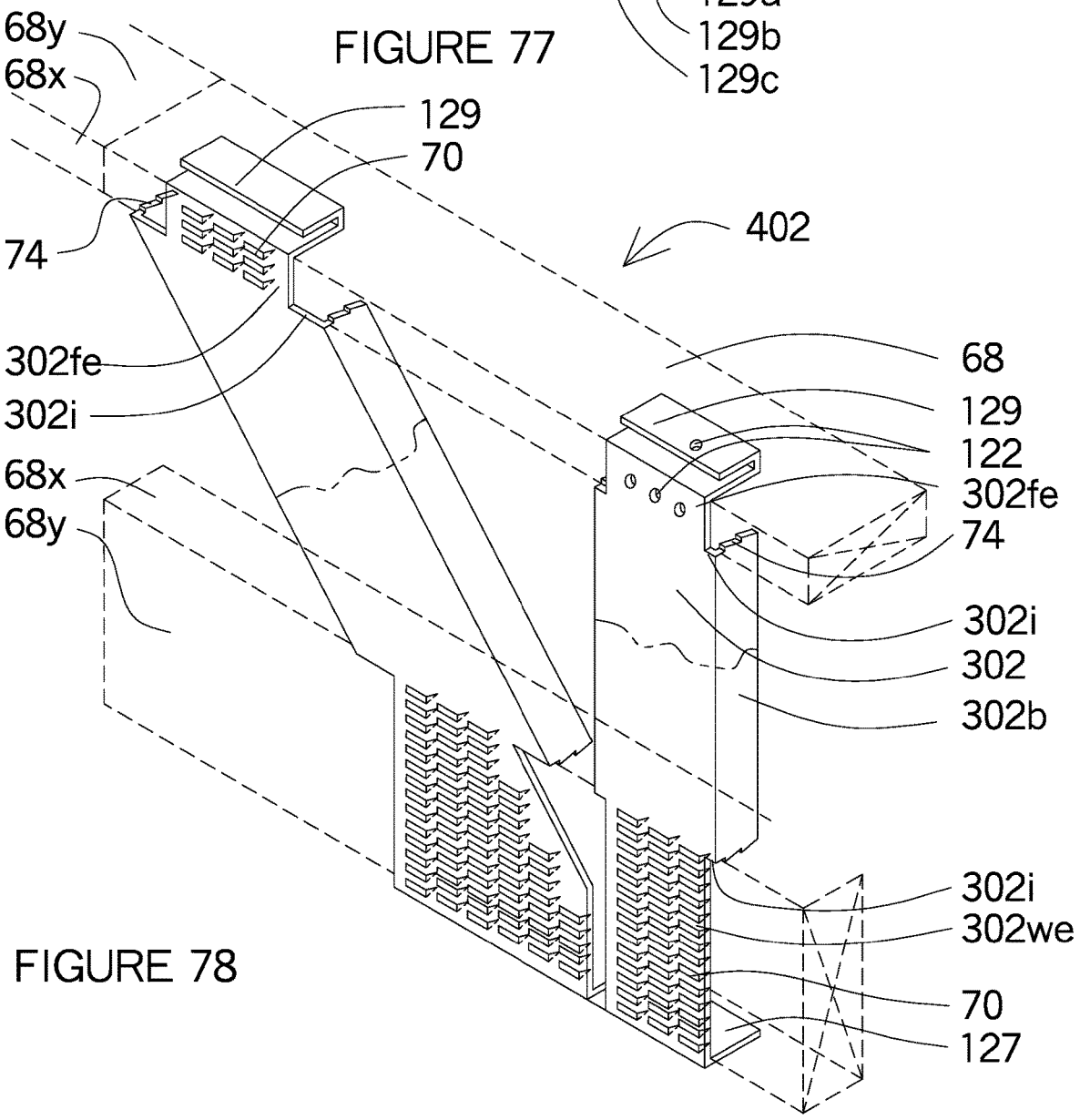
FIG. 78 shows a truss joist where the horizontal support members are wood with one spacer brace oriented vertically and the other diagonally both having jagged edges at the flanges and the punched teeth extending into the support members.
Figure 79:
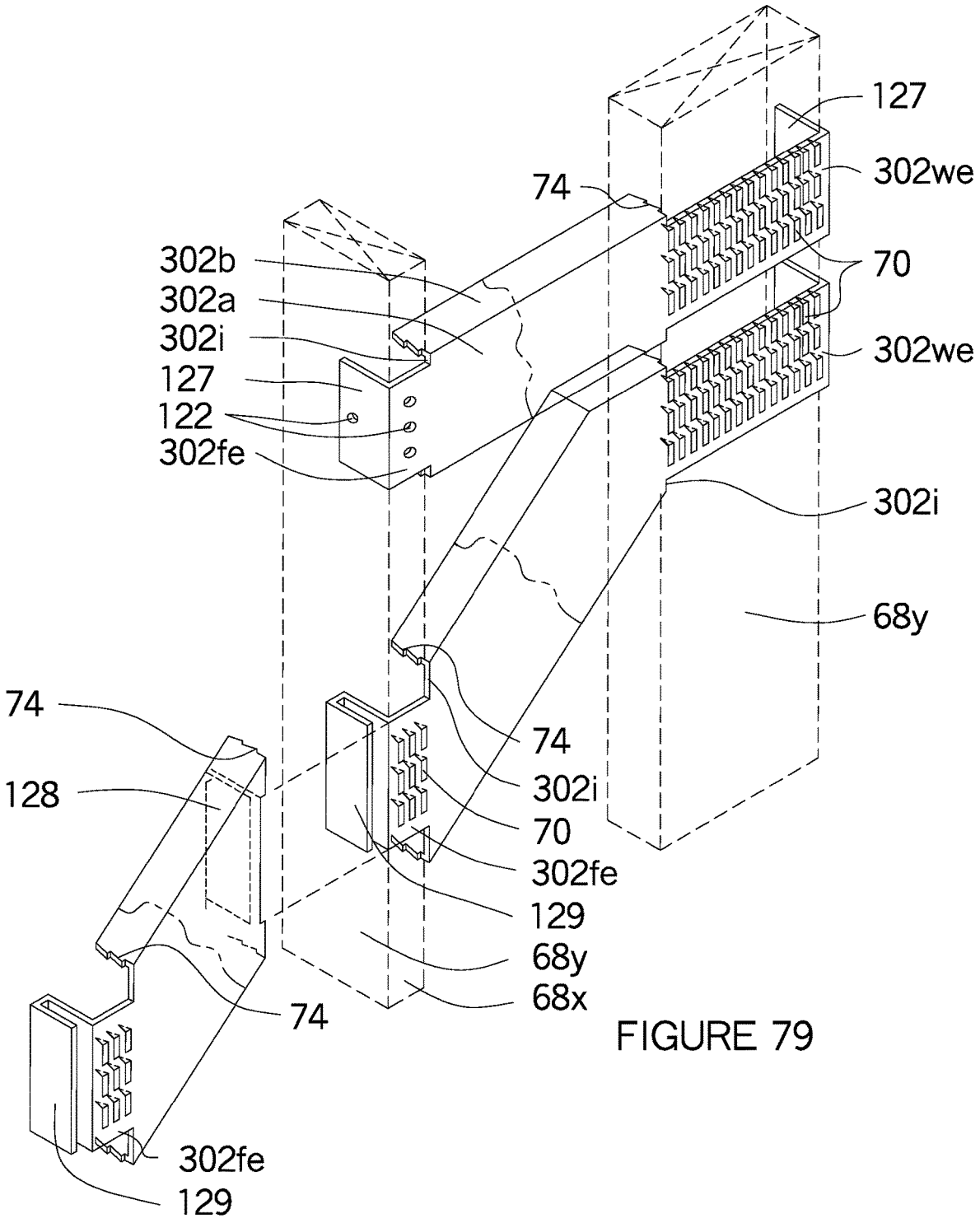
FIG. 79 shows a similar configuration as FIG. 78 except the wood support members are oriented vertically and the diagonal spacer brace has the U-shaped hook receiver with the adjacent spacer brace having an L-shaped hook tongue for connection.

FIGS. 78-79 are similar except in FIG. 78 the wood framing members 68 are shown as horizontal support members to form truss joists 402 that are shown in C-8 in FIG. 1. Truss joists 402 are typically joists that have a horizontal top and bottom chord (shown in ghost) shown as wood framing members 68 and diagonal chords connect the top and bottom chords shown in FIG. 78 as U-shaped spacer braces 302. In FIG. 79 the wood framing members 68 (shown in ghost) are vertical support members for a wood framed wall and the U-shaped spacer braces 302 are used as lateral and diagonal bracing between the support members. The wood support members 68 in FIG. 78 are shown parallel to each other for a floor joist, however if the top member was at an angle a triangular truss could be formed using different length U shaped spacer brace 302. The truss joist 402 is shown to having horizontally oriented top and bottom chords and connected by vertically oriented independent U shaped spacer braces 302 where the web 302*a* intersects the top chord at the indentation 302*i* along with the end of flanges 302*b* having jagged edges 74 are extended into the depth 68*d* side of the top cord. The left U shaped spacer brace 302 is shown installed at a diagonal while the right U shaped spacer brace 302 is installed vertically. The web 302*a* extends at the flange extension 302*fe* at the width 68*w* side or anchor space 355 to the hook receiver 129 at the top chord while the bottom chord has a web extension 302*we* at the anchor space 355 fitting over the depth 68*d* side of the bottom chord. The flange extension 302*fe* and web extension 302*we* have punched hole teeth 70 where the teeth 70*t* extend into the top and bottom chords as well as the jagged edges 74. FIG. 79 is similar however instead of horizontal chords to form a truss joist 402, the support members are vertical as typically used to frame walls. The U shaped spacer brace 302 in FIG. 79 has their webs 302*a* oriented vertically, however one U shaped spacer brace 302 is installed horizontally and the other is installed diagonally. The diagonal U shaped spacer brace 302 on the right side having the depth 68*d* side having the web extension 302*we* and the left side have the width 68*w* side have the flange extension 302*fe* at the anchor spaces 355. Both the flange and web extensions 302*fe* & 302*we* have the punched hole teeth 70. The right side shows the web 302*a* having a bend so the web extension 302*we* fits over the depth 68*d* side perpendicular to the support member, while the left side shows the web 302 abut the support member at the directional angle of the U shaped spacer brace. One end of the U shaped spacer brace 302 has a hook finger 127 and the opposite end has a hook receiver 129.

Figure 80:
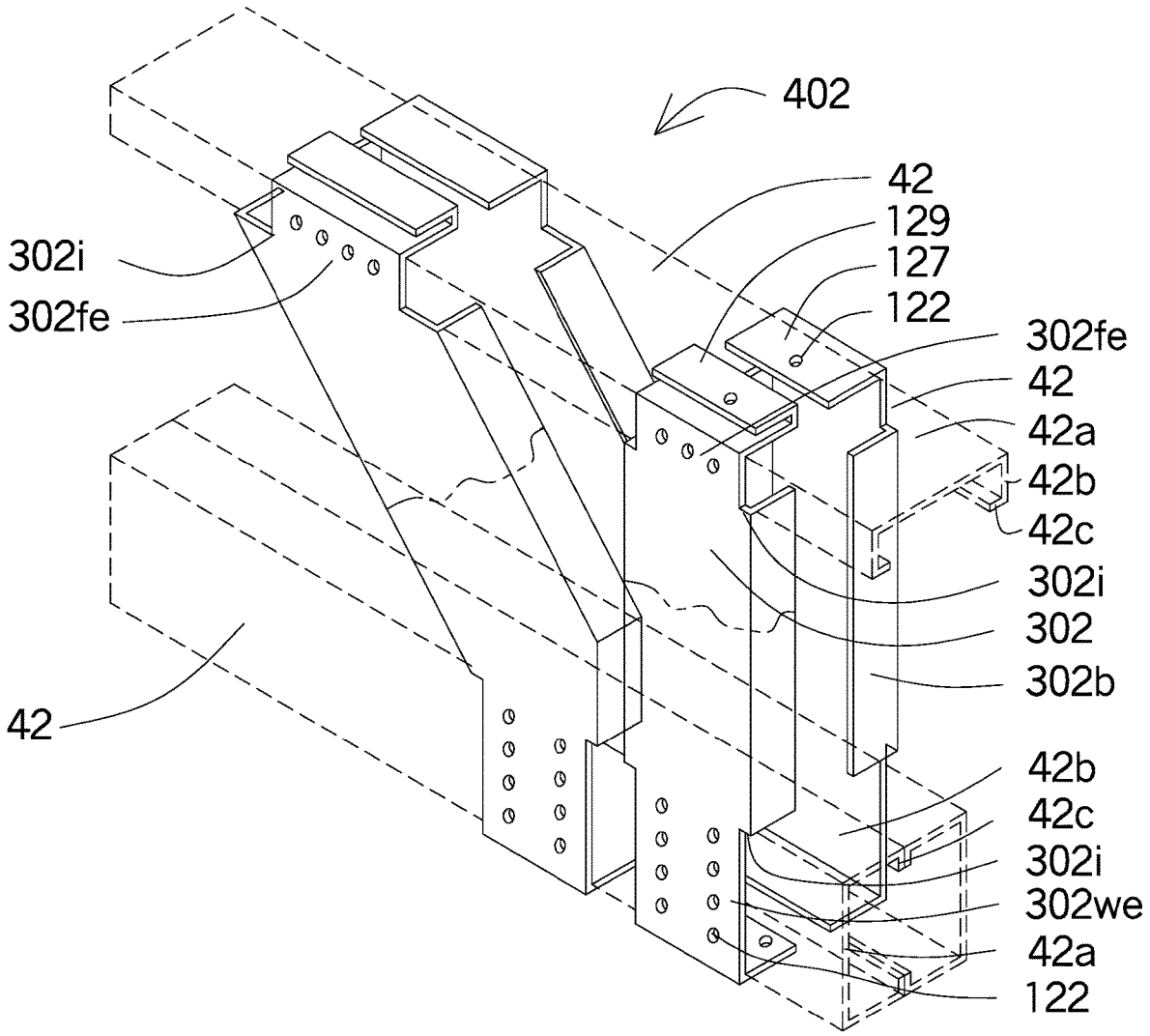
FIG. 80 shows a similar configuration as FIG. 78 except metal framing is used and two spacer braces are used in the bottom chord.

FIG. 80 is similar to FIG. 78 as they are both truss joist 402; however the FIG. 15 uses metal framing members as the support members. The top chord (shown in ghost) shows a C channel 42 with the exterior side having a web 42*a* oriented horizontally with two sides extending vertically with lips 42*c* extend horizontally inward to each other and are parallel to the web 42*a*. The lower chord (shown in ghost) of the truss joist 402 shows a C channel with a vertical exterior having a web 42*a* with two sides extending outwardly connected with lip extending inwardly toward each other. The U-shaped spacer braces 302 connect the top and bottom chords where the exterior sides are vertical and have a web 302*a* with two extending sides 302*b* that abut the interior side of the lip 42*c* of the upper chord and the top side of flange 42*b* of the bottom chord. The web 302*a* of the U-shaped spacer brace 302 at the top chord has an indentation 302*i* and a flange extension 302*fe* that extends over the upper chord flange 42*b* with a hook receiver 129 extending over the web 42*a*. The bottom end of the U shaped spacer brace 302 has an indentation 302*i* and a web extension 302*we* that extends over the bottom chord web 42*a* with a hook finger 127 extending over the flange 42*b*. The diagonally oriented spacer braces continually are placed between the top and bottom chords at repeating intervals until the truss joist 402 has reached its designated length. The above description is referring to a single row of U-shaped spacer braces 302; however another row of spacer braces has been added. The lower chord (shown in ghost) has another horizontal C channel 42 adjacent to the first C channel where the lips 42*c* abut each other. Since the top chord (shown in ghost) is orientated horizontally that is the exterior is horizontal rather than vertical, the second U-shaped spacer braces can be installed as previously described.

The present invention of the unique spacer braces are so versatile that the spacer brace allows for a much easier and quicker installation of metal or wood framing wall, constructing wood or metal truss joists, installing horizontal and diagonal lateral bracing between wood or metal floor joists, installing hold-down spacer bracing at floors between wood or metal framing, installing horizontal and diagonal braces between wood or metal support members either between holes or at the flanges. The spacer braces are additionally secured to the support members when the hook fingers have U-shape of C-shape ends.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

FIGURE NUMBER GLOSSARY OF TABLE OF CONTENTS

36 hole: 36*be*—hole bottom edge, 36*se*—hole side edge, 36*s*—slot hole, 36*t*—triangular shaped hole
36*r* rim
42 C channel 42*a*—web, 42*b*—flange, 42*c*—lip
45 gap
68 wood framing member
68*d* depth
68*w* width
70 punched hole teeth: 70*t*—teeth, 70*h*—punched hole
74 jagged edges
76 flap: 76*f*—flange flap, 76*s*—support flap, 76*b*—bent flap
98 bent angle: 98*e*—extension
121 groove
122 fasteners
126 notches: 126*rm*—rim notch,
127 hook finger
128 hook tongue: 128*a*—first side, 128*b*—second side, 128*w* wide hook tongue,
128*f*—flare, 128*tf*—tongue flap
129 hook receiver: 129*a*—first leg, 129*b*—second leg, 129*c*—third leg, 129*d*—slanted leg, 129*e*—extension side, 129*s*—end stop, 129*f*—flare, 129*k*—kink, 129*eg*—elongated, 129*rb*—receiver elbow, 129*ra*—receiver arm, 129*rx*—receiver extension X, 129*ry*—receiver extension Y, 129*sh*—receiver slot hole, 129*wr*—wide hook receiver, 129*fr*—flange receiver,
131 punched out hooks: 131*ve*—vented edge, 131*pe*—pivot edge, 131*h*—hook, 131*se*—side edge,
301 reverse lip spacer brace: 301*a*—web, 301*b*—flange, 301*c*—lip, 301*p*—punchout hole, 301*b*—bulge, 301*he*—hole extension, 301*i*—indentation, 301*fe*—flange extension, 302*he*—hole extension
302 U shaped spacer brace: 302*a* web, 302*b* flange, 302*c* lip, 302*bb*—double flange, 302*sb*—sharp budge, 302*fc*—flared lip, 302*we*—web extension, 302*fe*—flange extensions, 302*he*—hole extension, 302*re*—receiver extension, 302*e*—extension (general)
303 C shaped spacer brace: 303*a*—web, 303*b*—flange, 303*c*—lip, 303*g*—bulge
305 I shaped spacer brace: 305*a*—web, 305*b*—flange, 305*bb*—double flange, 305*he*—hole extension, 305*i*—indentation
306 J shaped space brace: 305*a*—web, 305*b*—flanges, 305*i*—indentation, 306*he*—hole extension
307 W—shaped clip: 307*a*—web, 307*b*—flange, 307*e*—elongated W—shaped clip
308 U—shaped clip: 308*a*—web, 308*b*—flange
309 hold—down spacer brace: 309*a*—web, 309*b*—flange, 309*e*—extension, 309*i*—indentation, 309*we*—web extension
310 hold—down bracket: 310*a*—web, 310*b*—flange, 310*f*—end plate, 310*i*—indentation
313 add—on connector: 313*a*—web, 313*b*—flange, 313*ae*—add—on extension, 313*we*—web extension, 313*i*—indentation
314 strap brace: 314*a*—web, 314*b*—flange, 314*re*—receiver extension
320 ridges
321 dimples
322 one piece hold—down spacer brace—bracket 322*a*—web, 322*b*—web
354 anchor bolt
355 anchor space
401 floor 401
402 truss joist—chords (no numbers)

The invention claimed is:

1. A longitudinal self-locking connector for building support framing comprising:

a web having a first side and a second side opposite said first side, a first end and a second end opposite said first end;

a first flange extending along said first side and a second flange extending along said second side, said first flange and said second flange having a first width and being substantially parallel and extending in a first direction substantially perpendicular to said web;

a receiver at said first end of said connector and having a first wall having a second width and a second wall having a third width and being substantially parallel to the first wall and defining a space therebetween, said second width being greater than said third width, said first wall and said second wall having respective facing inner surfaces being planar and abrasive;

a tongue at said second end of said connector and having a third wall substantially parallel to said first wall, said tongue terminating in a free distal end, said tongue having a first planar abrasive side and a second planar abrasive side opposite said first abrasive side, said tongue configured to be received in a receiver of a second substantially identical connector to form a locked connection.

2. The self-locking connector of claim 1, further comprising:

a third flange connected to a distal end of said first flange and a fourth flange connected to a distal end of said second flange, said third flange and said fourth flange having a second width being greater than said first width and being substantially parallel and extending in a direction substantially parallel to said web or opposite said first direction.

3. The self-locking connector of claim 1, further comprising:

a support member having a web and a first flange and a second flange; said web of said support member having an aperture extending therethrough, said receiver of said connector being placed through said aperture, and a tongue of a second substantially identical connector being received in said receiver.

4. The self-locking connector of claim 3:

wherein said web and said flanges of said connector have a cut out section braced against said web of said support member with said web of said connector extending through said aperture of said support member.

5. The self-locking connector of claim 1, further comprising:

a support member having a web and a first flange and a second flange, each said first flange and said second flange of said support member having a respective distal end and having a lip extending from said distal ends of said first flange and said second flange of said support member, said web of said connector having an extension being placed against said flange of said support member.

6. The self-locking connector of claim 1:

wherein the first end of said web receives a second end of a substantially identical second receiver and said second end of said web receives a first end of a substantially identical third receiver to form a locked connection among said self-locking connector, said substantially identical second receiver and said substantially identical third receiver.

7. The self-locking connector of claim 1:

wherein said first wall and said second wall of said receiver are curvilinear and flexible.

8. The self-locking connector of claim 1, further comprising:

a plurality of teeth protruding from said web of said connector.

9. The self-locking connector of claim 1:

wherein said first flange and said second flange have longitudinal ends, each said longitudinal end further comprising a plurality of protrusions extending therefrom.

10. The self-locking connector of claim 1, further comprising:

a plurality of screws or nails configured to be used in connecting to a support member.

11. The self-locking connector of claim 1:

wherein said receiver has an aperture in said first wall and having a fastener configured to secure said first wall to a web of a support member.

12. The self-locking connector of claim 11:

wherein said aperture is a slot.

13. The self-locking connector according to claim 1:

wherein said tongue has a tongue extension being substantially perpendicular to said first wall and said second wall of said receiver.

* * * * *